US010306364B2

(12) United States Patent
Sheen et al.

(10) Patent No.: US 10,306,364 B2
(45) Date of Patent: May 28, 2019

(54) AUDIO PROCESSING ADJUSTMENTS FOR PLAYBACK DEVICES BASED ON DETERMINED CHARACTERISTICS OF AUDIO CONTENT

(71) Applicant: Sonos, Inc., Santa Barbara, CA (US)

(72) Inventors: Timothy W. Sheen, Brighton, MA (US); Michael Darrell Andrew Ericson, Santa Barbara, CA (US); William H. Bush, Santa Clarita, CA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

(21) Appl. No.: 14/620,937

(22) Filed: Feb. 12, 2015

(65) Prior Publication Data

US 2015/0163596 A1 Jun. 11, 2015

Related U.S. Application Data

(63) Continuation of application No. 13/630,565, filed on Sep. 28, 2012, now Pat. No. 9,008,330.

(51) Int. Cl.

| | |
|---|---|
| ***H04R 3/04*** | (2006.01) |
| ***H04R 3/14*** | (2006.01) |
| ***H04R 27/00*** | (2006.01) |

(52) U.S. Cl.

CPC ..... *H04R 3/04* (2013.01); *H04R 3/14* (2013.01); *H04R 27/00* (2013.01);

(Continued)

(58) Field of Classification Search

CPC ..... H04R 3/14; H04R 3/04; H04S 7/307

(Continued)

(56) References Cited

U.S. PATENT DOCUMENTS

| | | | |
|---|---|---|---|
| 3,956,591 | A | 5/1976 | Gates, Jr. |
| 4,105,974 | A | 8/1978 | Rogers |

(Continued)

FOREIGN PATENT DOCUMENTS

| | | | |
|---|---|---|---|
| CA | 2320451 | A1 | 3/2001 |
| CN | 1598767 | A | 3/2005 |

(Continued)

OTHER PUBLICATIONS

Non-Final Office Action dated Jan. 29, 2016, issued in connection with U.S. Appl. No. 14/937,523, filed Nov. 10, 2015, 10 pages.

(Continued)

*Primary Examiner* — Alexander Jamal

(74) *Attorney, Agent, or Firm* — McDonnell Boehnen Hulbert & Berghoff LLP

(57) ABSTRACT

Methods and systems are provided for adjusting a crossover frequency between a plurality of audio speakers rendering audio content. In one example, a first subset of a plurality of audio speakers may be rendering a first sub-range of a range of audio frequencies of an audio content, and a second subset of speakers of the plurality of audio speakers may be rendering a second sub-range of the range of audio frequencies. In this example, the first sub-range and the second sub-range may be substantially separated at the crossover frequency. In one case, a characteristic of the audio content may be determined, and the crossover frequency may be adjusted based on the determined characteristic to help improve the audio content rendering quality by the respective subsets of audio speakers in the plurality of audio speakers.

20 Claims, 9 Drawing Sheets

(52) U.S. Cl.
CPC .. *H04R 2227/003* (2013.01); *H04R 2227/005* (2013.01); *H04R 2420/07* (2013.01); *H04R 2430/00* (2013.01); *H04R 2430/01* (2013.01)

(58) Field of Classification Search
USPC ..... 381/99, 100, 98
See application file for complete search history.

(56) References Cited

U.S. PATENT DOCUMENTS

| | | | |
|---|---|---|---|
| D260,764 | S | 9/1981 | Castagna et al. |
| 4,296,278 | A | 10/1981 | Cullison et al. |
| 4,306,114 | A | 12/1981 | Callahan |
| 4,382,158 | A | 5/1983 | Ohshita et al. |
| 4,509,211 | A | 4/1985 | Robbins |
| D279,779 | S | 7/1985 | Taylor |
| 4,530,091 | A | 7/1985 | Crockett |
| 4,696,037 | A | 9/1987 | Fierens |
| 4,701,629 | A | 10/1987 | Citroen |
| 4,712,105 | A | 12/1987 | Kohler |
| D293,671 | S | 1/1988 | Beaumont |
| 4,731,814 | A | 3/1988 | Becker et al. |
| 4,816,989 | A | 3/1989 | Finn et al. |
| 4,824,059 | A | 4/1989 | Butler |
| D301,037 | S | 5/1989 | Matsuda |
| 4,845,751 | A | 7/1989 | Schwab |
| D304,443 | S | 11/1989 | Grinyer et al. |
| D313,023 | S | 12/1990 | Kolenda et al. |
| D313,398 | S | 1/1991 | Gilchrist |
| D313,600 | S | 1/1991 | Weber |
| 4,994,908 | A | 2/1991 | Kuban et al. |
| 4,995,778 | A | 2/1991 | Bruessel |
| D320,598 | S | 10/1991 | Auerbach et al. |
| D322,609 | S | 12/1991 | Patton |
| 5,086,385 | A | 2/1992 | Launey et al. |
| D326,450 | S | 5/1992 | Watanabe |
| D327,060 | S | 6/1992 | Wachob et al. |
| 5,151,922 | A | 9/1992 | Weiss |
| 5,153,579 | A | 10/1992 | Fisch et al. |
| D331,388 | S | 12/1992 | Dahnert et al. |
| 5,182,552 | A | 1/1993 | Paynting |
| D333,135 | S | 2/1993 | Wachob et al. |
| 5,185,680 | A | 2/1993 | Kakubo |
| 5,237,327 | A | 8/1993 | Saitoh et al. |
| 5,239,458 | A | 8/1993 | Suzuki |
| 5,272,757 | A | 12/1993 | Scofield et al. |
| 5,299,266 | A | 3/1994 | Lumsden |
| D350,531 | S | 9/1994 | Tsuji |
| D350,962 | S | 9/1994 | Reardon et al. |
| 5,361,381 | A | 11/1994 | Short |
| 5,372,441 | A | 12/1994 | Louis |
| D354,059 | S | 1/1995 | Hendricks |
| D354,751 | S | 1/1995 | Hersh et al. |
| D356,093 | S | 3/1995 | McCauley et al. |
| D356,312 | S | 3/1995 | Althans |
| D357,024 | S | 4/1995 | Tokiyama et al. |
| 5,406,634 | A | 4/1995 | Anderson et al. |
| 5,430,485 | A | 7/1995 | Lankford et al. |
| 5,440,644 | A | 8/1995 | Farinelli et al. |
| D362,446 | S | 9/1995 | Gasiorek et al. |
| 5,457,448 | A | 10/1995 | Totsuka et al. |
| D363,933 | S | 11/1995 | Starck |
| 5,467,342 | A | 11/1995 | Logston et al. |
| D364,877 | S | 12/1995 | Tokiyama et al. |
| D364,878 | S | 12/1995 | Green et al. |
| D365,102 | S | 12/1995 | Gioscia |
| D366,044 | S | 1/1996 | Hara et al. |
| 5,481,251 | A | 1/1996 | Buys et al. |
| 5,491,839 | A | 2/1996 | Schotz |
| 5,515,345 | A | 5/1996 | Barreira et al. |
| 5,519,641 | A | 5/1996 | Beers et al. |
| 5,533,021 | A | 7/1996 | Branstad et al. |
| D372,716 | S | 8/1996 | Thorne |
| 5,553,147 | A | 9/1996 | Pineau |
| 5,553,222 | A | 9/1996 | Milne et al. |
| 5,553,314 | A | 9/1996 | Grube et al. |
| D377,651 | S | 1/1997 | Biasotti et al. |
| 5,596,696 | A | 1/1997 | Tindell et al. |
| 5,602,992 | A | 2/1997 | Danneels |
| 5,623,483 | A | 4/1997 | Agrawal et al. |
| 5,625,350 | A | 4/1997 | Fukatsu et al. |
| D379,816 | S | 6/1997 | Laituri et al. |
| 5,640,388 | A | 6/1997 | Woodhead et al. |
| D380,752 | S | 7/1997 | Hanson |
| 5,652,749 | A | 7/1997 | Davenport et al. |
| D382,271 | S | 8/1997 | Akwiwu |
| 5,661,665 | A | 8/1997 | Glass et al. |
| 5,668,884 | A | 9/1997 | Clair, Jr. et al. |
| 5,673,323 | A | 9/1997 | Schotz et al. |
| D384,940 | S | 10/1997 | Kono et al. |
| D387,352 | S | 12/1997 | Kaneko et al. |
| 5,696,896 | A | 12/1997 | Badovinatz et al. |
| D388,792 | S | 1/1998 | Nykerk |
| D389,143 | S | 1/1998 | Wicks |
| D392,641 | S | 3/1998 | Fenner |
| 5,726,989 | A | 3/1998 | Dokic |
| D393,628 | S | 4/1998 | Ledbetter et al. |
| 5,740,235 | A | 4/1998 | Lester et al. |
| 5,742,623 | A | 4/1998 | Nuber et al. |
| D394,659 | S | 5/1998 | Biasotti et al. |
| 5,751,819 | A | 5/1998 | Dorrough |
| 5,761,320 | A | 6/1998 | Farinelli et al. |
| 5,774,016 | A | 6/1998 | Ketterer |
| D395,889 | S | 7/1998 | Gerba et al. |
| 5,787,249 | A | 7/1998 | Badovinatz et al. |
| 5,790,543 | A | 8/1998 | Cloutier |
| D397,996 | S | 9/1998 | Smith |
| 5,808,662 | A | 9/1998 | Kinney et al. |
| 5,812,201 | A | 9/1998 | Yoo |
| 5,815,689 | A | 9/1998 | Shaw et al. |
| 5,818,948 | A | 10/1998 | Gulick |
| D401,587 | S | 11/1998 | Rudolph |
| 5,832,024 | A | 11/1998 | Schotz et al. |
| 5,848,152 | A | 12/1998 | Slipy et al. |
| 5,852,722 | A | 12/1998 | Hamilton |
| D404,741 | S | 1/1999 | Schumaker et al. |
| D405,071 | S | 2/1999 | Gambaro |
| 5,867,691 | A | 2/1999 | Shiraishi |
| 5,875,233 | A | 2/1999 | Cox |
| 5,875,354 | A | 2/1999 | Charlton et al. |
| D406,847 | S | 3/1999 | Gerba et al. |
| D407,071 | S | 3/1999 | Keating |
| 5,887,143 | A | 3/1999 | Saito et al. |
| 5,905,768 | A | 5/1999 | Maturi et al. |
| D410,927 | S | 6/1999 | Yamagishi |
| 5,910,991 | A | 6/1999 | Farrar |
| D412,337 | S | 7/1999 | Hamano |
| 5,923,869 | A | 7/1999 | Kashiwagi et al. |
| 5,923,902 | A | 7/1999 | Inagaki |
| 5,946,343 | A | 8/1999 | Schotz et al. |
| 5,956,025 | A | 9/1999 | Goulden et al. |
| 5,956,088 | A | 9/1999 | Shen et al. |
| 5,960,006 | A | 9/1999 | Maturi et al. |
| D415,496 | S | 10/1999 | Gerba et al. |
| D416,021 | S | 11/1999 | Godette et al. |
| 5,984,512 | A | 11/1999 | Jones et al. |
| 5,987,611 | A | 11/1999 | Freund |
| 5,990,884 | A | 11/1999 | Douma et al. |
| 5,991,307 | A | 11/1999 | Komuro et al. |
| 5,999,906 | A | 12/1999 | Mercs et al. |
| 6,009,457 | A | 12/1999 | Moller |
| 6,018,376 | A | 1/2000 | Nakatani |
| D420,006 | S | 2/2000 | Tonino |
| 6,026,150 | A | 2/2000 | Frank et al. |
| 6,029,196 | A | 2/2000 | Lenz |
| 6,031,818 | A | 2/2000 | Lo et al. |
| 6,032,202 | A | 2/2000 | Lea et al. |
| 6,038,614 | A | 3/2000 | Chan et al. |
| 6,046,550 | A | 4/2000 | Ference et al. |
| 6,061,457 | A | 5/2000 | Stockhamer |
| 6,078,725 | A | 6/2000 | Tanaka |
| 6,081,266 | A | 6/2000 | Sciammarella |
| 6,088,063 | A | 7/2000 | Shiba |
| D429,246 | S | 8/2000 | Holma |
| D430,143 | S | 8/2000 | Renk |

(56) References Cited

U.S. PATENT DOCUMENTS

| | | | |
|---|---|---|---|
| 6,101,195 | A | 8/2000 | Lyons et al. |
| 6,108,485 | A | 8/2000 | Kim |
| 6,108,686 | A | 8/2000 | Williams, Jr. |
| 6,122,668 | A | 9/2000 | Teng et al. |
| D431,552 | S | 10/2000 | Backs et al. |
| D432,525 | S | 10/2000 | Beecroft |
| 6,127,941 | A | 10/2000 | Van Ryzin |
| 6,128,318 | A | 10/2000 | Sato |
| 6,148,205 | A | 11/2000 | Cotton |
| 6,157,957 | A | 12/2000 | Berthaud |
| 6,163,647 | A | 12/2000 | Terashima et al. |
| 6,169,725 | B1 | 1/2001 | Gibbs et al. |
| 6,175,872 | B1 | 1/2001 | Neumann et al. |
| 6,181,383 | B1 | 1/2001 | Fox et al. |
| 6,185,737 | B1 | 2/2001 | Northcutt et al. |
| 6,195,435 | B1 | 2/2001 | Kitamura |
| 6,195,436 | B1 | 2/2001 | Scibora et al. |
| 6,199,169 | B1 | 3/2001 | Voth |
| 6,212,282 | B1 | 4/2001 | Mershon |
| 6,246,701 | B1 | 6/2001 | Slattery |
| 6,253,293 | B1 | 6/2001 | Rao et al. |
| D444,475 | S | 7/2001 | Levey et al. |
| 6,255,961 | B1 | 7/2001 | Van Ryzin et al. |
| 6,256,554 | B1 | 7/2001 | Dilorenzo |
| 6,269,406 | B1 | 7/2001 | Dutcher et al. |
| 6,301,012 | B1 | 10/2001 | White et al. |
| 6,308,207 | B1 | 10/2001 | Tseng et al. |
| 6,310,652 | B1 | 10/2001 | Li et al. |
| 6,313,879 | B1 | 11/2001 | Kubo et al. |
| 6,321,252 | B1 | 11/2001 | Bhola et al. |
| 6,324,586 | B1 | 11/2001 | Johnson |
| D452,520 | S | 12/2001 | Gotham et al. |
| 6,332,147 | B1 | 12/2001 | Moran et al. |
| 6,343,028 | B1 | 1/2002 | Kuwaoka |
| 6,349,285 | B1 | 2/2002 | Liu et al. |
| 6,349,339 | B1 | 2/2002 | Williams |
| 6,351,821 | B1 | 2/2002 | Voth |
| 6,353,172 | B1 | 3/2002 | Fay et al. |
| 6,356,871 | B1 | 3/2002 | Hemkumar et al. |
| 6,404,811 | B1 | 6/2002 | Cvetko et al. |
| 6,418,150 | B1 | 7/2002 | Staats |
| 6,430,353 | B1 | 8/2002 | Honda et al. |
| 6,442,443 | B1 | 8/2002 | Fujii et al. |
| D462,339 | S | 9/2002 | Allen et al. |
| D462,340 | S | 9/2002 | Allen et al. |
| D462,945 | S | 9/2002 | Skulley |
| 6,449,642 | B2 | 9/2002 | Bourke-Dunphy et al. |
| 6,449,653 | B2 | 9/2002 | Klemets et al. |
| 6,456,783 | B1 | 9/2002 | Ando et al. |
| 6,463,474 | B1 | 10/2002 | Fuh et al. |
| 6,466,832 | B1 | 10/2002 | Zuqert et al. |
| 6,469,633 | B1 | 10/2002 | Wachter |
| D466,108 | S | 11/2002 | Glodava et al. |
| 6,487,296 | B1 | 11/2002 | Allen et al. |
| 6,493,832 | B1 | 12/2002 | Itakura et al. |
| D468,297 | S | 1/2003 | Ikeda |
| 6,522,886 | B1 | 2/2003 | Youngs et al. |
| 6,526,325 | B1 | 2/2003 | Sussman et al. |
| 6,535,121 | B2 | 3/2003 | Matheny et al. |
| D474,763 | S | 5/2003 | Tozaki et al. |
| D475,993 | S | 6/2003 | Meyer |
| D476,643 | S | 7/2003 | Yamagishi |
| D477,310 | S | 7/2003 | Moransais |
| 6,587,127 | B1 | 7/2003 | Leeke et al. |
| 6,598,172 | B1 | 7/2003 | Vandeusen et al. |
| D478,051 | S | 8/2003 | Sagawa |
| D478,069 | S | 8/2003 | Beck et al. |
| D478,896 | S | 8/2003 | Summers |
| 6,604,023 | B1 | 8/2003 | Brown et al. |
| 6,611,537 | B1 | 8/2003 | Edens et al. |
| D479,520 | S | 9/2003 | De Saulees |
| D481,056 | S | 10/2003 | Kawasaki et al. |
| 6,631,410 | B1 | 10/2003 | Kowalski et al. |
| 6,636,269 | B1 | 10/2003 | Baldwin |
| 6,653,899 | B2 | 11/2003 | Organvidez et al. |
| 6,654,720 | B1 | 11/2003 | Graham et al. |
| 6,654,956 | B1 | 11/2003 | Trinh et al. |
| 6,658,091 | B1 | 12/2003 | Naidoo et al. |
| 6,674,803 | B1 | 1/2004 | Kesselring |
| 6,684,060 | B1 | 1/2004 | Curtin |
| D486,145 | S | 2/2004 | Kaminski et al. |
| 6,687,664 | B1 | 2/2004 | Sussman et al. |
| 6,704,421 | B1 | 3/2004 | Kitamura |
| 6,741,961 | B2 | 5/2004 | Lim |
| D491,925 | S | 6/2004 | Griesau et al. |
| 6,757,517 | B2 | 6/2004 | Chang |
| D493,148 | S | 7/2004 | Shibata et al. |
| 6,763,274 | B1 | 7/2004 | Gilbert |
| D495,333 | S | 8/2004 | Borsboom |
| 6,778,073 | B2 | 8/2004 | Lutter et al. |
| 6,778,493 | B1 | 8/2004 | Ishii |
| 6,778,869 | B2 | 8/2004 | Champion |
| D496,003 | S | 9/2004 | Spira |
| D496,005 | S | 9/2004 | Wang |
| D496,335 | S | 9/2004 | Spira |
| D497,363 | S | 10/2004 | Olson et al. |
| 6,803,964 | B1 | 10/2004 | Post et al. |
| 6,809,635 | B1 | 10/2004 | Kaaresoja |
| D499,086 | S | 11/2004 | Polito |
| 6,816,510 | B1 | 11/2004 | Banerjee |
| 6,816,818 | B2 | 11/2004 | Wolf et al. |
| 6,823,225 | B1 | 11/2004 | Sass |
| 6,826,283 | B1 | 11/2004 | Wheeler et al. |
| D499,395 | S | 12/2004 | Hsu |
| D499,718 | S | 12/2004 | Chen |
| D500,015 | S | 12/2004 | Gubbe |
| 6,836,788 | B2 | 12/2004 | Kim et al. |
| 6,839,752 | B1 | 1/2005 | Miller et al. |
| D501,477 | S | 2/2005 | Hall |
| 6,859,460 | B1 | 2/2005 | Chen |
| 6,859,538 | B1 | 2/2005 | Voltz |
| 6,873,862 | B2 | 3/2005 | Reshefsky |
| 6,882,335 | B2 | 4/2005 | Saarinen |
| D504,872 | S | 5/2005 | Uehara et al. |
| D504,885 | S | 5/2005 | Zhang et al. |
| 6,889,207 | B2 | 5/2005 | Slemmer et al. |
| 6,898,642 | B2 | 5/2005 | Chafle et al. |
| 6,901,439 | B1 | 5/2005 | Bonasia et al. |
| D506,463 | S | 6/2005 | Daniels |
| 6,907,458 | B2 | 6/2005 | Tomassetti et al. |
| 6,912,610 | B2 | 6/2005 | Spencer |
| 6,915,347 | B2 | 7/2005 | Hanko et al. |
| 6,916,980 | B2 | 7/2005 | Ishida et al. |
| 6,917,592 | B1 | 7/2005 | Ramankutty et al. |
| 6,919,771 | B2 | 7/2005 | Nakajima |
| 6,920,373 | B2 | 7/2005 | Xi et al. |
| 6,931,134 | B1 | 8/2005 | Waller, Jr. et al. |
| 6,931,557 | B2 | 8/2005 | Togawa |
| 6,934,766 | B1 | 8/2005 | Russell |
| 6,937,988 | B1 | 8/2005 | Hemkumar et al. |
| 6,970,482 | B2 | 11/2005 | Kim |
| 6,985,694 | B1 | 1/2006 | De Bonet et al. |
| 6,987,767 | B2 | 1/2006 | Saito |
| 6,987,947 | B2 | 1/2006 | Richenstein et al. |
| D515,072 | S | 2/2006 | Lee |
| D515,557 | S | 2/2006 | Okuley |
| 7,007,106 | B1 | 2/2006 | Flood et al. |
| 7,020,791 | B1 | 3/2006 | Aweya et al. |
| D518,475 | S | 4/2006 | Yang et al. |
| 7,043,477 | B2 | 5/2006 | Mercer et al. |
| 7,043,651 | B2 | 5/2006 | Aweya et al. |
| 7,046,677 | B2 | 5/2006 | Monta et al. |
| 7,047,308 | B2 | 5/2006 | Deshpande |
| 7,054,888 | B2 | 5/2006 | Lachapelle et al. |
| 7,058,889 | B2 | 6/2006 | Trovato et al. |
| 7,068,596 | B1 | 6/2006 | Mou |
| D524,296 | S | 7/2006 | Kita |
| 7,072,477 | B1 | 7/2006 | Kincaid |
| D527,375 | S | 8/2006 | Flora et al. |
| 7,092,528 | B2 | 8/2006 | Patrick et al. |
| 7,092,694 | B2 | 8/2006 | Griep et al. |
| 7,096,169 | B2 | 8/2006 | Crutchfield et al. |
| 7,113,999 | B2 | 9/2006 | Pestoni et al. |
| 7,115,017 | B1 | 10/2006 | Laursen et al. |

(56) References Cited

U.S. PATENT DOCUMENTS

| | | | |
|---|---|---|---|
| 7,120,168 | B2 | 10/2006 | Zimmermann |
| 7,130,316 | B2 | 10/2006 | Kovacevic |
| 7,130,368 | B1 | 10/2006 | Aweya et al. |
| 7,130,608 | B2 | 10/2006 | Hollstrom et al. |
| 7,130,616 | B2 | 10/2006 | Janik |
| 7,136,934 | B2 | 11/2006 | Carter et al. |
| 7,139,981 | B2 | 11/2006 | Mayer et al. |
| 7,143,141 | B1 | 11/2006 | Morgan et al. |
| 7,143,939 | B2 | 12/2006 | Henzerling |
| 7,146,260 | B2 | 12/2006 | Preston et al. |
| 7,158,488 | B2 | 1/2007 | Fujimori |
| 7,161,939 | B2 | 1/2007 | Israel et al. |
| 7,162,315 | B2 | 1/2007 | Gilbert |
| 7,171,010 | B2 | 1/2007 | Martin et al. |
| 7,185,090 | B2 | 2/2007 | Kowalski et al. |
| 7,187,947 | B1 | 3/2007 | White et al. |
| 7,197,148 | B2 | 3/2007 | Nourse et al. |
| 7,206,367 | B1 | 4/2007 | Moore |
| 7,206,618 | B2 | 4/2007 | Latto et al. |
| 7,206,967 | B1 | 4/2007 | Marti et al. |
| 7,209,795 | B2 | 4/2007 | Sullivan et al. |
| 7,218,708 | B2 | 5/2007 | Berezowski et al. |
| 7,236,739 | B2 | 6/2007 | Chang |
| 7,236,773 | B2 | 6/2007 | Thomas |
| 7,257,398 | B1 | 8/2007 | Ukita et al. |
| 7,260,616 | B1 | 8/2007 | Cook |
| 7,263,110 | B2 | 8/2007 | Fujishiro |
| 7,277,547 | B1 | 10/2007 | Delker et al. |
| 7,286,652 | B1 | 10/2007 | Azriel et al. |
| 7,289,631 | B2 | 10/2007 | Ishidoshiro |
| 7,293,060 | B2 | 11/2007 | Komsi |
| 7,295,548 | B2 | 11/2007 | Blank et al. |
| 7,302,468 | B2 | 11/2007 | Wijeratne |
| 7,305,694 | B2 | 12/2007 | Commons et al. |
| 7,308,188 | B2 | 12/2007 | Namatame |
| 7,310,334 | B1 | 12/2007 | Fitzgerald et al. |
| 7,312,785 | B2 | 12/2007 | Tsuk et al. |
| 7,313,593 | B1 | 12/2007 | Pulito et al. |
| 7,319,764 | B1 | 1/2008 | Reid et al. |
| 7,324,857 | B2 | 1/2008 | Goddard |
| 7,330,875 | B1 | 2/2008 | Parasnis et al. |
| 7,333,519 | B2 | 2/2008 | Sullivan et al. |
| 7,346,332 | B2 | 3/2008 | McCarty et al. |
| 7,356,011 | B1 | 4/2008 | Waters et al. |
| 7,359,006 | B1 | 4/2008 | Xiang et al. |
| 7,366,206 | B2 | 4/2008 | Lockridge et al. |
| 7,372,846 | B2 | 5/2008 | Zwack |
| 7,391,791 | B2 | 6/2008 | Balassanian et al. |
| 7,392,102 | B2 | 6/2008 | Sullivan et al. |
| 7,392,481 | B2 | 6/2008 | Gewickey et al. |
| 7,400,644 | B2 | 7/2008 | Sakamoto et al. |
| 7,412,499 | B2 | 8/2008 | Chang et al. |
| 7,424,267 | B2 | 9/2008 | Eisenbach |
| 7,428,310 | B2 | 9/2008 | Park |
| 7,430,181 | B1 | 9/2008 | Hong |
| 7,457,948 | B1 | 11/2008 | Bilicksa et al. |
| 7,472,058 | B2 | 12/2008 | Tseng et al. |
| 7,474,677 | B2 | 1/2009 | Trott |
| 7,483,538 | B2 | 1/2009 | McCarty et al. |
| 7,483,540 | B2 | 1/2009 | Rabinowitz et al. |
| 7,483,958 | B1 | 1/2009 | Elabbady et al. |
| 7,490,044 | B2 | 2/2009 | Kulkarni |
| 7,492,912 | B2 | 2/2009 | Chung et al. |
| 7,505,889 | B2 | 3/2009 | Salmonsen et al. |
| 7,509,181 | B2 | 3/2009 | Champion |
| 7,519,188 | B2 | 4/2009 | Berardi et al. |
| 7,519,667 | B1 | 4/2009 | Capps |
| 7,539,551 | B2 | 5/2009 | Komura et al. |
| 7,548,744 | B2 | 6/2009 | Oesterling et al. |
| 7,548,851 | B1 | 6/2009 | Lau et al. |
| 7,558,224 | B1 | 7/2009 | Surazski et al. |
| 7,558,635 | B1 | 7/2009 | Thiel et al. |
| 7,561,932 | B1 | 7/2009 | Holmes et al. |
| 7,571,014 | B1 | 8/2009 | Lambourne et al. |
| 7,574,274 | B2 | 8/2009 | Holmes |
| 7,599,685 | B2 | 10/2009 | Goldberg et al. |
| 7,606,174 | B2 | 10/2009 | Ochi et al. |
| 7,626,952 | B2 | 12/2009 | Slemmer et al. |
| 7,627,825 | B2 | 12/2009 | Kakuda |
| 7,630,500 | B1 | 12/2009 | Beckman et al. |
| 7,630,501 | B2 | 12/2009 | Blank et al. |
| 7,631,119 | B2 | 12/2009 | Moore et al. |
| 7,643,894 | B2 | 1/2010 | Braithwaite et al. |
| 7,653,344 | B1 | 1/2010 | Feldman et al. |
| 7,657,224 | B2 | 2/2010 | Goldberg et al. |
| 7,657,644 | B1 | 2/2010 | Zheng |
| 7,657,910 | B1 | 2/2010 | McAulay et al. |
| 7,665,115 | B2 | 2/2010 | Gallo et al. |
| 7,668,990 | B2 | 2/2010 | Krzyzanowski et al. |
| 7,669,113 | B1 | 2/2010 | Moore et al. |
| 7,669,219 | B2 | 2/2010 | Scott, III |
| 7,672,470 | B2 | 3/2010 | Lee |
| 7,675,943 | B2 | 3/2010 | Mosig et al. |
| 7,676,044 | B2 | 3/2010 | Sasaki et al. |
| 7,676,142 | B1 | 3/2010 | Hung |
| 7,688,306 | B2 | 3/2010 | Wehrenberg et al. |
| 7,689,304 | B2 | 3/2010 | Sasaki |
| 7,689,305 | B2 | 3/2010 | Kreifeldt et al. |
| 7,702,279 | B2 | 4/2010 | Ko et al. |
| 7,702,403 | B1 | 4/2010 | Gladwin et al. |
| 7,710,941 | B2 | 5/2010 | Rietschel |
| 7,711,774 | B1 | 5/2010 | Rothschild |
| 7,720,096 | B2 | 5/2010 | Klemets |
| 7,721,032 | B2 | 5/2010 | Bushell et al. |
| 7,742,740 | B2 | 6/2010 | Goldberg et al. |
| 7,742,832 | B1 | 6/2010 | Feldman et al. |
| 7,743,009 | B2 | 6/2010 | Hangartner et al. |
| 7,746,906 | B2 | 6/2010 | Jinzaki et al. |
| 7,761,176 | B2 | 7/2010 | Ben-Yaacov et al. |
| 7,765,315 | B2 | 7/2010 | Batson et al. |
| RE41,608 | E | 8/2010 | Blair et al. |
| 7,792,311 | B1 | 9/2010 | Holmgren et al. |
| 7,793,206 | B2 | 9/2010 | Lim et al. |
| 7,804,972 | B2 | 9/2010 | Melanson |
| 7,805,210 | B2 | 9/2010 | Cucos et al. |
| 7,817,960 | B2 | 10/2010 | Tan et al. |
| 7,827,259 | B2 | 11/2010 | Heller et al. |
| 7,831,054 | B2 | 11/2010 | Ball et al. |
| 7,835,689 | B2 | 11/2010 | Goldberg et al. |
| 7,849,181 | B2 | 12/2010 | Slemmer et al. |
| 7,853,341 | B2 | 12/2010 | McCarty et al. |
| 7,865,137 | B2 | 1/2011 | Goldberg et al. |
| 7,882,234 | B2 | 2/2011 | Watanabe et al. |
| 7,885,622 | B2 | 2/2011 | Krampf et al. |
| 7,907,819 | B2 | 3/2011 | Ando et al. |
| 7,916,877 | B2 | 3/2011 | Goldberg et al. |
| 7,917,082 | B2 | 3/2011 | Goldberg et al. |
| 7,933,418 | B2 | 4/2011 | Morishima |
| 7,934,239 | B1 | 4/2011 | Dagman |
| 7,945,636 | B2 | 5/2011 | Nelson et al. |
| 7,945,708 | B2 | 5/2011 | Ohkita |
| 7,958,441 | B2 | 6/2011 | Heller et al. |
| 7,962,482 | B2 | 6/2011 | Handman et al. |
| 7,966,388 | B1 | 6/2011 | Pugaczewski et al. |
| 7,987,294 | B2 | 7/2011 | Bryce et al. |
| 7,995,732 | B2 | 8/2011 | Koch et al. |
| 7,996,566 | B1 | 8/2011 | Sylvain et al. |
| 7,996,588 | B2 | 8/2011 | Subbiah et al. |
| 8,014,423 | B2 | 9/2011 | Thaler et al. |
| 8,015,306 | B2 | 9/2011 | Bowman |
| 8,020,023 | B2 | 9/2011 | Millington et al. |
| 8,023,663 | B2 | 9/2011 | Goldberg |
| 8,028,038 | B2 | 9/2011 | Weel |
| 8,028,323 | B2 | 9/2011 | Weel |
| 8,041,062 | B2 | 10/2011 | Cohen et al. |
| 8,045,721 | B2 | 10/2011 | Burgan et al. |
| 8,045,952 | B2 | 10/2011 | Qureshey et al. |
| 8,050,203 | B2 | 11/2011 | Jacobsen et al. |
| 8,050,652 | B2 | 11/2011 | Qureshey et al. |
| 8,054,987 | B2 | 11/2011 | Seydoux |
| 8,055,364 | B2 | 11/2011 | Champion |
| 8,063,698 | B2 | 11/2011 | Howard |
| 8,074,253 | B1 | 12/2011 | Nathan |
| 8,086,287 | B2 | 12/2011 | Mooney et al. |

(56) References Cited

U.S. PATENT DOCUMENTS 8,086,752 B2 12/2011 Millington et al.
8,090,317 B2 1/2012 Burge et al.
8,103,009 B2 1/2012 McCarty et al.
8,111,132 B2 2/2012 Allen et al.
8,112,032 B2 2/2012 Ko et al.
8,116,476 B2 2/2012 Inohara
8,126,172 B2 2/2012 Horbach et al.
8,131,389 B1 3/2012 Hardwick et al.
8,131,390 B2 3/2012 Braithwaite et al.
8,135,141 B2 3/2012 Shiba
8,139,774 B2 3/2012 Berardi et al.
8,144,883 B2 3/2012 Pdersen et al.
8,148,622 B2 4/2012 Rothkopf et al.
8,150,079 B2 4/2012 Maeda et al.
8,160,281 B2 4/2012 Kim et al.
8,169,938 B2 5/2012 Duchscher et al.
8,170,222 B2 5/2012 Dunko
8,170,260 B2 5/2012 Reining et al.
8,175,292 B2 5/2012 Aylward et al.
8,175,297 B1 5/2012 Ho et al.
8,185,674 B2 5/2012 Moore et al.
8,189,824 B2 5/2012 Strauss et al.
8,194,874 B2 6/2012 Starobin et al.
8,204,890 B1 6/2012 Gogan
8,208,653 B2 6/2012 Eo et al.
8,214,447 B2 7/2012 Deslippe et al.
8,214,740 B2 7/2012 Johnson
8,214,873 B2 7/2012 Weel
8,218,790 B2 7/2012 Bull et al.
8,229,125 B2 7/2012 Short
8,230,099 B2 7/2012 Weel
8,233,029 B2 7/2012 Yoshida et al.
8,233,632 B1 7/2012 MacDonald et al.
8,233,635 B2 7/2012 Shiba
8,233,648 B2 7/2012 Sorek et al.
8,234,395 B2 7/2012 Millington
8,238,578 B2 8/2012 Aylward
8,239,559 B2 8/2012 Rajapakse
8,239,748 B1 8/2012 Moore et al.
8,243,961 B1 8/2012 Morrill
8,265,310 B2 9/2012 Berardi et al.
8,279,709 B2 10/2012 Choisel et al.
8,281,001 B2 10/2012 Busam et al.
8,285,404 B1 10/2012 Kekki
8,290,185 B2 10/2012 Kim
8,290,603 B1 10/2012 Lambourne
8,300,845 B2 10/2012 Zurek et al.
8,306,235 B2 11/2012 Mahowald
8,311,226 B2 11/2012 Lorgeoux et al.
8,315,555 B2 11/2012 Ko et al.
8,316,147 B2 11/2012 Batson et al.
8,325,931 B2 12/2012 Howard et al.
8,325,935 B2 12/2012 Rutschman
8,331,585 B2 12/2012 Hagen et al.
8,340,330 B2 12/2012 Yoon et al.
8,345,709 B2 1/2013 Nitzpon et al.
8,364,295 B2 1/2013 Beckmann et al.
8,370,678 B2 2/2013 Millington et al.
8,374,595 B2 2/2013 Chien et al.
8,391,501 B2 3/2013 Khawand et al.
8,407,623 B2 3/2013 Kerr et al.
8,411,883 B2 4/2013 Matsumoto
8,423,659 B2 4/2013 Millington
8,423,893 B2 4/2013 Ramsay et al.
8,432,851 B2 4/2013 Xu et al.
8,433,076 B2 4/2013 Zurek et al.
8,442,239 B2 5/2013 Bruelle-Drews et al.
8,452,020 B2 5/2013 Gregg et al.
8,457,334 B2 6/2013 Yoon et al.
8,463,184 B2 6/2013 Dua
8,463,875 B2 6/2013 Katz et al.
8,473,844 B2 6/2013 Kreifeldt et al.
8,477,958 B2 7/2013 Moeller et al.
8,483,853 B1 7/2013 Lambourne
8,498,726 B2 7/2013 Kim et al.
8,509,211 B2 8/2013 Trotter et al.
8,520,870 B2 8/2013 Sato et al.
8,565,455 B2 10/2013 Worrell et al.
8,577,045 B2 11/2013 Gibbs
8,577,048 B2 11/2013 Chaikin et al.
8,588,432 B1 11/2013 Simon
8,588,949 B2 11/2013 Lambourne et al.
8,600,075 B2 12/2013 Lim
8,600,084 B1 12/2013 Garrett
8,611,559 B2 12/2013 Sanders
8,615,091 B2 12/2013 Terwal
8,620,006 B2 12/2013 Berardi et al.
8,639,830 B2 1/2014 Bowman
8,654,995 B2 2/2014 Silber et al.
8,672,744 B1 3/2014 Gronkowski et al.
8,683,009 B2 3/2014 Ng et al.
8,700,730 B2 4/2014 Rowe
8,731,206 B1 5/2014 Park
8,750,282 B2 6/2014 Gelter et al.
8,751,026 B2 6/2014 Sato et al.
8,762,565 B2 6/2014 Togashi et al.
8,775,546 B2 7/2014 Millington
8,788,080 B1 7/2014 Kallai et al.
8,818,538 B2 8/2014 Sakata
8,819,554 B2 8/2014 Basso et al.
8,843,224 B2 9/2014 Holmgren et al.
8,843,228 B2 9/2014 Lambourne
8,843,586 B2 9/2014 Pantos et al.
8,855,319 B2 10/2014 Liu et al.
8,861,739 B2 10/2014 Ojanpera
8,879,761 B2 11/2014 Johnson et al.
8,885,851 B2 11/2014 Westenbroek
8,886,347 B2 11/2014 Lambourne
8,904,066 B2 12/2014 Moore et al.
8,914,559 B2 12/2014 Kalayjian et al.
8,917,877 B2 12/2014 Haff et al.
8,923,997 B2 12/2014 Kallai et al.
8,930,006 B2 1/2015 Haatainen
8,934,647 B2 1/2015 Joyce et al.
8,934,655 B2 1/2015 Breen et al.
8,942,252 B2 1/2015 Balassanian et al.
8,942,395 B2 1/2015 Lissaman et al.
8,954,177 B2 2/2015 Sanders
8,965,544 B2 2/2015 Ramsay
8,965,546 B2 2/2015 Visser et al.
8,966,394 B2 2/2015 Gates et al.
8,977,974 B2 3/2015 Kraut
8,984,442 B2 3/2015 Pirnack et al.
9,020,153 B2 4/2015 Britt, Jr.
9,137,602 B2 9/2015 Mayman et al.
9,160,965 B2 10/2015 Redmann et al.
9,219,959 B2 12/2015 Kallai et al.
9,226,073 B2 12/2015 Ramos et al.
9,245,514 B2 1/2016 Donaldson
9,325,286 B1 4/2016 Yang
9,607,624 B2 3/2017 Baumgarte et al.
9,608,588 B2 3/2017 Baumgarte et al.
2001/0001160 A1 5/2001 Shoff et al.
2001/0009604 A1 7/2001 Ando et al.
2001/0022823 A1 9/2001 Renaud
2001/0027498 A1 10/2001 Van de Meulenhof et al.
2001/0032188 A1 10/2001 Miyabe et al.
2001/0042107 A1 11/2001 Palm
2001/0043456 A1 11/2001 Atkinson
2001/0046235 A1 11/2001 Trevitt et al.
2001/0047377 A1 11/2001 Sincaglia et al.
2001/0050991 A1 12/2001 Eves
2002/0002039 A1 1/2002 Qureshey et al.
2002/0002562 A1 1/2002 Moran et al.
2002/0002565 A1 1/2002 Ohyama
2002/0003548 A1 1/2002 Krusche et al.
2002/0015003 A1 2/2002 Kato et al.
2002/0022453 A1 2/2002 Balog et al.
2002/0026442 A1 2/2002 Lipscomb et al.
2002/0034374 A1 3/2002 Barton
2002/0042844 A1 4/2002 Chiazzese
2002/0049843 A1 4/2002 Barone et al.
2002/0062406 A1 5/2002 Chang et al.
2002/0065926 A1 5/2002 Hackney et al.

(56) References Cited

U.S. PATENT DOCUMENTS

2002/0067909 A1 6/2002 Iivonen
2002/0072816 A1 6/2002 Shdema et al.
2002/0072817 A1 6/2002 Champion
2002/0073228 A1 6/2002 Cognet et al.
2002/0078161 A1 6/2002 Cheng
2002/0078293 A1 6/2002 Kou et al.
2002/0080783 A1 6/2002 Fujimori
2002/0090914 A1 7/2002 Kang et al.
2002/0093478 A1 7/2002 Yeh
2002/0095460 A1 7/2002 Benson
2002/0098878 A1 7/2002 Mooney et al.
2002/0101357 A1 8/2002 Gharapetian
2002/0103635 A1 8/2002 Mesarovic et al.
2002/0109710 A1 8/2002 Holtz et al.
2002/0112244 A1 8/2002 Liou et al.
2002/0114354 A1 8/2002 Sinha et al.
2002/0114359 A1 8/2002 Ibaraki et al.
2002/0124097 A1 9/2002 Isely et al.
2002/0129156 A1 9/2002 Yoshikawa
2002/0131398 A1 9/2002 Taylor
2002/0131761 A1 9/2002 Kawasaki et al.
2002/0136335 A1 9/2002 Liou et al.
2002/0137505 A1 9/2002 Eiche et al.
2002/0143547 A1 10/2002 Fay et al.
2002/0143998 A1 10/2002 Rajagopal et al.
2002/0159596 A1 10/2002 Durand et al.
2002/0163361 A1 11/2002 Parkin
2002/0165721 A1 11/2002 Chang et al.
2002/0165921 A1 11/2002 Sapieyevski
2002/0168938 A1 11/2002 Chang
2002/0173273 A1 11/2002 Spurgat et al.
2002/0177411 A1 11/2002 Yajima et al.
2002/0181355 A1 12/2002 Shikunami et al.
2002/0184310 A1 12/2002 Traversat et al.
2002/0188762 A1 12/2002 Tomassetti et al.
2002/0194309 A1 12/2002 Carter et al.
2002/0196951 A1 12/2002 Tsai
2003/0002609 A1 1/2003 Faller et al.
2003/0002689 A1 1/2003 Folio
2003/0008616 A1 1/2003 Anderson
2003/0014486 A1 1/2003 May
2003/0018797 A1 1/2003 Dunning et al.
2003/0020763 A1 1/2003 Mayer et al.
2003/0023741 A1 1/2003 Tomassetti et al.
2003/0031333 A1 2/2003 Cohen et al.
2003/0035072 A1 2/2003 Hagg
2003/0035444 A1 2/2003 Zwack
2003/0041173 A1 2/2003 Hoyle
2003/0041174 A1 2/2003 Wen et al.
2003/0043856 A1 3/2003 Lakaniemi et al.
2003/0043924 A1 3/2003 Haddad et al.
2003/0055892 A1 3/2003 Huitema et al.
2003/0061428 A1 3/2003 Garney et al.
2003/0063755 A1 4/2003 Nourse et al.
2003/0066094 A1 4/2003 Van der Schaar et al.
2003/0067437 A1 4/2003 McClintock et al.
2003/0073432 A1 4/2003 Meade
2003/0091322 A1 5/2003 Van
2003/0097478 A1 5/2003 King
2003/0099212 A1 5/2003 Anjum et al.
2003/0099221 A1 5/2003 Rhee
2003/0101253 A1 5/2003 Saito et al.
2003/0103088 A1 6/2003 Dresti et al.
2003/0110329 A1 6/2003 Higaki et al.
2003/0126211 A1 7/2003 Anttila et al.
2003/0135822 A1 7/2003 Evans
2003/0157951 A1 8/2003 Hasty
2003/0161479 A1 8/2003 Yang et al.
2003/0167335 A1 9/2003 Alexander
2003/0172123 A1 9/2003 Polan et al.
2003/0177889 A1 9/2003 Koseki et al.
2003/0179780 A1 9/2003 Walker et al.
2003/0185400 A1 10/2003 Yoshizawa et al.
2003/0195964 A1 10/2003 Mane
2003/0198254 A1 10/2003 Sullivan et al.
2003/0198255 A1 10/2003 Sullivan et al.
2003/0198257 A1 10/2003 Sullivan et al.
2003/0200001 A1 10/2003 Goddard
2003/0204273 A1 10/2003 Dinker et al.
2003/0204509 A1 10/2003 Dinker et al.
2003/0210796 A1 11/2003 McCarty et al.
2003/0212802 A1 11/2003 Rector et al.
2003/0219007 A1 11/2003 Barrack et al.
2003/0227478 A1 12/2003 Chatfield
2003/0229900 A1 12/2003 Reisman
2003/0231208 A1 12/2003 Hanon et al.
2003/0231871 A1 12/2003 Ushimaru
2003/0235304 A1 12/2003 Evans et al.
2004/0001106 A1 1/2004 Deutscher et al.
2004/0001484 A1 1/2004 Ozguner
2004/0001591 A1 1/2004 Mani et al.
2004/0008852 A1 1/2004 Also et al.
2004/0010727 A1 1/2004 Fujinami
2004/0012620 A1 1/2004 Buhler et al.
2004/0014426 A1 1/2004 Moore
2004/0015252 A1 1/2004 Aiso et al.
2004/0019497 A1 1/2004 Volk et al.
2004/0019807 A1 1/2004 Freund et al.
2004/0019911 A1 1/2004 Gates et al.
2004/0023697 A1 2/2004 Komura
2004/0024478 A1 2/2004 Hans et al.
2004/0024925 A1 2/2004 Cypher et al.
2004/0027166 A1 2/2004 Mangum et al.
2004/0032348 A1 2/2004 Lai et al.
2004/0032421 A1 2/2004 Williamson et al.
2004/0037433 A1 2/2004 Chen
2004/0041836 A1 3/2004 Zaner et al.
2004/0042629 A1 3/2004 Mellone et al.
2004/0044742 A1 3/2004 Evron et al.
2004/0048569 A1 3/2004 Kawamura
2004/0059842 A1 3/2004 Hanson et al.
2004/0059965 A1 3/2004 Marshall et al.
2004/0066736 A1 4/2004 Kroeger
2004/0071299 A1* 4/2004 Yoshino ..... H03G 5/165 381/98
2004/0075767 A1 4/2004 Neuman et al.
2004/0078383 A1 4/2004 Mercer et al.
2004/0080671 A1 4/2004 Siemens et al.
2004/0093096 A1 5/2004 Huang et al.
2004/0098754 A1 5/2004 Vella et al.
2004/0111473 A1 6/2004 Lysenko et al.
2004/0117044 A1 6/2004 Konetski
2004/0117462 A1 6/2004 Bodin et al.
2004/0128701 A1 7/2004 Kaneko et al.
2004/0131192 A1 7/2004 Metcalf
2004/0133689 A1 7/2004 Vasisht
2004/0143368 A1 7/2004 May et al.
2004/0143852 A1 7/2004 Meyers
2004/0147224 A1 7/2004 Lee
2004/0148237 A1 7/2004 Bittmann et al.
2004/0168081 A1 8/2004 Ladas et al.
2004/0170383 A1 9/2004 Mazur
2004/0171346 A1 9/2004 Lin
2004/0177167 A1 9/2004 Iwamura et al.
2004/0179554 A1 9/2004 Tsao
2004/0183827 A1 9/2004 Putterman et al.
2004/0185773 A1 9/2004 Gerber et al.
2004/0203354 A1 10/2004 Yue
2004/0203378 A1 10/2004 Powers
2004/0203590 A1 10/2004 Shteyn
2004/0208158 A1 10/2004 Fellman et al.
2004/0213230 A1 10/2004 Douskalis et al.
2004/0220687 A1 11/2004 Klotz et al.
2004/0223622 A1 11/2004 Lindemann et al.
2004/0224638 A1 11/2004 Fadell et al.
2004/0225389 A1 11/2004 Ledoux et al.
2004/0228367 A1 11/2004 Mosig et al.
2004/0248601 A1 12/2004 Chang
2004/0249490 A1 12/2004 Sakai
2004/0249965 A1 12/2004 Huggins et al.
2004/0249982 A1 12/2004 Arnold et al.
2004/0252400 A1 12/2004 Blank et al.
2004/0253969 A1 12/2004 Nguyen et al.
2005/0002535 A1 1/2005 Liu et al.

(56) References Cited

U.S. PATENT DOCUMENTS

2005/0010691 A1 1/2005 Oyadomari et al.
2005/0011388 A1 1/2005 Kouznetsov
2005/0013394 A1 1/2005 Rausch et al.
2005/0015551 A1 1/2005 Eames et al.
2005/0021470 A1 1/2005 Martin et al.
2005/0021590 A1 1/2005 Debique et al.
2005/0027821 A1 2/2005 Alexander et al.
2005/0031135 A1 2/2005 Devantier et al.
2005/0047605 A1 3/2005 Lee et al.
2005/0058149 A1 3/2005 Howe
2005/0060435 A1 3/2005 Xue et al.
2005/0062637 A1 3/2005 El Zabadani et al.
2005/0069153 A1* 3/2005 Hall ..... H03G 5/025 381/103
2005/0081213 A1 4/2005 Suzuoki et al.
2005/0100174 A1 5/2005 Howard et al.
2005/0105052 A1 5/2005 McCormick et al.
2005/0114538 A1 5/2005 Rose
2005/0120128 A1 6/2005 Willes et al.
2005/0125222 A1 6/2005 Brown et al.
2005/0125357 A1 6/2005 Saadat et al.
2005/0131558 A1 6/2005 Braithwaite et al.
2005/0144284 A1 6/2005 Ludwig et al.
2005/0147261 A1 7/2005 Yeh
2005/0154766 A1 7/2005 Huang et al.
2005/0159833 A1 7/2005 Giaimo et al.
2005/0160270 A1 7/2005 Goldberg et al.
2005/0166135 A1 7/2005 Burke et al.
2005/0168630 A1 8/2005 Yamada et al.
2005/0177256 A1 8/2005 Shintani et al.
2005/0177643 A1 8/2005 Xu
2005/0181348 A1 8/2005 Carey et al.
2005/0195205 A1 9/2005 Abrams, Jr.
2005/0195823 A1 9/2005 Chen et al.
2005/0197725 A1 9/2005 Alexander et al.
2005/0198574 A1 9/2005 Lamkin et al.
2005/0201549 A1 9/2005 Dedieu et al.
2005/0216556 A1 9/2005 Manion et al.
2005/0254505 A1 11/2005 Chang et al.
2005/0262217 A1 11/2005 Nonaka et al.
2005/0266798 A1 12/2005 Moloney et al.
2005/0266826 A1 12/2005 Vlad
2005/0281255 A1 12/2005 Davies et al.
2005/0283820 A1 12/2005 Richards et al.
2005/0288805 A1 12/2005 Moore et al.
2005/0289224 A1 12/2005 Deslippe et al.
2005/0289244 A1 12/2005 Sahu et al.
2006/0016324 A1 1/2006 Hsieh et al.
2006/0032357 A1 2/2006 Roovers et al.
2006/0041616 A1 2/2006 Ludwig et al.
2006/0041639 A1 2/2006 Lamkin et al.
2006/0072489 A1 4/2006 Toyoshima
2006/0095516 A1 5/2006 Wijeratne
2006/0098936 A1 5/2006 Ikeda et al.
2006/0119497 A1 6/2006 Miller et al.
2006/0143236 A1 6/2006 Wu
2006/0149402 A1 7/2006 Chung
2006/0155721 A1 7/2006 Grunwald et al.
2006/0158558 A1* 7/2006 Chung ..... G09G 5/005 348/576
2006/0173844 A1 8/2006 Zhang et al.
2006/0179160 A1 8/2006 Uehara et al.
2006/0193454 A1 8/2006 Abou-Chakra et al.
2006/0193482 A1 8/2006 Harvey et al.
2006/0199538 A1 9/2006 Eisenbach
2006/0205349 A1 9/2006 Passier et al.
2006/0222186 A1 10/2006 Paige et al.
2006/0227985 A1 10/2006 Kawanami
2006/0229752 A1 10/2006 Chung
2006/0259649 A1 11/2006 Hsieh et al.
2006/0270395 A1 11/2006 Dhawan et al.
2006/0294569 A1 12/2006 Chung
2007/0003067 A1 1/2007 Gierl et al.
2007/0003075 A1* 1/2007 Cooper ..... H04S 3/00 381/98
2007/0022207 A1 1/2007 Millington et al.
2007/0038999 A1 2/2007 Millington et al.
2007/0043847 A1 2/2007 Carter et al.
2007/0047712 A1 3/2007 Gross et al.
2007/0048713 A1 3/2007 Plastina et al.
2007/0054680 A1 3/2007 Mo et al.
2007/0071255 A1 3/2007 Schobben
2007/0087686 A1 4/2007 Holm et al.
2007/0142022 A1 6/2007 Madonna et al.
2007/0142944 A1 6/2007 Goldberg et al.
2007/0143493 A1 6/2007 Mullig et al.
2007/0169115 A1 7/2007 Ko et al.
2007/0180137 A1 8/2007 Rajapakse
2007/0189544 A1 8/2007 Rosenberg
2007/0192156 A1 8/2007 Gauger
2007/0206829 A1 9/2007 Weinans et al.
2007/0223725 A1 9/2007 Neumann et al.
2007/0249295 A1 10/2007 Ukita et al.
2007/0265031 A1 11/2007 Koizumi et al.
2007/0271388 A1 11/2007 Bowra et al.
2007/0288610 A1 12/2007 Saint et al.
2007/0299778 A1 12/2007 Haveson et al.
2008/0002836 A1 1/2008 Moeller et al.
2008/0007649 A1 1/2008 Bennett
2008/0007650 A1 1/2008 Bennett
2008/0007651 A1 1/2008 Bennett
2008/0018785 A1 1/2008 Bennett
2008/0022320 A1 1/2008 Ver Steeg
2008/0025535 A1 1/2008 Rajapakse
2008/0045140 A1 2/2008 Korhonen
2008/0065232 A1 3/2008 Igoe
2008/0066094 A1 3/2008 Igoe
2008/0066120 A1 3/2008 Igoe
2008/0072816 A1 3/2008 Riess et al.
2008/0075295 A1 3/2008 Mayman et al.
2008/0077261 A1 3/2008 Baudino et al.
2008/0077619 A1 3/2008 Gilley et al.
2008/0077620 A1 3/2008 Gilley et al.
2008/0086318 A1 4/2008 Gilley et al.
2008/0091771 A1 4/2008 Allen et al.
2008/0092204 A1 4/2008 Bryce et al.
2008/0120429 A1 5/2008 Millington et al.
2008/0126943 A1 5/2008 Parasnis et al.
2008/0144861 A1 6/2008 Melanson et al.
2008/0144864 A1 6/2008 Huon
2008/0146289 A1 6/2008 Korneluk et al.
2008/0152165 A1 6/2008 Zacchi
2008/0159545 A1 7/2008 Takumai et al.
2008/0162668 A1 7/2008 Miller
2008/0189272 A1 8/2008 Powers et al.
2008/0205070 A1 8/2008 Osada
2008/0212786 A1 9/2008 Park
2008/0215169 A1 9/2008 Debettencourt et al.
2008/0242222 A1 10/2008 Bryce et al.
2008/0247554 A1 10/2008 Caffrey
2008/0263010 A1 10/2008 Roychoudhuri et al.
2008/0303947 A1 12/2008 Ohnishi et al.
2009/0011798 A1 1/2009 Yamada
2009/0017868 A1 1/2009 Ueda et al.
2009/0031336 A1 1/2009 Chavez et al.
2009/0060219 A1 3/2009 Inohara
2009/0070434 A1 3/2009 Himmelstein
2009/0089327 A1 4/2009 Kalaboukis et al.
2009/0097672 A1 4/2009 Buil et al.
2009/0100189 A1 4/2009 Bahren et al.
2009/0124289 A1 5/2009 Nishida
2009/0157905 A1 6/2009 Davis
2009/0164655 A1 6/2009 Pettersson et al.
2009/0169030 A1 7/2009 Inohara
2009/0180632 A1 7/2009 Goldberg et al.
2009/0193345 A1 7/2009 Wensley et al.
2009/0222115 A1 9/2009 Malcolm et al.
2009/0228919 A1 9/2009 Zott et al.
2009/0232326 A1 9/2009 Gordon et al.
2009/0251604 A1 10/2009 Iyer
2010/0004983 A1 1/2010 Dickerson et al.
2010/0010651 A1 1/2010 Kirkeby et al.
2010/0031366 A1 2/2010 Knight et al.
2010/0049835 A1 2/2010 Ko et al.

(56) References Cited

U.S. PATENT DOCUMENTS

2010/0052843 A1 3/2010 Cannistraro
2010/0067716 A1 3/2010 Katayama
2010/0087089 A1 4/2010 Struthers et al.
2010/0142735 A1 6/2010 Yoon et al.
2010/0153097 A1 6/2010 Hotho et al.
2010/0228740 A1 9/2010 Cannistraro et al.
2010/0272270 A1 10/2010 Chaikin et al.
2010/0284389 A1 11/2010 Ramsay et al.
2010/0290643 A1 11/2010 Mihelich et al.
2010/0299639 A1 11/2010 Ramsay et al.
2011/0001632 A1 1/2011 Hohorst
2011/0002487 A1 1/2011 Panther et al.
2011/0044476 A1 2/2011 Burlingame et al.
2011/0066943 A1 3/2011 Brillon et al.
2011/0110533 A1 5/2011 Choi et al.
2011/0170710 A1 7/2011 Son
2011/0228944 A1 9/2011 Croghan et al.
2011/0299696 A1 12/2011 Holmgren et al.
2011/0316768 A1 12/2011 Mcrae
2012/0029671 A1 2/2012 Millington et al.
2012/0030366 A1 2/2012 Collart et al.
2012/0047435 A1 2/2012 Holladay et al.
2012/0051558 A1 3/2012 Kim et al.
2012/0051567 A1 3/2012 Castor-Perry
2012/0060046 A1 3/2012 Millington
2012/0127831 A1 5/2012 Gicklhorn et al.
2012/0129446 A1 5/2012 Ko et al.
2012/0148075 A1* 6/2012 Goh ..... H04S 7/301
381/303
2012/0185771 A1 7/2012 Rothkopf et al.
2012/0192071 A1 7/2012 Millington
2012/0207290 A1 8/2012 Moyers et al.
2012/0237054 A1 9/2012 Eo et al.
2012/0263325 A1 10/2012 Freeman et al.
2012/0281058 A1 11/2012 Laney et al.
2012/0290621 A1 11/2012 Heitz, III et al.
2013/0010970 A1 1/2013 Hegarty et al.
2013/0018960 A1 1/2013 Knysz et al.
2013/0022221 A1 1/2013 Kallai et al.
2013/0028443 A1 1/2013 Pance et al.
2013/0031475 A1 1/2013 Maor et al.
2013/0038726 A1 2/2013 Kim
2013/0041954 A1 2/2013 Kim et al.
2013/0047084 A1 2/2013 Sanders et al.
2013/0051572 A1 2/2013 Goh et al.
2013/0052940 A1 2/2013 Brillhart et al.
2013/0070093 A1 3/2013 Rivera et al.
2013/0080599 A1 3/2013 Ko et al.
2013/0094670 A1 4/2013 Millington
2013/0124664 A1 5/2013 Fonseca, Jr. et al.
2013/0129122 A1 5/2013 Johnson et al.
2013/0132837 A1 5/2013 Mead et al.
2013/0159126 A1 6/2013 Elkady
2013/0167029 A1 6/2013 Friesen et al.
2013/0174100 A1 7/2013 Seymour et al.
2013/0174223 A1 7/2013 Dykeman et al.
2013/0179163 A1 7/2013 Herbig et al.
2013/0191454 A1 7/2013 Oliver et al.
2013/0197682 A1 8/2013 Millington
2013/0208911 A1 8/2013 Millington
2013/0208921 A1 8/2013 Millington
2013/0226323 A1 8/2013 Millington
2013/0230175 A1 9/2013 Bech et al.
2013/0232416 A1 9/2013 Millington
2013/0243199 A1 9/2013 Kallai et al.
2013/0253679 A1 9/2013 Lambourne
2013/0253934 A1 9/2013 Parekh et al.
2013/0259254 A1 10/2013 Xiang et al.
2013/0279706 A1 10/2013 Marti
2013/0287186 A1 10/2013 Quady
2013/0290504 A1 10/2013 Quady
2013/0293345 A1 11/2013 Lambourne
2013/0305152 A1* 11/2013 Griffiths ..... G06F 3/04883
715/716
2013/0329896 A1 12/2013 Krishnaswamy
2014/0006483 A1 1/2014 Garmark et al.
2014/0016784 A1 1/2014 Sen et al.
2014/0016786 A1 1/2014 Sen
2014/0016802 A1 1/2014 Sen
2014/0023196 A1 1/2014 Xiang et al.
2014/0037097 A1 2/2014 Labosco
2014/0064501 A1 3/2014 Olsen et al.
2014/0075308 A1 3/2014 Sanders et al.
2014/0075311 A1 3/2014 Boettcher et al.
2014/0079242 A1 3/2014 Nguyen et al.
2014/0108929 A1 4/2014 Garmark et al.
2014/0112481 A1 4/2014 Li et al.
2014/0123005 A1 5/2014 Forstall et al.
2014/0140530 A1 5/2014 Gomes-Casseres et al.
2014/0161265 A1 6/2014 Chaikin et al.
2014/0181569 A1 6/2014 Millington et al.
2014/0219456 A1 8/2014 Morrell et al.
2014/0226823 A1 8/2014 Sen et al.
2014/0242913 A1 8/2014 Pang
2014/0256260 A1 9/2014 Ueda et al.
2014/0267148 A1 9/2014 Luna et al.
2014/0270202 A1 9/2014 Ivanov et al.
2014/0273859 A1 9/2014 Luna et al.
2014/0279889 A1 9/2014 Luna
2014/0285313 A1 9/2014 Luna et al.
2014/0286496 A1 9/2014 Luna et al.
2014/0294200 A1 10/2014 Baumgarte et al.
2014/0298174 A1 10/2014 Ikonomov
2014/0323036 A1 10/2014 Daley et al.
2014/0344689 A1 11/2014 Scott et al.
2014/0355768 A1 12/2014 Sen et al.
2014/0355794 A1 12/2014 Morrell et al.
2014/0378056 A1 12/2014 Liu
2015/0019670 A1 1/2015 Redmann
2015/0026613 A1 1/2015 Kwon et al.
2015/0032844 A1 1/2015 Tarr et al.
2015/0043736 A1 2/2015 Olsen et al.
2015/0049248 A1 2/2015 Wang et al.
2015/0063610 A1 3/2015 Mossner
2015/0074527 A1 3/2015 Sevigny et al.
2015/0074528 A1 3/2015 Sakalowsky et al.
2015/0098576 A1 4/2015 Sundaresan et al.
2015/0139210 A1 5/2015 Marin et al.
2015/0146886 A1 5/2015 Baumgarte
2015/0201274 A1 7/2015 Ellner et al.
2015/0256954 A1 9/2015 Carlsson et al.
2015/0281866 A1 10/2015 Williams et al.
2015/0304288 A1 10/2015 Balasaygun et al.
2015/0365987 A1 12/2015 Weel

FOREIGN PATENT DOCUMENTS

CN 101292500 A 10/2008
EP 0251584 A2 1/1988
EP 0672985 A1 9/1995
EP 0772374 A2 5/1997
EP 1111527 A2 6/2001
EP 1122931 A2 8/2001
EP 1133896 B1 8/2002
EP 1312188 5/2003
EP 1312188 A1 5/2003
EP 1389853 A1 2/2004
EP 1410686 A2 4/2004
EP 2713281 4/2004
EP 1517464 A2 3/2005
EP 0895427 A3 1/2006
EP 1416687 B1 8/2006
EP 1410686 3/2008
EP 2043381 A2 4/2009
EP 2161950 A2 3/2010
EP 1825713 B1 10/2012
EP 0742674 B1 4/2014
EP 2591617 B1 6/2014
EP 2860992 A1 4/2015
GB 2284327 A 5/1995
GB 2338374 12/1999
GB 2379533 A 3/2003
GB 2486183 6/2012
JP 63269633 11/1988

(56) References Cited

FOREIGN PATENT DOCUMENTS

| | | | |
|---|---|---|---|
| JP | 07-210129 | | 8/1995 |
| JP | 2000149391 | A | 5/2000 |
| JP | 2001034951 | | 2/2001 |
| JP | 2002111817 | | 4/2002 |
| JP | 2002123267 | A | 4/2002 |
| JP | 2002358241 | A | 12/2002 |
| JP | 2003037585 | | 2/2003 |
| JP | 2003506765 | A | 2/2003 |
| JP | 2003101958 | | 4/2003 |
| JP | 2003169089 | A | 6/2003 |
| JP | 2005108427 | | 4/2005 |
| JP | 2005136457 | | 5/2005 |
| JP | 2007241652 | A | 9/2007 |
| JP | 2009506603 | A | 2/2009 |
| JP | 2009135750 | | 6/2009 |
| JP | 2009218888 | | 9/2009 |
| JP | 2009535708 | | 10/2009 |
| JP | 2009538006 | A | 10/2009 |
| JP | 2011010183 | A | 1/2011 |
| JP | 2011130496 | | 6/2011 |
| JP | 2011176581 | | 9/2011 |
| TW | 439027 | | 6/2001 |
| WO | 199525313 | | 9/1995 |
| WO | 1999023560 | | 5/1999 |
| WO | 199961985 | | 12/1999 |
| WO | 0019693 | A1 | 4/2000 |
| WO | 2000019693 | | 4/2000 |
| WO | 0110125 | A1 | 2/2001 |
| WO | 0153994 | | 7/2001 |
| WO | 02073851 | | 9/2002 |
| WO | 03093950 | A2 | 11/2003 |
| WO | 2005013047 | A2 | 2/2005 |
| WO | 2007023120 | A1 | 3/2007 |
| WO | 2007127485 | | 11/2007 |
| WO | 2007131555 | | 11/2007 |
| WO | 2007135581 | A2 | 11/2007 |
| WO | 2008082350 | A1 | 7/2008 |
| WO | 2008114389 | A1 | 9/2008 |
| WO | 2012050927 | | 4/2012 |
| WO | 2012137190 | A1 | 10/2012 |
| WO | 2013012582 | A1 | 1/2013 |
| WO | 2014004182 | | 1/2014 |
| WO | 2014149533 | A2 | 9/2014 |
| WO | 2015024881 | A1 | 2/2015 |

OTHER PUBLICATIONS

Non-Final Office Action dated Feb. 10, 2016, issued in connection with U.S. Appl. No. 14/937,571, filed Nov. 10, 2015, 9 pages.
Notice of Allowance dated Mar. 10, 2016, issued in connection with U.S. Appl. No. 14/937,523, filed Nov. 10, 2015, 5 pages.
Notice of Allowance dated Mar. 15, 2016, issued in connection with U.S. Appl. No. 14/937,571, filed Nov. 10, 2015, 5 pages.
"Advisory Action dated Oct. 5, 2015, issued in connection with U.S. Appl. No. 13/458,558, filed Apr. 27, 2012, 4 pages".
"Corrected Notice of Allowance dated Mar. 12, 2015, issued in connection with U.S. Appl. No. 13/630,565, filed Sep. 28, 2012, 4 pages".
"Final Office Action dated Jul. 2, 2015, issued in connection with U.S. Appl. No. 13/458,558, filed Apr. 27, 2012, 11 pages".
Mills D.L., "Network Time Protocol (Version 3) Specification, Implementation and Analysis," Network Working Group, Mar. 1992.
"Non-Final Office Action dated Dec. 22, 2014, issued in connection with U.S. Appl. No. 13/458,558, filed Apr. 27, 2012, 11 pages".
"Non-Final Office Action dated Jul. 15, 2015, issued in connection with U.S. Appl. No. 14/174,253, filed Feb. 6, 2014, 9 pages".
"Non-Final Office Action dated Jul. 7, 2015, issued in connection with U.S. Appl. No. 14/174,244, filed Feb. 6, 2014, 9 pages".
"Polycom Conference Composer manual: copyright 2001".
"U.S. Appl. No. 13/083,499, filed Apr. 8, 2011, "Multi-Channel Pairing in a Media System.""".
"Yamaha DME 32 manual: copyright 2001".
"AudioTron Quick Start Guide, Version 1.0", Voyetra Turtle Beach, Inc., Mar. 2001, 24 pages.
"AudioTron Reference Manual, Version 3.0", Voyetra Turtle Beach, Inc., May 2002, 70 pages.
"AudioTron Setup Guide, Version 3.0", Voyetra Turtle Beach, Inc., May 2002, 38 pages.
"Bluetooth. "Specification of the Bluetooth System: The ad hoc SCATTERNET for affordable and highly functional wireless connectivity" Core, Version 1.0 A, Jul. 26, 1999, 1068 pages".
"Bluetooth. "Specification of the Bluetooth System: Wireless connections made easy" Core, Version 1.0 B, Dec. 1, 1999, 1076 pages".
"Dell, Inc. "Dell Digital Audio Receiver: Reference Guide" Jun. 2000, 70 pages".
"Dell, Inc. "Start Here" Jun. 2000, 2 pages".
Jo J., et al., "Synchronized One-to-many Media Streaming with Adaptive Playout Control," Proceedings of SPIE, 2002, vol. 4861, pp. 71-82.
"Jones, Stephen. "Dell Digital Audio Receiver: Digital upgrade for your analog stereo" Analog Stereo. Jun. 24, 2000 <http://www.reviewsonline.com/articles/961906864.htm> retrieved Jun. 18, 2014, 2 pages".
"Louderback, Jim. "Affordable Audio Receiver Furnishes Homes With MP3" TechTV Vault. Jun. 28, 2000 <http://www.g4tv.com/articles/17923/affordable-audio-receiver-furnishes-homes-with-mp3/> retrieved Jul. 10, 2014, 2 pages".
"Non-Final Office Action dated Sep. 23, 2014, issued in connection with U.S. Appl. No. 13/630,565, filed Sep. 28, 2012, 7 pages".
"Notice of Allowance dated Jan. 22, 2015, issued in connection with U.S. Appl. No. 13/630,565, filed Sep. 28, 2012, 7 pages".
"Palm, Inc. "Handbook for the Palm VII Handheld" May 2000, 311 pages".
"Presentations at WinHEC 2000" May 2000, 138 pages.
"UPnP; "Universal Plug and Play Device Architecture"; Jun. 8, 2000; version 1.0; Microsoft Corporation; pp. 1-54".
Non-Final Office Action dated Dec. 17, 2015, issued in connection with U.S. Appl. No. 13/458,558, filed Apr. 27, 2012, 10 pages.
Non-Final Office Action dated May 24, 2016, issued in connection with U.S. Appl. No. 15/134,767, filed Apr. 21, 2016, 12 pages.
*Sonos, Inc.* v. *D&M Holdings Inc. et al.*, Opening Brief in Support of Defendants' Partial Motion for Judgment on the Pleadings for Lack of Patent-Eligible Subject Matter, filed May 6, 2016, 27 pages.
*Sonos, Inc.* v. *D&M Holdings Inc. et al.*, Plaintiff Sonos, Inc.'s Opening Claim Construction Brief, tiled Sep. 9, 2016, 26 pp.
*Sonos, Inc.* v. *D&M Holdings Inc. et al.*, Plaintiff Sonos, Inc.'s Response in Opposition to Defendants' Partial Motion for Judgment on the Pleadings, filed May 27, 2016, 24 pages.
*Sonos, Inc.* v. *D&M Holdings Inc. et al.*, Second Amended Complaint for Patent Infringement, filed Feb. 27, 2015, 49 pages.
*Sonos, Inc.* v. *D&M Holdings Inc. et al.*, Third Amended Complaint for Patent Infringement, filed Jan. 29, 2016, 47 pages.
Sony: AIR-SA 50R Wireless Speaker, Copyright 2009, 2 pages.
Sony: Altus Quick Setup Guide ALT-SA32PC, Copyright 2009, 2 pages.
Sony: BD/DVD Home Theatre System Operating Instructions for BDV-E300, E301 and E801, Copyright 2009, 115 pages.
Sony: BD/DVD Home Theatre System Operating Instructions for BDV-IT1000/BDV-IS1000, Copyright 2008, 159 pages.
Sony: Blu-ray Disc/DVD Home Theatre System Operating Instructions for BDV-IZ1000W, Copyright 2010, 88 pages.
Sony: DVD Home Theatre System Operating Instructions for DAV-DZ380W/DZ680W/DZ880W, Copyright 2009, 136 pages.
Sony: DVD Home Theatre System Operating Instructions for DAV-DZ870W, Copyright 2008, 128 pages.
Sony Ericsson MS500 User Guide, Copyright 2009, 2 pages.
Sony: Home Theatre System Operating Instructions for HT-IS100, Copyright 2008, 168 pages.
Sony: HT-IS100, 5.1 Channel Audio System, last updated Nov. 2009, 2 pages.
Sony: Multi Channel AV Receiver Operating Instructions, 2007, 80 pages.

(56) References Cited

OTHER PUBLICATIONS

Sony: Multi Channel AV Receiver Operating Instructions for STR-DN1000, Copyright 2009, 136 pages.
Sony: STR-DN1000, Audio Video Receiver, last updated Aug. 2009, 2 pages.
Sony: Wireless Surround Kit Operating Instructions for WHAT-SA2, Copyright 2010, 56 pages.
Taylor, Marilou, "Long Island Sound," Audio Video Interiors, Apr. 2000, 8 pages.
TOA Corporation, Digital Processor DP-0206 DACsys2000 Version 2.00 Software Instruction Manual, Copyright 2001,67 pages.
WaveLan High-Speed Multimode Chip Set, AVAG00003, Agere Systems, Feb. 2003, 4 pages.
WaveLan High-Speed Multimode Chip Set, AVAGO0005, Agere Systems, Feb. 2003, 4 pages.
WaveLAN Wireless Integration Developer Kit (WI-DK) for Access Point Developers, AVAGO0054, Agere Systems, Jul. 2003, 2 pages.
WaveLAN Wireless Integration-Developer Kit (WI-DK) Hardware Control Function (HCF), AVAGO0052, Agere Systems, Jul. 2003, 2 pages.
WI-DK Release 2 WaveLan Embedded Drivers for VxWorks and Linux, AVAGO0056, Agere Systems, Jul. 2003, 2 pages.
WI-DK Release 2 WaveLan END Reference Driver for VxWorks, AVAGO0044, Agere Systems, Jul. 2003, 2 pages.
WI-DK Release 2 WaveLan LKM Reference Drivers for Linux, AVAGO0048, Agere Systems, Jul. 2003, 4 pages.
WPA Reauthentication Rates, AVAGO0063, Agere Systems, Feb. 2004, 3 pages.
ZX135: Installation Manual, LA Audio, Apr. 2003, 44 pages.
LG: RJP-201M Remote Jack Pack Installation and Setup Guide, 2010, 24 pages.
Lienhart et al., "On the Importance of Exact Synchronization for Distributed Audio Signal Processing," Session L: Poster Session II—ICASSP'03 Papers, 2002, 1 page.
LinkSys by Cisco, Wireless Home Audio Controller, Wireless-N Touchscreen Remote DMRW1000 Datasheet, Copyright 2008, 2 pages.
LinkSys by Cisco, Wireless Home Audio Controller, Wireless-N Touchscreen Remote DMRW1000 User Guide, Copyright 2008, 64 pages.
LinkSys by Cisco, Wireless Home Audio Player, Wireless-N Music Extender DMP100 Quick Installation Guide, Copyright 2009, 32 pages.
LinkSys by Cisco, Wireless Home Audio Player, Wireless-N Music Extender DMP100 User Guide, Copyright 2008, 65 pages.
Liu et al., "A synchronization control scheme for real-time streaming multimedia applications," Packet Video. 2003, 10 pages, vol. 2003.
Liu et al., "Adaptive Delay Concealment for Internet Voice Applications with Packet-Based Time-Scale Modification." Information Technologies 2000, pp. 91-102.
Parasound Zpre2 Zone Preamplifier with PTZI Remote Control, 2005, 16 pages.
Pillai et al., "A Method to Improve the Robustness of MPEG Video Applications over Wireless Networks," Kent Ridge Digital Labs, 2000, 15 pages.
Proficient Audio Systems M6 Quick Start Guide, 2011, 5 pages.
Proficient Audio Systems: Proficient Editor Advanced Programming Guide, 2007, 40 pages.
Programming Interface for WL54040 Dual-Band Wireless Transceiver, AVAGO0066, Agere Systems, May 2004, 16 pages.
Radio Shack, "Auto-Sensing 4-Way Audio/Video Selector Switch," 2004, 1 page.
RadioShack, Pro-2053 Scanner, 2002 Catalog, part 1, 100 pages.
RadioShack, Pro-2053 Scanner, 2002 Catalog, part 2, 100 pages.
RadioShack, Pro-2053 Scanner, 2002 Catalog, part 3, 100 pages.
RadioShack, Pro-2053 Scanner, 2002 Catalog, part 4, 100 pages.
RadioShack, Pro-2053 Scanner, 2002 Catalog, part 5, 46 pages.
Rangan et al., "Feedback Techniques for Continuity and Synchronization in Multimedia Information Retrieval," ACM Transactions on Information Systems, 1995, pp. 145-176, vol. 13, No. 2.
Reid, Mark, "Multimedia conferencing over ISDN and IP networks using ITU-T H-series recommendations: architecture, control and coordination," Computer Networks, 1999, pp. 225-235, vol. 31.
Rothermel et al., "An Adaptive Protocol for Synchronizing Media Streams," Institute of Parallel and Distributed High-Performance Systems (IPVR), 1997, 26 pages.
Rothermel et al., "An Adaptive Stream Synchronization Protocol," 5th International Workshop on Network and Operating System Support for Digital Audio and Video, Apr. 18-21, 1995, 12 pages.
Rothermel et al., "Synchronization in Joint-Viewing Environments," University of Stuttgart Institute of Parallel and Distributed High-Performance Systems, 1992, 13 pages.
*Sonos, Inc.* v. *D&M Holdings Inc. et al.*, Complaint for Patent Infringement, filed Oct. 21, 2014, 20 pages.
*Sonos, Inc.* v. *D&M Holdings Inc. et al.*, Declaration of Steven C. Visser, executed Sep. 9, 2016, 40 pages.
*Sonos, Inc.* v. *D&M Holdings Inc. et al.*, Defendant's Amended Invalidity Contentions, filed Sep. 14, 2016, 100 pages.
*Sonos, Inc. .D&M Holdings Inc. et al.*, Defendant's Initial Invalidity Contentions Exhibit 1: Defendants' Invalidity Contentions for U.S. Pat. No. 7,571,014 filed Apr. 15, 2016, 161 pages.
*Sonos, Inc.* v. *D&M Holdings Inc. et al.*, Defendant's Initial Invalidity Contentions Exhibit 10: Defendants' Invalidity Contentions for U.S. Pat. No. 9,213,357 filed Apr. 15, 2016, 244 pages.
*Sonos, Inc.* v. *D&M Holdings Inc. et al.*, Defendant's Initial Invalidity Contentions Exhibit 11: Defendants' Invalidity Contentions for U.S. Pat. No. 9,219,959 filed Apr. 15, 2016, 172 pages.
*Sonos, Inc.* v. *D&M Holdings Inc. et al.*, Defendant's Initial Invalidity Contentions Exhibit 12: Defendants' Invalidity Contentions for Design U.S. Pat. No. D. 559,197 filed Apr. 15, 2016, 36 pages.
*Sonos, Inc.* v. *D&M Holdings Inc. et al.*, Defendant's Initial Invalidity Contentions Exhibit 2: Defendants' Invalidity Contentions for U.S. Pat. No. 8,588,949 filed Apr. 15, 2016, 112 pages.
*Sonos, Inc.* v. *D&M Holdings Inc. et al.*, Defendant's Initial Invalidity Contentions Exhibit 3: Defendants' Invalidity Contentions for U.S. Pat. No. 8,843,224 filed Apr. 15, 2016, 118 pages.
*Sonos, Inc.* v. *D&M Holdings Inc. et al.*, Defendant's Initial Invalidity Contentions Exhibit 4: Defendants' Invalidity Contentions for U.S. Pat. No. 8,938,312 filed Apr. 15, 2016, 217 pages.
*Sonos, Inc.* v. *D&M Holdings Inc. et al.*, Defendant's Initial Invalidity Contentions Exhibit 5: Defendants' Invalidity Contentions for U.S. Pat. No. 8,938,637 filed Apr. 15, 2016, 177 pages.
*Sonos, Inc.* v. *D&M Holdings Inc. et al.*, Defendant's Initial Invalidity Contentions Exhibit 6: Defendants' Invalidity Contentions for U.S. Pat. No. 9,042,556 filed Apr. 15, 2016, 86 pages.
*Sonos, Inc.* v. *D&M Holdings Inc. et al.*, Defendant's Initial Invalidity Contentions Exhibit 7: Defendants' Invalidity Contentions for U.S. Pat. No. 9,130,771 filed Apr. 15, 2016, 203 pages.
*Sonos, Inc.* v. *D&M Holdings Inc. et al.*, Defendant's Initial Invalidity Contentions Exhibit 8: Defendants' Invalidity Contentions for U.S. Pat. No. 9,195,258 filed Apr. 15, 2016, 400 pages.
*Sonos, Inc.* v. *D&M Holdings Inc. et al.*, Defendant's Initial Invalidity Contentions Exhibit 9: Defendants' Invalidity Contentions for U.S. Pat. No. 9,202,509 filed Apr. 15, 2016, 163 pages.
*Sonos, Inc.* v. *D&M Holdings Inc. et al.*, Defendant's Initial Invalidity Contentions, filed Apr. 15, 2016, 97 pages.
*Sonos, Inc.* v. *D&M Holdings Inc. et al.*, Defendant's Preliminary Identification of Indefinite Terms, provided Jul. 29, 2016, 8 pages.
*Sonos, Inc.* v. *D&M Holdings Inc. et al.*, Defendant's Preliminary Identification of Prior Art References, provided Jul. 29, 2016, 5 pages.
*Sonos, Inc.* v. *D&M Holdings Inc. et al.*, Defendants' Amended Answer, Defenses, and Counterclaims for Patent Infringement, filed Nov. 30, 2015, 47 pages.
*Sonos, Inc.* v. *D&M Holdings Inc. et al.*, Defendants' Answer to Plaintiff's Second Amended Complaint, filed Apr. 30, 2015, 19 pages.

(56) References Cited

OTHER PUBLICATIONS

*Sonos, Inc.* v. *D&M Holdings Inc. et al.*, Defendants' First Amended Answer to Plaintiffs' Third Amended Complaint, filed Sep. 7, 2016, 23 pages.
*Sonos, Inc.* v. *D&M Holdings Inc. et al.*, Defendants' Reply in Support of Partial Motion for Judgment on the Pleadings, filed Jun. 10, 2016, 15 pages.
*Sonos, Inc.* v. *D&M Holdings Inc. et al.*, Exhibit A: Defendants' Second Amended Answer to Plaintiffs' Third Amended Complaint, filed Sep. 9, 2016, 43 pages.
*Sonos, Inc.* v. *D&M Holdings Inc. et al.*, First Amended Complaint for Patent Infringement, filed Dec. 17, 2014, 26 pages.
*Sonos, Inc.* v. *D&M Holdings Inc. et al.*, Joint Claim Construction Chart, vol. 1 of 3 with Exhibits A-O, filed Aug. 17, 2016, 30 pages.
Advisory Action dated Dec. 22, 2011, issued in connection with U.S. Appl. No. 11/853,790, filed Sep. 11, 2007, 2 pages.
Breebaart et al., "Multi-Channel Goes Mobile: MPEG Surround Binaural Rendering," AES 29th International Conference, Sep. 2-4, 2006, pp. 1-13.
Canadian Patent Office, Office Action dated Apr. 10, 2015, issued in connection with Canadian Patent Application No. 2,832,542, 3 pages.
Chinese Patent Office, Office Action dated Nov. 27, 2015, issued in connection with Chinese Patent Application No. 201280028038.9, 26 pages.
Corrected Notice of Allowance dated Oct. 30, 2015, issued in connection with U.S. Appl. No. 13/013,740, filed Jan. 25, 2011, 2 pages.
Dorwaldt; Carl, "EASE 4.1 Tutorial," Renkus-Heinz, Inc., 2004, 417 pages.
Dynaudio Acoustics Air Series, http://www.soundonsound.com/sos/sep02/articles/dynaudioair.asp, 2002, 4 pages.
European Patent Office, European Search Report dated Jul. 5, 2016, issued in connection with European Patent Application No. 16156935.5, 9 pages.
Faller, Christof, "Coding of Spatial Audio Compatible with Different Playback Formats," Audio Engineering Society Convention Paper (Presented at the 117th Convention), Oct. 28-31, 2004, 12 pages.
Final Office Action dated Jul. 23, 2014, issued in connection with U.S. Appl. No. 13/896,037, filed May 16, 2013, 12 pages.
Final Office Action dated Jul. 1, 2016, issued in connection with U.S. Appl. No. 13/458,558, filed Apr. 27, 2012, 11 pages.
Final Office Action dated Feb. 10, 2014, issued in connection with U.S. Appl. No. 13/013,740, filed Jan. 25, 2011, 13 pages.
Final Office Action dated Oct. 13, 2011, issued in connection with U.S. Appl. No. 11/853,790, filed Sep. 11, 2007, 10 pages.
Final Office Action dated Jun. 29, 2015, issued in connection with U.S. Appl. No. 14/465,457, filed Aug. 21, 2014, 13 pages.
Herre et al., "The Reference Model Architecture for MPEG Spatial Audio Coding," Audio Engineering Society Convention Paper (Presented at the 118th Convention), May 28-31, 2005, 13 pages.
ID3 tag version 2.4.0—Native Frames, Draft Specification, copyright 2000, 41 pages.
International Bureau, International Preliminary Report on Patentability, dated Oct. 17, 2013, issued in connection with International Application No. PCT/IB2012/052071, filed on Apr. 26, 2012, 7 pages.
International Searching Authority, International Search Report for Application No. PCT/IB2012/052071, dated Aug. 23, 2012, 3 pages.
International Searching Authority, Written Opinion dated Aug. 23, 2012, issued in connection with International Application No. PCT/IB2012/052071, filed on Apr. 26, 2012, 6 pages.
Japanese Intellectual Property Office, Office Action Summary dated Sep. 8, 2015, issued in connection with Japanese Patent Application No. 2014-503273, 4 pages.
Japanese Intellectual Property Office,Office Action dated Jan. 6, 2015, issued in connection with Japanese Patent Application No. 2014-503273, 5 pages.
Non-Final Office Action dated Jan. 7, 2014, issued in connection with U.S. Appl. No. 13/896,829, filed May 17, 2013, 11 pages.
Non-Final Office Action dated Feb. 10, 2014, issued in connection with U.S. Appl. No. 13/083,499, filed Apr. 8, 2011, 12 pages.
Non-Final Office Action dated Jul. 23, 2014, issued in connection with U.S. Appl. No. 14/256,434, filed Apr. 18, 2014, 12 pages.
Non-Final Office Action dated Mar. 8, 2011, issued in connection with U.S. Appl. No. 11/853,790, filed Sep. 11, 2007, 10 pages.
Non-Final Office Action dated May 9, 2014, issued in connection with U.S. Appl. No. 13/892,230, filed on May 10, 2013, 10 pages.
Non-Final Office Action dated Feb. 13, 2014, issued in connection with U.S. Appl. No. 13/896,037, filed May 16, 2013, 9 pages.
Non-Final Office Action dated Feb. 13, 2015, issued in connection with U.S. Appl. No. 13/013,740, filed Jan. 25, 2011, 14 pages.
Non-Final Office Action dated Jun. 13, 2016, issued in connection with U.S. Appl. No. 15/134,761, filed Apr. 21, 2016, 10 pages.
Non-Final Office Action dated Mar. 23, 2015, issued in connection with U.S. Appl. No. 14/299,847, filed Jun. 9, 2014, 14 pages.
Non-Final Office Action dated Jan. 27, 2015, issued in connection with U.S. Appl. No. 14/465,457, filed Aug. 21, 2014, 11 pages.
Non-Final Office Action dated Sep. 27, 2013,issued in connection with U.S. Appl. No. 13/013,740, filed Jan. 25, 2011, 12 pages.
Non-Final Office Action dated Jun. 29, 2016, issued in connection with U.S. Appl. No. 14/629,937, filed Feb. 24, 2015, 12 pages.
Notice of Allowability dated Apr. 18, 2013, issued in connection with U.S. Appl. No. 11/853,790, filed Sep. 11, 2007, 4 pages.
Notice of Allowance dated Jun. 2, 2014, issued in connection with U.S. Appl. No. 13/083,499, filed Apr. 8, 2011, 5 pages.
Notice of Allowance dated Dec. 5, 2014, issued in connection with U.S. Appl. No. 14/256,434, filed Apr. 18, 2014, 7 pages.
Notice of Allowance dated Sep. 6, 2016, issued in connection with U.S. Appl. No. 15/134,747, filed Apr. 21, 2016, 7 pages.
Notice of Allowance dated Jul. 10, 2015, issued in connection with U.S. Appl. No. 13/013,740, filed Jan. 25, 2011, 9 pages.
Notice of Allowance dated Sep. 10, 2014, issued in connection with U.S. Appl. No. 13/892,230, filed May 10, 2013, 5 pages.
Notice of Allowance dated Jun. 12, 2014, issued in connection with U.S. Appl. No. 13/896,829, filed May 17, 2013, 5 pages.
Notice of Allowance dated May 13, 2015, issued in connection with U.S. Appl. No. 14/299,847, filed Jun. 9, 2014, 10 pages.
Notice of Allowance dated Aug. 19, 2016, issued in connection with U.S. Appl. No. 14/619,813, filed Feb. 11, 2015, 9 pages.
Notice of Allowance dated Jan. 20, 2016, issued in connection with U.S. Appl. No. 14/465,457, filed Aug. 21, 2014, 10 pages.
Notice of Allowance dated Oct. 27, 2015, issued in connection with U.S. Appl. No. 14/299,847, filed Jun. 9, 2014, 5 pages.
Notice of Allowance dated Oct. 28, 2014, issued in connection withU.S. Appl. No. 13/896,037, filed May 16, 2013, 7 pages.
Preinterview First Office Action dated Jun. 8, 2016, issued in connection with U.S. Appl. No. 14/619,813, filed Feb. 11, 2015, 4 pages.
Rane: DragNet software; available for sale at least 2006.
Sonos Controller for iPad Product Guide; copyright 2004-2013; 47 pages.
"884+ Automatic Matrix Mixer Control System," Ivie Technologies, Inc., 2000, pp. 1-4.
Advanced Driver Tab User Interface WaveLan GUI Guide, AVAGO0009, Agere Systems, Feb. 2004, 4 pages.
Agere Systems' Voice-over-Wireless LAN (VoWLAN) Station Quality of Service, AVAGO0015, Agere Systems, Jan. 2005, 5 pages.
Akyildiz et al., "Multimedia Group Synchronization Protocols for Integrated Services Networks," IEEE Journal on Selected Areas in Communications, 1996 pp. 162-173, vol. 14, No. 1.
Audio Authority: How to Install and Use the Model 1154 Signal Sensing Auto Selector, 2002, 4 pages.
Audio Authority: Model 1154B High Definition AV Auto Selector, 2008, 8 pages.
AudioSource: AMP 100 User Manual, 2003, 4 pages.
Automatic Profile Hunting Functional Description, AVAGO0013, Agere Systems, Feb. 2004, 2 pages.
AXIS Communication: AXIS P8221 Network I/O Audio Module, 2009, 41 pages.

(56) References Cited

OTHER PUBLICATIONS

Balfanz et al., "Network-in-a-Box: How to Set Up a Secure Wireless Network in Under a Minute," 13th USENIX Security Symposium—Technical Paper, 2002, 23 pages.
Balfanz et al., "Talking to Strangers: Authentication in Ad-Hoc Wireless Networks," Xerox Palo Alto Research Center, 2002, 13 pages.
Barham et al., "Wide Area Audio Synchronisation," University of Cambridge Computer Laboratory, 1995, 5 pages.
Bogen Communications, Inc., ProMatrix Digitally Matrixed Amplifier Model PM3180, Copyright 1996, 2 pages.
Brassil et al., "Enhancing Internet Streaming Media with Cueing Protocols," 2000, 9 pages.
Breebaart et al., "Multi-Channel Goes Mobile: MPEG Surround Binaural Rendering," AES 29th International Conference, Sep. 2-4, 2006, 1-13.
Cen et al., "A Distributed Real-Time MPEG Video Audio Player," Department of Computer Science and Engineering. Oregon Graduate Institute of Science and Technology, 1995, 12 pages.
Change Notification: Agere Systems WaveLan Multimode Reference Design (D2 to D3), AVAGO0042, Agere Systems, Nov. 2004, 2 pages.
Dannenberg et al., "A. System Supporting Flexible Distributed Real-Time Music Processing," Proceedings of the 2001 International Computer Music Conference, 2001, 4 pages.
Dannenberg; Roger B., "Remote Access to Interactive Media," Proceedings of the SPIE 1785, 1993, 230-237.
Day, Rebecca, "Going Elan!" Primedia Inc., 2003, 4 pages.
Deep-Sleep Implementation in WL60011 for IEEE 802.11b Applications, AVAGO0020, Agere Systems, Jul. 2004, 22 pages.
Denon AV Surround Receiver AVR-1604/684 User's Manual, 2004, 128 pages.
Denon AV Surround Receiver AVR-5800 Operating Instructions, Copyright 2000, 67 pages.
Fireball DVD and Music Manager DVDM-100 Installation and User's Guide, Copyright 2003, 185 pages.
Fireball MP-200 User's Manual, Copyright 2006, 93 pages.
Fireball Remote Control Guide WD006-1-1, Copyright 2003, 19 pages.
Fireball SE-D1 User's Manual, Copyright 2005, 90 pages.
Fober et al., "Clock Skew Compensation over a High Latency Network," Proceedings of the ICMC, 2002, pp. 548-552.
Gaston et al., "Methods for Sharing Stereo and Multichannel Recordings Among Planetariums," Audio Engineering Society Convention Paper 7474, 2008, 15 pages.
IBM Home Director Installation and Service Manual, Copyright 1998, 124 pages.
IBM Home Director Owner's Manual, Copyright 1999, 67 pages.
Integra Audio Network Receiver NAC 2.3 Instruction Manual, 68 pages.
Integra Audio Network Server NAS 2.3 Instruction Manual, pp. 1-32.
Integra Service Manual, Audio Network Receiver Model NAC-2.3, Dec. 2002, 44 pages.
Ishibashi et al., "A Comparison of Media Synchronization Quality Among Reactive Control Schemes," IEEE Infocom, 2001, pp. 77-84.
Issues with Mixed IEEE 802.b/802.11g Networks, AVAGO0058, Agere Systems, Feb. 2004, 5 pages.
Lake Processors: Lake® LM Series Digital Audio Processors Operation Manual, 2011, 71 pages.
"A/V Surround Receiver AVR-5800," Denon Electronics, 2000, 2 pages.
"A/V System Controller, Owner's Manual," B&K Compontents, Ltd., 1998, 52 pages.
"Denon 2003-2004 Product Catalog," Denon, 2003-2004, 44 pages.
"DP-0206 Digital Signal Processor," TOA Electronics, Inc., 2001, pp. 1-12.
"Home Theater Control Systems," Cinema Source, 2002, 19 pages.
"Model MRC44 Four Zone—Four Source Audio/Video Controller/Amplifier System," Xantech Corporation, 2002, 52 pages.
"NexSys Software v. 3 Manual," Crest Audio, Inc., 1997, 76 pages.
"Residential Distributed Audio Wiring Practices," Leviton Network Solutions, 2001, 13 pages.
"RVL-6 Modular Multi-Room Controller, Installation & Operation Guide," Nile Audio Corporations, 1999, 46 pages.
"Systemline Modular Installation Guide, Multiroom System," Systemline, 2003, pp. 1-22.
"ZR-8630AV MultiZone Audio/Video Receiver, Installation and Operation Guide," Niles Audio Corporation, 2003, 86 pages.
Sonos Play:3 Product Guide; copyright 2004-2011; 2 pages.
Sonos Play:3 Product Guide; copyright 2004-2012; 14 pages.
Sonos Play:3 Product Guide; copyright 2004-2013; 15 pages.
Sonos Play:3 Teardown; https://www.ifixit.com/Teardown/Sonos+Play%3A3+Teardown/12475; 11 pages.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.
Yamaha DME Designer software manual: Copyright 2004, 482 pages.
Notice of Allowance dated Sep. 9, 2016, issued in connection with U.S. Appl. No. 15/134,761, filed Apr. 21, 2016, 7 pages.
"Notice of Allowance dated Oct. 21, 2015, issued in connection with U.S. Appl. No. 14/174,244, filed Feb. 6. 2014, 5 pages."
"Notice of Allowance dated Oct. 21, 2015, issued in connection with U.S. Appl. No. 14/174253, filed Feb. 6, 2014, 6 pages."
Non-Final Office Action dated Nov. 16, 2016, issued in connection with U.S. Appl. No. 15/228,639, filed Aug. 4, 2016, 15 pages.
Non-Final Office Action dated Nov. 17, 2014, issued in connection with U.S. Appl. No. 13/864,247, filed Apr. 17, 2013, 11 pages.
Non-Final Office Action dated Feb. 18, 2009, issued in connection with U.S. Appl. No. 10/861,653, filed Jun. 5, 2004, 18 pages.
Non-Final Office Action dated Nov. 18, 2014, issued in connection with U.S. Appl. No. 13/435,739, filed Mar. 30, 2012, 10 pages.
Non-Final Office Action dated Jun. 19, 2015, issued in connection with U.S. Appl. No. 13/533,105, filed Jun. 26, 2012, 38 pages.
Non-Final Office Action dated Nov. 19, 2014, issued in connection with U.S. Appl. No. 13/848,921, filed Mar. 22, 2013, 9 pages.
Non-Final Office Action dated Aug. 20, 2009, issued in connection with U.S. Appl. No. 11/906,702, filed Oct. 2, 2007, 27 pages.
Non-Final Office Action dated Sep. 21, 2016, issued in connection with U.S. Appl. No. 15/080,591, filed Mar. 25, 2016, 9 pages.
Non-Final Office Action dated Sep. 21, 2016, issued in connection with U.S. Appl. No. 15/080,716, filed Mar. 25, 2016, 8 pages.
Non-Final Office Action dated Sep. 21, 2016, issued in connection with U.S. Appl. No. 15/088,283, filed Apr. 1, 2016, 8 pages.
Non-Final Office Action dated Sep. 21, 2016, issued in connection with U.S. Appl. No. 15/088,532, filed Apr. 1, 2016, 9 pages.
Non-Final Office Action dated Sep. 22, 2016, issued in connection with U.S. Appl. No. 15/088,906, filed Apr. 1, 2016, 9 pages.
Non-Final Office Action dated Sep. 22, 2016, issued in connection with U.S. Appl. No. 15/155,149, filed May 16, 2016 7 pages.
Non-Final Office Action dated Jun. 23, 2015, issued in connection with U.S. Appl. No. 13/705,176, filed Dec. 5, 2012, 30 pages.
Non-Final Office Action dated Oct. 23, 2014, issued in connection with U.S. Appl. No. 13/848,904, filed Mar. 22, 2013, 11 pages.
Non-Final Office Action dated Oct. 23, 2014, issued in connection with U.S. Appl. No. 13/864,251, filed Apr. 17, 2013, 11 pages.
Non-Final Office Action dated Oct. 23, 2014 issued in connection with U.S. Appl. No. 13/888,203, filed May 6, 2013, 9 pages.
Non-Final Office Action dated Oct. 24, 2014, issued in connection with U.S. Appl. No. 13/435,776, filed Mar. 30, 2012, 14 pages.
Non-Final Office Action dated Feb. 26, 2015, issued in connection with U.S. Appl. No. 14/186,850, filed Feb. 21, 2014, 25 pages.
Non-Final Office Action dated Mar. 26, 2015, issued in connection with U.S. Appl. No. 14/184,528, filed Feb. 19, 2014, 18 pages.
Non-Final Office Action dated Jun. 27, 2008, issued in connection with U.S. Appl. No. 10/861,653, filed Jun. 5, 2004, 19 pages.
Non-Final Office Action dated Mar. 27, 2015, issued in connection with U.S. Appl. No. 13/705,178, filed Dec. 5, 2012, 14 pages.

(56) References Cited

OTHER PUBLICATIONS

Non-Final Office Action dated Dec. 28, 2015, issued in connection with U.S. Appl. No. 14/290,493, filed May 29, 2014, 29 pages.
Non-Final Office Action dated Dec. 28, 2016, issued in connection with U.S. Appl. No. 15/343,000, filed Nov. 3, 2016, 11 pages.
Non-Final Office Action dated Apr. 30, 2012, issued in connection with U.S. Appl. No. 13/204,511, filed Aug. 5, 2011, 16 pages.
Non-Final Office Action dated Jan. 30, 2015, issued in connection with U.S. Appl. No. 14/504,812, filed Oct. 2, 2014, 13 pages.
Non-Final Office Action dated Jan. 30, 2015, issued in connection with U.S. Appl. No. 14/290,493, filed May 29, 2014, 30 pages.
Non-Final Office Action dated Nov. 30, 2016, issued in connection with U.S. Appl. No. 15/243,186, filed Aug. 22, 2016, 12 pages.
Non-Final Office Action dated Sep. 30, 2016, issued in connection with U.S. Appl. No. 13/864,249, filed Apr. 17, 2013, 12 pages.
North American MPEG-2 Information, "The MPEG-2 Transport Stream," Retrieved from the Internet:, 2006, pp. 1-5.
Notice of Allowance dated Jan. 31, 2013, issued in connection with U.S. Appl. No. 13/298,090, filed Nov. 16, 2011, 19 pages.
Notice of Allowance dated Dec. 1, 2016, issued in connection with U.S. Appl. No. 15/088,283, filed Apr. 1, 2016, 9 pages.
Notice of Allowance dated Dec. 2, 2016, issued in connection with U.S. Appl. No. 15/088,532, filed Apr. 1, 2016, 9 pages.
Notice of Allowance dated Dec. 2, 2016, issued in connection with U.S. Appl. No. 15/088,678, filed Apr. 1, 2016, 9 pages.
Notice of Allowance dated Dec. 2, 2016, issued in connection with U.S. Appl. No. 15/089,758, filed Apr. 4, 2016, 9 pages.
Notice of Allowance dated Dec. 2, 2016, issued in connection with U.S. Appl. No. 15/155,149, filed May 16, 2016, 9 pages.
Notice of Allowance dated Jul. 2, 2015, issued in connection with U.S. Appl. No. 13/848,904, filed Mar. 22, 2013, 17 pages.
Notice of Allowance dated Jul. 2, 2015, issued in connection with U.S. Appl. No. 13/888,203, filed May 6, 2013, 19 pages.
Notice of Allowance dated Jul. 2, 2015, issued in connection with U.S. Appl. No. 14/184,935, filed Feb. 20, 2014, 23 pages.
Notice of Allowance dated Sep. 3, 2015, issued in connection with U.S. Appl. No. 13/705,174, filed Dec. 5, 2012, 4 pages.
Notice of Allowance dated Aug. 4, 2015, issued in connection with U.S. Appl. No. 14/516,867, filed Oct. 17, 2014, 13 pages.
Notice of Allowance dated Oct. 5, 2012, issued in connection with U.S. Appl. No. 13/204,511, filed Aug. 5, 2011, 11 pages.
Notice of Allowance dated Mar. 6, 2014, issued in connection with U.S. Appl. No. 13/827,653, filed Mar. 14, 2013, 17 pages.
Notice of Allowance dated May 6, 2011, issued in connection with U.S. Appl. No. 11/801,468, filed May 9, 2007, 10 pages.
Notice of Allowance dated Sep. 6, 2013, issued in connection with U.S. Appl. No. 13/619,237, filed Sep. 14, 2012, 10 pages.
Notice of Allowance dated Apr. 7, 2016, issued in connection with U.S. Appl. No. 13/533,105, filed Jun. 26, 2012, 40 pages.
Notice of Allowance dated Oct. 7, 2015, issued in connection with U.S. Appl. No. 14/184,526, filed Feb. 19, 2014, 7 pages.
Notice of Allowance dated Oct. 9, 2015, issued in connection with U.S. Appl. No. 13/435,739, filed Mar. 30, 2012, 4 pages.
Notice of Allowance dated Aug. 10, 2015, issued in connection with U.S. Appl. No. 13/848,904, filed Mar. 22, 2013, 9 pages.
Notice of Allowance dated Nov. 10, 2011, issued in connection with U.S. Appl. No. 11/906,702, filed Oct. 7, 2007, 17 pages.
Advisory Action dated Feb. 2, 2016, issued in connection with U.S. Appl. No. 13/848,921, filed Mar. 22, 2013, 8 pages.
Advisory Action dated Sep. 18, 2008, issued in connection with U.S. Appl. No. 10/816,217, filed Apr. 1, 2004, 8 pages.
Advisory Action dated Feb. 1, 2016, issued in connection with U.S. Appl. No. 13/864,247, filed Apr. 17, 2013, 6 pages.
Advisory Action dated Jun. 1, 2015, issued in connection with U.S. Appl. No. 14/516,867, filed Oct. 17, 2014, 11 pages.
Advisory Action dated Mar. 2, 2015, issued in connection with U.S. Appl. No. 13/848,932, filed Mar. 22, 2013, 3 pages.
Advisory Action dated Jan. 5, 2012, issued in connection with U.S. Appl. No. 12/035,112, filed Feb. 21, 2008, 3 pages.
Advisory Action dated Sep. 5, 2014, issued in connection with U.S. Appl. No. 13/907,666, filed May 31, 2013, 3 pages.
Advisory Action dated Jan. 8, 2015, issued in connection with U.S. Appl. No. 13/705,176, filed Dec. 5, 2012, 4 pages.
Advisory Action dated Jun. 9, 2016, issued in connection with U.S. Appl. No. 13/871,795, filed Apr. 25, 2013, 14 pages.
Advisory Action dated Feb. 10, 2016, issued in connection with U.S. Appl. No. 13/871,795, filed Apr. 26, 2013, 3 pages.
Advisory Action dated Nov. 12, 2014, issued in connection with U.S. Appl. No. 13/907,666, filed May 31, 2013, 6 pages.
Advisory Action dated Apr. 15, 2015, issued in connection with U.S. Appl. No. 14/184,526, filed Feb. 19, 2014, 9 pages.
Advisory Action dated Apr. 15, 2015, issued in connection with U.S. Appl. No. 14/184,935, filed Feb. 20, 2014, 9 pages.
Advisory Action dated Mar. 25, 2015, issued in connection with U.S. Appl. No. 13/533,105, filed Jun. 26, 2012, 5 pages.
Advisory Action dated Feb. 26, 2015, issued in connection with U.S. Appl. No. 14/184,528, filed Feb. 19, 2014, 3 pages.
Advisory Action dated Nov. 26, 2014, issued in connection with U.S. Appl. No. 14/186,850, filed Feb. 21, 2014, 9 pages.
Advisory Action dated Jul. 28, 2015, issued in connection with U.S. Appl. No. 14/184,522, filed Feb. 19, 2014, 7 pages.
Advisory Action dated Sep. 28, 2009, issued in connection with U.S. Appl. No. 10/816,217, filed Apr. 1, 2004, 4 pages.
Baldwin, Roberto. "How-To: Setup iTunes DJ on Your Max and iPhone", available at http://www.maclife.com/article/howtos/howto_setup_itunes_dj_your mac_and_iphone, archived on Mar. 17, 2009, 4 pages.
Baudisch et al., "Flat Volume Control: Improving Usability by Hiding the Volume Control Hierarchy in the User Interface," 2004, 8 pages.
Benslimane Abderrahim, "A Multimedia Synchronization Protocol for Multicast Groups," Proceedings of the 26th Euromicro Conference, 2000, pp. 456-463, vol. 1.
Biersack et al., "Intra- and Inter-Stream Synchronization for Stored Multimedia Streams," IEEE International Conference on Multimedia Computing and Systems, 1996, pp. 372-381.
Blakowski G. et al., "A Media Synchronization Survey: Reference Model, Specification, and Case Studies," Jan. 1996, pp. 5-35, vol. 14, No. 1.
Bretl W.E., et al., MPEG2 Tutorial [online], 2000 [retrieved on Jan. 13, 2009] Retrieved from the Internet:, pp. 1-23.
Canadian Intellectual Property Office, Canadian Office Action dated Apr. 4, 2016, issued in connection with Canadian Patent Application No. 2,842,342, 5 pages.
Canadian Intellectual Property Office, Canadian Office Action dated Sep. 14, 2015, issued in connection with Canadian Patent Application No. 2,842,342, 2 pages.
Chakrabarti et al., "A Remotely Controlled Bluetooth Enabled Environment," IEEE, 2004, pp. 77-81.
Chinese Patent Office, Office Action dated Jul. 5, 2016, issued in connection with Chinese Patent Application No. 201380044380.2, 25 pages.
Corrected Notice of Allowance dated Aug. 19, 2015, issued in connection with U.S. Appl. No. 13/907,666, filed May 31, 2013, 2 pages.
Creative, "Connecting Bluetooth Devices with Creative D200," http://support.creative.com/kb/ShowArticle.aspx?url=http://ask.creative.com:80/SRVS/CGI-BIN/WEBCGI.EXE/,/?St=106,E=000000000396859016,K=9377,Sxi=8,VARSET=ws:http://us.creative.com,case=63350>, available on Nov. 28, 2011, 2 pages.
Crown PIP Manual available for sale at least 2004, 68 pages.
European Patent Office, European Extended Search Repor dated Feb. 28, 2014, issued in connection with EP Application No. 13184747.7, 8 pages.
European Patent Office, European Extended Search Report dated Mar. 7, 2016, issued in connection with EP Application No. 13810340.3, 9 pages.
European Patent Office, European Extended Search Report dated Mar. 31, 2015, issued in connection with EP Application No. 14181454.1, 9 pages.

(56) References Cited

OTHER PUBLICATIONS

European Patent Office, Examination Report dated Mar. 22, 2016, issued in connection with European Patent Application No. EP14181454.1, 6 pages.
European Patent Office, Examination Report dated Oct. 24, 2016, issued in connection with European Patent Application No. 13808623.6, 4 pages.
Falcone, John, "Sonos BU150 Digital Music System review," CNET, CNET [online] Jul. 27, 2009 [retrieved on Mar. 16, 2016], 11 pages Retrieved from the Internet: URL:http://www.cnet.com/products/sonos-bu150-digital-music-system/.
File History of Re-Examination U.S. Appl. No. 90/013,423.
Final Office Action dated Jun. 5, 2014, issued in connection with U.S. Appl. No. 13/907,666, filed May 31, 2013, 12 pages.
Final Office Action dated Jul. 13, 2009, issued in connection with U.S. Appl. No. 10/816,217, filed Apr. 1, 2004, 16 pages.
Final Office Action dated Sep. 13, 2012, issued in connection with U.S. Appl. No. 13/297,000, filed Nov. 15, 2011, 17 pages.
Final Office Action dated Nov. 18, 2015, issued in connection with U.S. Appl. No. 13/533,105, filed Jun. 26, 2012, 56 pages.
Final Office Action dated Oct. 21, 2011, issued in connection with U.S. Appl. No. 10/816,217, filed Apr. 1, 2004, 19 pages.
Final Office Action dated Mar. 27, 2014, issued in connection with U.S. Appl. No. 13/533,105, filed Jun. 26, 2012, 29 pages.
Final Office Action dated Jan. 28, 2011, issued in connection with U.S. Appl. No. 10/816,217, filed Apr. 1, 2004, 21 pages.
Final Office Action dated Jun. 30, 2008, issued in connection with U.S. Appl. No. 10/816,217, filed Apr. 1, 2004, 30 pages.
Final Office Action dated Aug. 3, 2015, issued in connection with U.S. Appl. No. 13/848,921, filed Mar. 22, 2013, 13 pages.
Final Office Action dated Dec. 3, 2014, issued in connection with U.S. Appl. No. 14/184,528, filed Feb. 19, 2014, 12 pages.
Final Office Action dated Jul. 3, 2012, issued in connection with U.S. Appl. No. 13/298,090, filed Nov. 16, 2011, 41 pages.
Final Office Action dated Jun. 3, 2016, issued in connection with U.S. Appl. No. 13/705,176, filed Dec. 5, 2012, 24 pages.
Notice of Allowance dated Apr. 11, 2016, issued in connection with U.S. Appl. No. 13/864,247, filed Apr. 17, 2013, 21 pages.
Notice of Allowance dated Jan. 11, 2017, issued in connection with U.S. Appl. No. 14/565,544, filed Dec. 9, 2014, 5 pages.
Notice of Allowance dated Aug. 12, 2015, issued in connection with U.S. Appl. No. 13/435,739, filed Mar. 30, 2012, 27 pages.
Notice of Allowance dated Jul. 13, 2015, issued in connection with U.S. Appl. No. 14/184,526, filed Feb. 19, 2014, 22 pages.
Notice of Allowance dated Nov. 13, 2013, issued in connection with U.S. Appl. No. 13/724,048, filed Dec. 21, 2012, 7 pages.
Notice of Allowance dated Oct. 13, 2015, issued in connection with U.S. Appl. No. 13/864,251, filed Apr. 17, 2013, 7 pages.
Notice of Allowance dated Jun. 14, 2012, issued in connection with U.S. Appl. No. 12/035,112, filed Feb. 21, 2008, 9 pages.
Notice of Allowance dated Jul. 15, 2015, issued in connection with U.S. Appl. No. 13/705,174, filed Dec. 5, 2012, 18 pages.
Notice of Allowance dated Jun. 16, 2009, issued in connection with U.S. Appl. No. 10/861,653, filed Jun. 5, 2004, 11 pages.
Notice of Allowance dated Jul. 17, 2015, issued in connection with U.S. Appl. No. 13/864,251, filed Apr. 17, 2013, 20 pages.
Notice of Allowance dated May 19, 2015, issued in connection with U.S. Appl. No. 13/907,666, filed May 31, 2013, 7 pages.
Notice of Allowance dated Oct. 19, 2016, issued in connection with U.S. Appl. No. 14/290,493, filed May 29, 2014, 14 pages.
Notice of Allowance dated Sep. 21, 2015, issued in connection with U.S. Appl. No. 13/297,000, filed Nov. 15, 2011, 11 pages.
Notice of Allowance dated Sep. 22, 2015, issued in connection with U.S. Appl. No. 13/888,203, filed May 6, 2013, 7 pages.
Notice of Allowance dated Sep. 24, 2015, issued in connection with U.S. Appl. No. 13/705,174, filed Dec. 5, 2012, 7 pages.
Notice of Allowance dated Sep. 24, 2015, issued in connection with U.S. Appl. No. 14/184,935, filed Feb. 20, 2014, 7 pages.
Notice of Allowance dated Sep. 25, 2014, issued in connection with U.S. Appl. No. 14/176,808, filed Feb. 10, 2014, 5 pages.
Notice of Allowance dated Aug. 27, 2015, issued in connection with U.S. Appl. No. 13/705,177, filed Dec. 5, 2012, 34 pages.
Notice of Allowance dated Aug. 27, 2015, issued in connection with U.S. Appl. No. 14/505,027, filed Oct. 2, 2014, 18 pages.
Notice of Allowance dated Dec. 27, 2011, issued in connection with U.S. Appl. No. 10/816,217, filed Apr. 1, 2004, 15 pages.
Notice of Allowance dated Jul. 29, 2015, issued in connection with U.S. Appl. No. 13/359,976, filed Jan. 27, 2012, 28 pages.
Notice of Allowance dated Jul. 29, 2015, issued in connection with U.S. Appl. No. 14/186,850, filed Feb. 21, 2014, 9 pages.
Notice of Allowance dated Aug. 30, 2016, issued in connection with U.S. Appl. No. 14/290,493, filed May 29, 2014, 7 pages.
Notice of Allowance dated Jul. 30, 2015, issued in connection with U.S. Appl. No. 13/705,178, filed Dec. 5, 2012, 18 pages.
Notice of Allowance dated Aug. 5, 2015, issued in connection with U.S. Appl. No. 13/435,776, filed Mar. 30, 2012, 26 pages.
Notice of Allowance dated Jul. 6, 2015, issued in connection with U.S. Appl. No. 13/297,000, filed Nov. 15, 2011, 24 pages.
Nutzel et al., "Sharing Systems for Future HiFi Systems," IEEE, 2004, 9 pages.
Park et al., "Group Synchronization in MultiCast Media Communications," Proceedings of the 5th Research on Multicast Technology Workshop, 2003, 5 pages.
Pre-Interview First Office Action dated Mar. 10, 2015, issued in connection with U.S. Appl. No. 14/505,027, filed Oct. 2, 2014, 4 pages.
PRISMIQ, Inc., "PRISMIQ Media Player User Guide," 2003, 44 pages.
Re-Exam Final Office Action dated Aug. 5, 2015, issued in connection with U.S. Appl. No. 90/013,423, filed Jan. 5, 2015, 25 pages.
Re-Exam Non-Final Office Action dated Apr. 22, 2015, issued in connection with U.S. Appl. No. 90/013,423, filed Jan. 5, 2015, 16 pages.
Renkus Heinz Manual; available for sale at least 2004, 6 pages.
Roland Corporation, "Roland announces BA-55 Portable PA System," press release, Apr. 6, 2011, 2 pages.
Rothermel et al., "An Adaptive Stream Synchronization Protocol," 5th International Workshop on Network and Operating System Support for Digital Audio and Video, 1995, 13 pages.
Schmandt et al., "Impromptu: Managing Networked Audio Applications for Mobile Users," 2004, 11 pages.
Schulzrinne H., et al., "RTP: A Transport Protocol for Real-Time Applications, RFC 3550," Network Working Group, 2003, pp. 1-89.
*Sonos, Inc.* v. *D&M Holdings Inc. et al.*, Defendant's Amended Invalidity Contentions Exhibit 1: Defendants' Invalidity Contentions for U.S. Pat. No. 7,571,014 filed Sep. 16, 2016, 270 pages.
*Sonos, Inc.* v. *D&M Holdings Inc. et al.*, Defendant's Amended Invalidity Contentions Exhibit 10: Defendants' Invalidity Contentions for U.S. Pat. No. 9,219,959 filed Sep. 27, 2016, 236 pages.
*Sonos, Inc.* v. *D&M Holdings Inc. et al.*, Defendant's Amended Invalidity Contentions Exhibit 11: Defendants' Invalidity Contentions for Design U.S. Pat. No. D. 559,197 filed Sep. 27, 2016, 52 pages.
*Sonos, Inc.* v. *D&M Holdings Inc. et al.*, Defendant's Amended Invalidity Contentions Exhibit 2: Defendants' Invalidity Contentions for U.S. Pat. No. 8,588,949 filed Sep. 27, 2016, 224 pages.
*Sonos, Inc.* v. *D&M Holdings Inc. et al.*, Defendant's Amended Invalidity Contentions Exhibit 3: Defendants' Invalidity Contentions for U.S. Pat. No. 8,843,224 filed Sep. 27, 2016, 147 pages.
*Sonos, Inc.* v. *D&M Holdings Inc. et al.*, Defendant's Amended Invalidity Contentions Exhibit 4: Defendants' Invalidity Contentions for U.S. Pat. No. 8,938,312 filed Sep. 27, 2016, 229 pages.
*Sonos, Inc.* v. *D&M Holdings Inc. et al.*, Defendant's Amended Invalidity Contentions Exhibit 5: Defendants' Invalidity Contentions for U.S. Pat. No. 8,938,637 filed Sep. 27, 2016, 213 pages.
*Sonos, Inc.* v. *D&M Holdings Inc. et al.*, Defendant's Amended Invalidity Contentions Exhibit 6: Defendants' Invalidity Contentions for U.S. Pat. No. 9,042,556 filed Sep. 27, 2016, 162 pages.
*Sonos, Inc.* v. *D&M Holdings Inc. et al.*, Defendant's Amended Invalidity Contentions Exhibit 7: Defendants' Invalidity Contentions for U.S. Pat. No. 9,195,258 filed Sep. 27, 2016, 418 pages.

(56) References Cited

OTHER PUBLICATIONS

*Sonos, Inc.* v. *D&M Holdings Inc. et al.*, Defendant's Amended Invalidity Contentions Exhibit 8: Defendants' Invalidity Contentions for U.S. Pat. No. 9,202,509 filed Sep. 27, 2016, 331 pages.
*Sonos, Inc.* v. *D&M Holdings Inc. et al.*, Defendant's Amended Invalidity Contentions Exhibit 9: Defendants' Invalidity Contentions for U.S. Pat. No. 9,213,357 filed Sep. 27, 2016, 251 pages.
*Sonos, Inc.* v. *D&M Holdings Inc. et al.*, Defendants' Brief in Support of their Motion for Leave to Amend their Answer to Add the Defense of Inequitabke Conduct, provided Oct. 12, 2016, 24 pages.
*Sonos, Inc.* v. *D&M Holdings Inc. et al.*, Defendants' Opposition to Sonos's Motion to Strike Defendants' New Amended Answer Submitted with their Reply, provided Oct. 3, 2016, 15 pages.
*Sonos, Inc.* v. *D&M Holdings Inc. et al.*, Exhibit A: Defendants' First Amended Answer to Plaintiffs' Third Amended Complaint, provided Aug. 1, 2016, 26 pages,
*Sonos, Inc.* v. *D&M Holdings Inc. et al.*, Exhibit A: Defendants' Second Amended Answer to Plaintiffs' Third Amended Complaint, provided Oct. 12, 2016, 43 pages.
*Sonos, Inc.* v. *D&M Holdings Inc. et al.*, Exhibit A: Defendants' Second Amended Answer to Plaintiffs' Third Amended Complaint, provided Sep. 9, 2016, 88 pages.
*Sonos, Inc.* v. *D&M Holdings Inc. et al.*, Exhibit B: Defendants' Second Amended Answer to Plaintiffs' Third Amended Complaint, provided Oct. 12, 2016, 43 pages.
*Sonos, Inc.* v. *D&M Holdings Inc. et al.*, Opening Brief in Support of Defendants' Motion for Leave to Amend Their Answer to Add the Defense of Inequitable Conduct, provided Aug. 1, 2016, 11 pages.
*Sonos, Inc.* v. *D&M Holdings Inc. et al.*, Order, provided Oct. 7, 2016, 2 pages.
*Sonos, Inc.* v. *D&M Holdings Inc. et al.*, Plaintiff's Opposition to Defendants' Motion for Leave to Amend Their Answer to Add the Defense of Inequitable Conduct, provided Aug. 26, 2016, 25 pages.
*Sonos, Inc.* v. *D&M Holdings Inc. et al.*, Redlined Exhibit B: Defendants' First Amended Answer to Plaintiffs' Third Amended Complaint, provided Aug. 1, 2016, 27 pages.
*Sonos, Inc.* v. *D&M Holdings Inc. et al.*, Reply Brief in Support of Defendants' Motion for Leave to Amend their Answer to Add the Defense of Inequitable Conduct, provided Nov. 10, 2016, 16 pages.
*Sonos, Inc.* v. *D&M Holdings Inc. et al.*, Reply Brief in Support of Defendants' Motion for Leave to Amend their Answer to Add the Defense of Inequitable Conduct, provided Sep. 9, 2016, 16 pages.
*Sonos, Inc.* v. *D&M Holdings Inc. et al.*, Sono's Motion to Strike Defendants' New Amended Answer to Submitted with their Reply Brief, provided Sep. 15, 2016, 10 pages.
*Sonos, Inc.* v. *D&M Holdings Inc. et al.*, Sono's Opposition to Defendants' Motion for Leave to Amend their Answer to Add the Defense of Inequitable Conduct, provided Oct. 31, 2016, 26 pages.
Third Party Request for Ex Parte Re-Examination, U.S. Appl. No. 90/013,859, filed Nov. 4, 2016, 424 pages.
U.S. Appl. No. 60/490,768, filed Jul. 28, 2003, entitled "Method for synchronizing audio playback between multiple networked devices," 13 pages.
U.S. Appl. No. 60/825,407, filed Sep. 12, 2003, entitled "Controlling and manipulating groupings in a multi-zone music or media system," 82 pages.
"Welcome. You're watching Apple TV." Apple TV 1st Generation Setup Guide, Apr. 8, 2008 Retrieved Oct. 14, 2014, 40 pages.
"Welcome. You're watching Apple TV." Apple TV 2nd Generation Setup Guide, Mar. 10, 2011 Retrieved Oct. 16, 2014, 36 pages.
"Welcome. You're watching Apple TV." Apple TV 3rd Generation Setup Guide, Mar. 16, 2012 Retrieved Oct. 16, 2014, 36 pages.
Advisory Action dated Oct. 6, 2016, issued in connection with U.S. Appl. No. 13/458,558, filed Apr. 27, 2012, 4 pages.
Anonymous, "Information technology—Generic coding of moving pictures and associated audio information—Part 3: Audio," ISO/IEC 13818-3, Apr. 1998, pp. 15.
Anonymous, "Transmission Control Protocol," RFC: 793, USC/Information Sciences Institute, Sep. 1981, 91 pages.
Buerk et al., "AVTransport:1 Service Template Version 1.01," Contributing Members of the UPnP Forum, Jun. 25, 2002, 67 pages.
European Patent Office, Extended European Search Report dated Jul. 5, 2016, issued in connection with European Patent Application No. 16156940.5, 7 pages.
Japanese Patent Office, Office Action dated Nov. 1, 2016, issued in connection with Japanese Application No. 2015-238682, 5 pages.
Kou et al., "RenderingControl:1 Service Template Verion 1.01," Contributing Members of the UPnP Forum, Jun. 25, 2002, 63 pages.
Non-Final Office Action dated Oct. 12, 2016, issued in connection with U.S. Appl. No. 14/505,966, filed Oct. 3, 2014, 10 pages.
Non-Final Office Action dated Oct. 20, 2016, issued in connection with U.S. Appl. No. 14/563,515, filed Dec. 8, 2014, 10 pages.
Non-Final Office Action dated Sep. 27, 2016, issued in connection with U.S. Appl. No. 15/228,685, filed Aug. 4, 2016, 8 pages.
Non-Final Office Action dated Oct. 31, 2016, issued in connection with U.S. Appl. No. 14/806,070, filed Jul. 22, 2015, 11 pages.
Notice of Allowance dated Oct. 24, 2016, issued in connection with U.S. Appl. No. 15/134,761, filed Apr. 21, 2016, 7 pages.
Notice of Allowance dated Oct. 24, 2016, issued in connection with U.S. Appl. No. 15/134,767, filed Apr. 21, 2016, 7 pages.
Postel, J., "User Datagram Protocol," RFC: 768, USC/Information Sciences Institute, Aug. 1980, 3 pages.
Reexam Non-Final Office Action dated Oct. 17, 2016, issued in connection with U.S. Appl. No. 90/013,756, filed May 25, 2016, 31 pages.
Ritchie et al., "MediaServer:1 Device Template Version 1.01," Contributing Members of the UPnP Forum, Jun. 25, 2002, 12 pages.
Ritchie et al., "UPnP AV Architecture:1, Version 1.0," Contributing Members of the UPnP Forum, Jun. 25, 2002, 22 pages.
Ritchie, John, "MediaRenderer:1 Device Template Version 1.01," Contributing Members of the UPnP Forum, Jun. 25, 2002, 12 pages.
Schulzrinne et al., "RTP: A Transport Protocol for Real-Time Applications," Network Working Group, RFC: 3550, Standards Track, Jul. 2003, 104 pages.
Sonos Digital Music System User Guide, Version: 050801, Aug. 2005, 114 pages.
Sonos Multi-Room Music System User Guide, Version: 091001, 2009, 299 pages.
Motorola, "Simplefi, Wireless Digital Audio Receiver, Installation and User Guide," Dec. 31, 2001, 111 pages.
Nilsson, M., "ID3 Tag Version 2," Mar. 26, 1998, 28 pages.
Non-Final Office Action dated May 1, 2014, issued in connection with U.S. Appl. No. 14/184,522, filed Feb. 19, 2014, 31 pages.
Non-Final Office Action dated Dec. 5, 2013, issued in connection with U.S. Appl. No. 13/827,653, filed Mar. 14, 2013, 28 pages.
Non-Final Office Action dated Jan. 5, 2012, issued in connection with U.S. Appl. No. 13/298,090, filed Nov. 16, 2011, 35 pages.
Non-Final Office Action dated May 6, 2014, issued in connection with U.S. Appl. No. 13/705,176, filed Dec. 5, 2012, 23 pages.
Non-Final Office Action dated Sep. 7, 2016, issued in connection with U.S. Appl. No. 13/864,248, filed Apr. 17, 2013, 12 pages.
Non-final Office Action dated Apr. 10, 2013, issued in connection with U.S. Appl. No. 13/619,237, filed Sep. 14, 2012, 10 pages.
Non-Final Office Action dated May 12, 2014, issued in connection with U.S. Appl. No. 14/184,528, filed Feb. 19, 2014, 23 pages.
Non-Final Office Action dated May 14, 2014, issued in connection with U.S. Appl. No. 13/848,932, filed Mar. 22, 2013, 14 pages.
Non-Final Office Action dated Jun. 17, 2014, issued in connection with U.S. Appl. No. 14/176,808, filed Feb. 10, 2014, 6 pages.
Non-Final Office Action dated Dec. 18, 2013, issued in connection with U.S. Appl. No. 13/907,666, filed May 31, 2013, 12 pages.
Non-Final Office Action dated Jan. 18, 2008, issued in connection with U.S. Appl. No. 10/816,217, filed Apr. 1, 2004, 28 pages.
Non-Final Office Action dated Apr. 19, 2010, issued in connection with U.S. Appl. No. 11/801,468, filed May 9, 2007, 16 pages.
Non-Final Office Action dated Mar. 19, 2013, issued in connection with U.S. Appl. No. 13/724,048, filed Dec. 21, 2012, 9 pages.
Non-Final Office Action dated Jun. 21, 2011, issued in connection with U.S. Appl. No. 10/816,217, filed Apr. 1, 2004, 13 pages.

(56) References Cited

OTHER PUBLICATIONS

Non-Final Office Action dated Jan. 22, 2009, issued in connection with U.S. Appl. No. 10/816,217, filed Apr. 1, 2004, 18 pages.
Non-Final Office Action dated Jul. 25, 2014, issued in connection with U.S. Appl. No. 14/184,526, filed Feb. 19, 2014, 9 pages.
Non-Final Office Action dated Jul. 25, 2014, issued in connection with U.S. Appl. No. 14/184,935, filed Feb. 20, 2014, 11 pages.
Non-Final Office Action dated Jun. 25, 2010, issued in connection with U.S. Appl. No. 10/816,217, filed Apr. 1, 2004, 17 pages.
Non-Final Office Action dated Nov. 25, 2013, issued in connection with U.S. Appl. No. 13/533,105, filed Jun. 26, 2012, 19 pages.
Non-Final Office Action dated May 27, 2014, issued in connection with U.S. Appl. No. 14/186,850, filed Feb. 21, 2014, 13 pages.
Non-Final Office Action dated Feb. 29, 2012, issued in connection with U.S. Appl. No. 13/297,000, filed Nov. 15, 2011, 10 pages.
Non-Final Office Action dated Nov. 29, 2010, issued in connection with U.S. Appl. No. 11/801,468, filed May 9, 2007, 17 pages.
Non-Final Office Action dated Jul. 30, 2013, issued in connection with U.S. Appl. No. 13/724,048, filed Dec. 21, 2012, 7 pages.
Non-Final Office Action dated Jul. 31, 2014, issued in connection with U.S. Appl. No. 13/533,105, filed Jun. 26, 2012, 31 pages.
Non-Final Office Action dated Dec. 1, 2014, issued in connection with U.S. Appl. No. 14/516,867, filed Oct. 17, 2014, 11 pages.
Non-Final Office Action dated Jun. 1, 2016, issued in connection with U.S. Appl. No. 14/184,522, filed Feb. 19, 2014, 21 pages.
Non-Final Office Action dated Jan. 3, 2017, issued in connection with U.S. Appl. No. 14/808,397, filed Jul. 24, 2015, 11 pages.
Non-Final Office Action dated Jun. 3, 2015, issued in connection with U.S. Appl. No. 14/564,544, filed Dec. 9, 2014, 7 pages.
Non-Final Office Action dated Nov. 3, 2016, issued in connection with U.S. Appl. No. 14/184,528, filed Feb. 19, 2014, 17 pages.
Non-Final Office Action dated Jan. 4, 2017, issued in connection with U.S. Appl. No. 14/825,961, filed Aug. 13, 2015, 11 pages.
Non-Final Office Action dated Jun. 4, 2015, issued in connection with U.S. Appl. No. 13/871,795, filed Apr. 26, 2013, 16 pages.
Non-Final Office Action dated Mar. 4, 2015, issued in connection with U.S. Appl. No. 13/435,776, filed Mar. 30, 2012, 16 pages.
Non-Final Office Action dated Oct. 4, 2016, issued in connection with U.S. Appl. No. 15/089,758, filed Apr. 4, 2016, 9 pages.
Non-Final Office Action dated Oct. 5, 2016, issued in connection with U.S. Appl. No. 13/864,250, filed Apr. 17, 2013, 10 pages.
Non-Final Office Action dated Oct. 5, 2016, issued in connection with U.S. Appl. No. 13/864,252, filed Apr. 17, 2013, 11 pages.
Non-Final Office Action dated Oct. 6, 2016, issued in connection with U.S. Appl. No. 15/088,678, filed Apr. 1, 2016, 9 pages.
Non-Final Office Action dated Oct. 7, 2016, issued in connection with U.S. Appl. No. 15/156,392, filed May 17, 2016, 8 pages.
Non-Final Office Action dated Mar. 8, 2016, issued in connection with U.S. Appl. No. 13/848,921, filed Mar. 22, 2013, 13 pages.
Non-Final Office Action dated Aug. 9, 2016, issued in connection with U.S. Appl. No. 13/871,795, filed Apr. 26, 2013, 31 pages.
Non-Final Office Action dated Mar. 10, 2011, issued in connection with U.S. Appl. No. 12/035,112, filed Feb. 21, 2008, 12 pages.
Non-Final Office Action dated May 10, 2016, issued in connection with U.S. Appl. No. 14/504,812, filed Oct. 2, 2014, 22 pages.
Non-Final Office Action dated Nov. 10, 2016, issued in connection with U.S. Appl. No. 15/243,355, filed Aug. 22, 2016, 11 pages.
Non-Final Office Action dated Dec. 12, 2016, issued in connection with U.S. Appl. No. 15/343,019, filed Nov. 3, 2016, 8 pages.
Non-Final Office Action dated Jun. 12, 2015, issued in connection with U.S. Appl. No. 13/848,932, filed Mar. 22, 2013, 16 pages.
Non-Final Office Action dated Mar. 12, 2015, issued in connection with U.S. Appl. No. 13/705,174, filed Dec. 5, 2012, 13 pages.
Non-Final Office Action dated Jan. 13, 2016, issued in connection with U.S. Appl. No. 14/184,528, filed Feb. 19, 2014, 14 pages.
Non-Final Office Action dated Mar. 13, 2015, issued in connection with U.S. Appl. No. 13/705,177, filed Dec. 5, 2012, 15 pages.
Non-Final Office Action dated Dec. 15, 2016, issued in connection with U.S. Appl. No. 13/458,558, filed Apr. 27, 2012, 12 pages.
*Sonos, Inc.* v. *D&M Holdings* (No. 14-1330-RGA), DI 206-1, Transcript of 101 Hearing (Nov. 28, 2016) (28 pages).
*Sonos, Inc.* v. *D&M Holdings* (No. 14-1330-RGA), DI 207, Public Joint Claim Construction Brief (Nov. 30, 2016) (88 pages).
*Sonos, Inc.* v. *D&M Holdings* (No. 14-1330-RGA), Markman Hearing Transcript (Dec. 14, 2016) (69 pages).
*Sonos, Inc.* v. *D&M Holdings* (No. 14-1330-RGA), DI 214, D&M Post-Markman Letter (Dec. 22, 2016) (13 pages).
*Sonos, Inc.* v. *D&M Holdings* (No. 14-1330-RGA), DI 215, Sonos Post-Markman Letter (Dec. 22, 2016) (15 pages).
*Sonos, Inc.* v. *D&M Holdings* (No. 14-1330-RGA), DI 219, Claim Construction Opinion (Jan. 12, 2017) (24 pages).
*Sonos, Inc.* v. *D&M Holdings* (No. 14-1330-RGA), DI 221, Claim Construction Order (Jan. 18 2017) (2 pages).
Universal Plug and Play ("UPnP") AV Architecture:1 for UPnP, Version 1.0, (Jun. 25, 2002) (D+M_0298151-72) (22 pages).
UPnP AV Architecture:0.83 (Jun. 12, 2002) (SONDM000115483-504) (22 pages).
RenderingControl:1 Service Template Version 1.01 for UPnP, Version 1.0, (Jun. 25, 2002) (SONDM000115187-249) (63 pages).
MediaServer:1 Device Template Version 1.01 for UPnP, Version 1.0 (Jun. 25, 2002) (12 pages).
Universal Plug and Play Device Architecture V. 1.0, (Jun. 8, 2000) (54 pages).
MediaRenderer:1 Device Template Version 1.01 for UPnP, Version 1.0 (Jun. 25, 2002) (12 pages).
AVTransport:1 Service Template Version 1.01 for UPnP, Version 1.0 (Jun. 25, 2002) (66 pages).
Connection Manager: 1 Service Template Version 1.01 for UPnP, Version 1.0 (Jun. 25, 2002) (25 pages).
ContentDirectory:1 Service Template Version 1.01 for UPnP, Version 1.0 (Jun. 25, 2002) (89 pages).
WANCommonInterfaceConfig:1 Service Template Version 1.01 for UPnP, Ver. 1.0 (Nov. 12, 2001) (D+M_0401820-43) (24 pages).
WANIPConnection:1 Service Template Version 1.01 for UPnP Ver. 1 .0 (Nov. 12, 2001) (D+M_0401844-917) (74 pages).
WANPPPConnection:1 Service Template Version 1.01 for UPnP, Version 1.0 (Nov. 12, 2001) (D+M_0401918-2006) (89 pages).
Intel Media Renderer Device Interface ("Intel Media Renderer") (Sep. 6, 2002) (62 pages).
Intel Designing a UPnP AV Media Renderer, v. 1.0 ("Intel Av Media Renderer") (May 20, 2003) (SONDM000115117-62) (46 pages).
Windows Media Connect Device Compatibility Specification (Apr. 12, 2004) (16 pages).
Universal Plug and Play Vendor's Implementation Guide (Jan. 5, 2000) (7 pages).
Intel SDK for UPnP Devices Programming Guide, Version 1.2.1, (Nov. 2002) (30 pages).
Linux SDK for UPnP Devices v. 1.2 (Sep. 6, 2002) (101 pages).
Designing a UPnP AV MediaServer, Nelson Kidd (2003) (SONDM000115062-116) (55 pages).
Simple Service Discovery Protocol/1.0 Operating without an Arbiter (Oct. 28, 1999) (24 pages).
General Event Notification Architecture Base: Client to Arbiter (Apr. 2000) (23 pages).
Microsoft, Universal Plug and Play (UPnP) Client Support ("Microsoft UPnP") (Aug. 2001) (D+M_0402007-24) (18 pages).
Home Networking with Universal Plug and Play, IEEE Communications Magazine, vol. 39 No. 12 (Dec. 2001) (D+56 M_0402025-40) (16 pages).
Universal Plug and Play in Windows XP, Tom Fout. Microsoft Corporation (Jul. 2001) (D+M_0402041-73) (33 pages).
Understanding Universal Plug and Play, Microsoft White Paper (Jun. 2000) (D+M_0402074-118) (45 pages).
Microsoft Window's XP Reviewer's Guide (Aug. 2001) (D+M_0402225-85) (61 pages).
Simple Network Time Protocol (SNTPI), RFC 1361 (Aug. 1992) (D+M_0397537-46) (10 pages).
Simple Network Time Protocol (SNTPII), RFC 1769 (Mar. 1995) (D+M_0397663-76) (14 pages).
Realtime Transport Protocol (RTP), RFC 3550 (Jul. 2003) (D+M_0398235-323) (89 pages).

(56) References Cited

OTHER PUBLICATIONS

Real Time Control Protocol (RTCP) and Realtime Transfer Protocol (RTP), RFC 1889 (Jan. 1996) (D+M_0397810-84) (75 pages).
Realtime Streaming Protocol (RTSP), RFC 2326 (Apr. 1998) (D+M_0397945-8036) (92 pages).
Network Time Protocol (NTP), RFC 1305 (Mar. 1992) (D+M_0397417-536) (120 pages).
UPnP Design by Example, A Software Developers Guide to Universal Plug and Play Michael Jeronimo and Jack Weast, Intel Press (D+M_0401307-818) (Apr. 2003) (511 pages).
*Sonos, Inc.* v. *D&M Holdings* (No. 14-1330-RGA), DI 226, Opinion Denying Inequitable Conduct Defenses, Feb. 6, 2017, 5 pages.
*Sonos, Inc.* v. *D&M Holdings* (No. 14-1330-RGA), DI 227, Order Denying Inequitable Conduct Defenses, Feb. 6, 2017, 1 page.
Final Office Action dated Mar. 3, 2015, issued in connection with U.S. Appl. No. 13/864,251, filed Apr. 7, 2013, 13 pages.
Final Office Action dated Mar. 4, 2015, issued in connection with U.S. Appl. No. 13/848,904, filed Mar. 22, 2013, 16 pages.
Final Office Action dated Mar. 5, 2015, issued in connection with U.S. Appl. No. 13/888,203, filed May 6, 2013, 13 pages.
Final Office Action dated Jan. 7, 2015, issued in connection with U.S. Appl. No. 13/848,932, filed Mar. 22, 2013, 14 pages.
Final Office Action dated Mar. 9, 2015, issued in connection with U.S. Appl. No. 14/516,867, filed Oct. 17, 2014, 14 pages.
Final Office Action dated Aug. 10, 2015, issued in connection with U.S. Appl. No. 14/290,493, filed May 29, 2014, 26 pages.
Final Office Action dated Aug. 11, 2015, issued in connection with U.S. Appl. No. 13/864,247, filed Apr. 17, 2013, 15 pages.
Final Office Action dated Feb. 11, 2015, issued in connection with U.S. Appl. No. 14/184,526, filed Feb. 19, 2014, 13 pages.
Final Office Action dated Feb. 11, 2015, issued in connection with U.S. Appl. No. 14/184,935, filed Feb. 20, 2014, 17 pages.
Final Office Action dated Feb. 12, 2015, issued in connection with U.S. Appl. No. 14/184,522, filed Feb. 19, 2014, 20 pages.
Final Office Action dated Dec. 13, 2016, issued in connection with U.S. Appl. No. 14/629,937, filed Feb. 24, 2015, 14 pages.
Final Office Action dated Oct. 13, 2011, issued in connection with U.S. Appl. No. 12/035,112, filed Feb. 21, 2008, 10 pages.
Final Office Action dated Jul. 15, 2015, issued in connection with U.S. Appl. No. 14/504,812, filed Oct. 2, 2014, 18 pages.
Final Office Action dated Jun. 15, 2015, issued in connection with U.S. Appl. No. 14/184,522, filed Feb. 19, 2014, 25 pages.
Final Office Action dated Dec. 17, 2014, issued in connection with U.S. Appl. No. 13/533,105, filed Jun. 26, 2012, 36 pages.
Final Office Action dated Oct. 19, 2016, issued in connection with U.S. Appl. No. 13/848,921, filed Mar. 22, 2013, 14 pages.
Final Office Action dated Jan. 21, 2010, issued in connection with U.S. Appl. No. 11/906,702, filed Oct. 2, 2007, 27 pages.
Final Office Action dated Oct. 22, 2014, issued in connection with U.S. Appl. No. 14/186,850, filed Feb. 21, 2014, 12 pages.
Final Office Action dated Oct. 23, 2014, issued in connection with U.S. Appl. No. 13/705,176, filed Dec. 5, 2012, 23 pages.
Final Office Action dated Feb. 24, 2016, issued in connection with U.S. Appl. No. 13/871,795, filed Apr. 26, 2013, 28 pages.
Final Office Action dated May 25, 2016, issued in connection with U.S. Appl. No. 14/290,493, filed May 29, 2014, 33 pages.
Final Office Action dated Apr. 28, 2015, issued in connection with U.S. Appl. No. 14/186,850, filed Feb. 21, 2014, 20 pages.
Final Office Action dated Nov. 30, 2015, issued in connection with U.S. Appl. No. 13/871,795, filed Apr. 26, 2013, 26 pages.
First Action Interview Office Action Summary dated Apr. 15, 2015, issued in connection with U.S. Appl. No. 14/505,027, filed Oct. 2, 2014, 6 pages.
Fulton et al., "The Network Audio System: Make Your Application Sing (As Well As Dance)!" The X Resource, 1994, 14 pages.
Hans et al., "Interacting with Audio Streams for Entertainment and Communication," Proceedings of the Eleventh ACM International Conference on Multimedia, ACM, 2003, 7 pages.
Horwitz, Jeremy, "Logic3 i-Station25," retrieved from the internet: http://www.ilounge.com/index.php/reviews/entry/logic3-i-station25/, last visited Dec. 17, 2013, 5 pages.
Huang C.M., et al., "A Synchronization Infrastructure for Multicast Multimedia at the Presentation Layer," IEEE Transactions on Consumer Electronics, 1997, pp. 370-380, vol. 43, No. 3.
International Bureau, International Preliminary Report on Patentability, dated Jan. 8, 2015, issued in connection with International Application No. PCT/US2013/046372, filed on Jun. 18, 2013, 6 pages.
International Bureau, International Preliminary Report on Patentability, dated Jan. 8, 2015, issued in connection with International Application No. PCT/US2013/046386, filed on Jun. 18, 2013, 8 pages.
International Bureau, International Preliminary Report on Patentability dated Jan. 30, 2014, issued in connection with International Application No. PCT/US2012/045894, filed on Jul. 9, 2012, 6 pages.
International Searching Authority, International Search Report dated Aug. 1, 2008, in connection with International Application No. PCT/US2004/023102, 5 pages.
International Searching Authority, International Search Report dated Aug. 26, 2013, issued in connection with International Application No. PCT/US2013/046372, filed on Jun. 18, 2013, 3 pages.
International Searching Authority, International Search Report dated Dec. 26, 2012, issued in connection with International Application No. PCT/US2012/045894, filed on Jul. 9, 2012, 3 pages.
International Searching Authority, International Search Report dated Sep. 30, 2013, issued in Connection with International Application No. PCT/US2013/046386, filed on Jun. 18, 2013, 3 pages.
International Searching Authority, Written Opinion dated Aug. 26, 2013, issued in connection with International Application No. PCT/US2013/046372, filed on Jun. 18, 2013, 4 pages.
International Searching Authority, Written Opinion dated Dec. 26, 2012, issued in connection with International Application No. PCT/US2012/045894, filed on Jul. 9, 2012, 4 pages.
International Searching Authority, Written Opinion dated Sep. 30, 2013, issued in connection with International Application No. PCT/US2013/046386, filed on Jun. 18, 2013, 6 pages.
Ishibashi et al., "A Group Synchronization Mechanism for Live Media in Multicast Communications," IEEE Global Telecommunications Conference, 1997, pp. 746-752, vol. 2.
Ishibashi et al., "A Group Synchronization Mechanism for Stored Media in Multicast Communications," IEEE Information Revolution and Communications, 1997, pp. 692-700, vol. 2.
Japanese Patent Office, Decision of Rejection dated Jul. 8, 2014, issued in connection with Japanese Patent Application No. 2012-178711, 3 pages.
Japanese Patent Office, Notice of Rejection, dated Feb. 3, 2015, issued in connection with Japanese Patent Application No. 2014-521648, 7 pages.
Japanese Patent Office, Notice of Rejection dated Sep. 15, 2015, issued in connection with Japanese Patent Application No. 2014-220704, 7 pages.
Japanese Patent Office, Office Action dated May 24, 2016, issued in connection with Japanese Patent Application No. 2014-220704, 7 pages.
Japanese Patent Office, Office Action dated Mar. 29, 2016, issued in connection with Japanese Patent Application No. JP2015-520288, 12 pages.
Japanese Patent Office, Office Action Summary dated Feb. 2, 2016, issued in connection with Japanese Patent Application No. 2015-520286, 6 pages.
Japanese Patent Office, Office Action Summary dated Nov. 19, 2013, issued in connection with Japanese Patent Application No. 2012-178711, 5 pages.
Levergood et al., "AudioFile: A Network-Transparent System for Distributed Audio Applications," Digital Equipment Corporation, 1993, 109 pages.
Maniactools, "Identify Duplicate Files by Sound," Sep. 28, 2010, http://www.maniactools.com/soft/music-duplicate-remover/identify-duplicate-files-by-sound.shtml.

(56) References Cited

OTHER PUBLICATIONS

Mills, David L, "Precision Synchronization of Computer Network Clocks," ACM SIGCOMM Computer Communication Review, 1994, pp. 28-43, vol. 24, No. 2.
European Patent Office, European Extended Search Report dated Feb. 16, 2018, issued in connection with EP Application No. 17198867.8, 9 pages.
Canadian Patent Office, Canadian Office Action dated Aug. 30, 2017, issued in connection with CA Application No. 2947275, 5 pages.
Final Office Action dated Apr. 13, 2017, issued in connection with U.S. Appl. No. 14/563,515, filed Dec. 8, 2014, 13 pages.
Final Office Action dated Jun. 26, 2017, issued in connection with U.S. Appl. No. 15/343,019, filed Nov. 3, 2016, 10 pages.
Fries et al. "The MP3 and Internet Audio Handbook: Your Guide to the Digital Music Revolution." 2000, 320 pages.
"Microsoft Windows XP File and Printer Share with Microsoft Windows" Microsoft Windows XP Technical Article, 2003, 65 pages.
"SMPTE Made Simple: A Time Code Tutor by Timeline," 1996, 46 pages.
Niederst, Jennifer "O'Reilly Web Design in a Nutshell," Second Edition, Sep. 2001, 678 pages.
Non-Final Office Action dated Feb. 24, 2017, issued in connection with U.S. Appl. No. 14/619,813, filed Feb. 11, 2015, 9 pages.
Notice of Allowance dated Jun. 1, 2017, issued in connection with U.S. Appl. No. 14/808,397, filed Jul. 24, 2015, 5 pages.
Notice of Allowance dated Jul. 14, 2017, issued in connection with U.S. Appl. No. 15/343,000, filed Nov. 3, 2016, 5 pages.
Notice of Allowance dated May 16, 2017, issued in connection with U.S. Appl. No. 15/228,685, filed Aug. 4, 2016, 10 pages.
Notice of Allowance dated May 24, 2017, issued in connection with U.S. Appl. No. 14/806,070, filed Jul. 22, 2015, 5 pages.
Notice of Allowance dated Jun. 27, 2017, issued in connection with U.S. Appl. No. 13/458,558, filed Apr. 27, 2012, 8 pages.
Notice of Allowance dated Apr. 7, 2017, issued in connection with U.S. Appl. No. 14/629,937, filed Feb. 24, 2015, 8 pages.
Notice of Allowance dated Aug. 9, 2017, issued in connection with U.S. Appl. No. 15/343,019, filed Nov. 3, 2016, 5 pages.
Notice of Incomplete Re-Exam Request dated May 25, 2017, issued in connection with U.S. Appl. No. 90/013,959, filed Apr. 1, 2016, 10 pages.
Notice of Intent to Issue Re-Examination Certificate dated Mar. 24, 2017, issued in connection with U.S. Appl. No. 90/013,859, filed Nov. 4, 2016, 10 pages.
Request for Ex Parte Reexamination submitted in U.S. Pat. No. 9,213,357 dated May 22, 2017, 85 pages.
Rothermel et al., "Clock Hierarchies—An Abstraction for Grouping and Controlling Media Streams," University of Stuttgart Institute of Parallel and Distributed High-Performance Systems, Jan. 1996, 23 pages.
Rothermel, Kurt, "State-of-the-Art and Future Research in Stream Synchronization," University of Stuttgart, 3 pages.
*Sonos, Inc.* v *D&M Holdings*, D&M Supp Opposition Brief including Exhibits, Mar. 17, 2017, 23 pages.
*Sonos, Inc.* v. *D&M Holdings*, Expert Report of Jay P. Kesan including Appendices A-P, Feb. 20, 2017, 776 pages.
*Sonos, Inc.* v. *D&M Holdings, Inc.* (No. 14-1330-RGA), Defendants' Final Invalidity Contentions (Jan. 18, 2017) (106 pages).
*Sonos, Inc.* v. *D&M Holdings* (No. 14-1330-RGA), DI 226, Opinion Denying Inequitable Conduct Defenses, Feb. 6, 2017, updated, 5 pages.
*Sonos, Inc.* v. *D&M Holdings* (No. 14-1330-RGA), DI 242, US District Judge Andrews 101 Opinion, Mar. 13, 2017, 16 pages.
*Sonos, Inc.* v. *D&M Holdings*, Sonos Supp Opening Markman Brief including Exhibits, Mar. 3, 2017, 17 pages.
*Sonos, Inc.* v. *D&M Holdings*, Sonos Supp Reply Markman Brief including Exhibits, Mar. 29, 2017, 36 pages.
"Symantec pcAnywhere User's Guide," v 10.5.1, 1995-2002, 154 pages.
Non-Final Office Action dated Jan. 24, 2019, issued in connection with U.S. Appl. No. 16/113,078, filed Aug. 27, 2018, 10 pages.
Notice of Allowance dated Dec. 11, 2018, issued in connection with U.S. Appl. No. 15/909,327, filed Mar. 1, 2018, 10 pages.
Notice of Allowance dated Apr. 5, 2018, issued in connection with U.S. Appl. No. 15/670,769, filed Aug. 7, 2017, 12 pages.

* cited by examiner

AUDIO PROCESSING ADJUSTMENTS FOR PLAYBACK DEVICES BASED ON DETERMINED CHARACTERISTICS OF AUDIO CONTENT

CROSS REFERENCE TO RELATED APPLICATIONS

This application claims priority under 35 U.S.C. § 120 to and is a continuation of U.S. Non-provisional patent application Ser. No. 13/630,565, filed on Sep. 28, 2012, entitled "Crossover Frequency Adjustments for Audio Speakers," which is assigned to the assignee of the present application and is incorporated herein by reference.

FIELD OF THE DISCLOSURE

The disclosure is related to consumer goods and, more particularly, to systems, products, features, services, and other items directed to media playback or some aspect thereof.

BACKGROUND

Technological advancements have increased the accessibility of music content, as well as other types of media, such as television content, movies, and interactive content. For example, a user can access audio, video, or both audio and video content over the Internet through an online store, an Internet radio station, a music service, a movie service, and so on, in addition to the more traditional avenues of accessing audio and video content. As access to audio, video, and both audio and video content inside and outside of the home increases, improved means for enjoying the available content continues to be beneficial.

BRIEF DESCRIPTION OF THE DRAWINGS

Features, aspects, and advantages of the presently disclosed technology are better understood with regard to the following description, appended claims, and accompanying drawings where:

Figure 1:
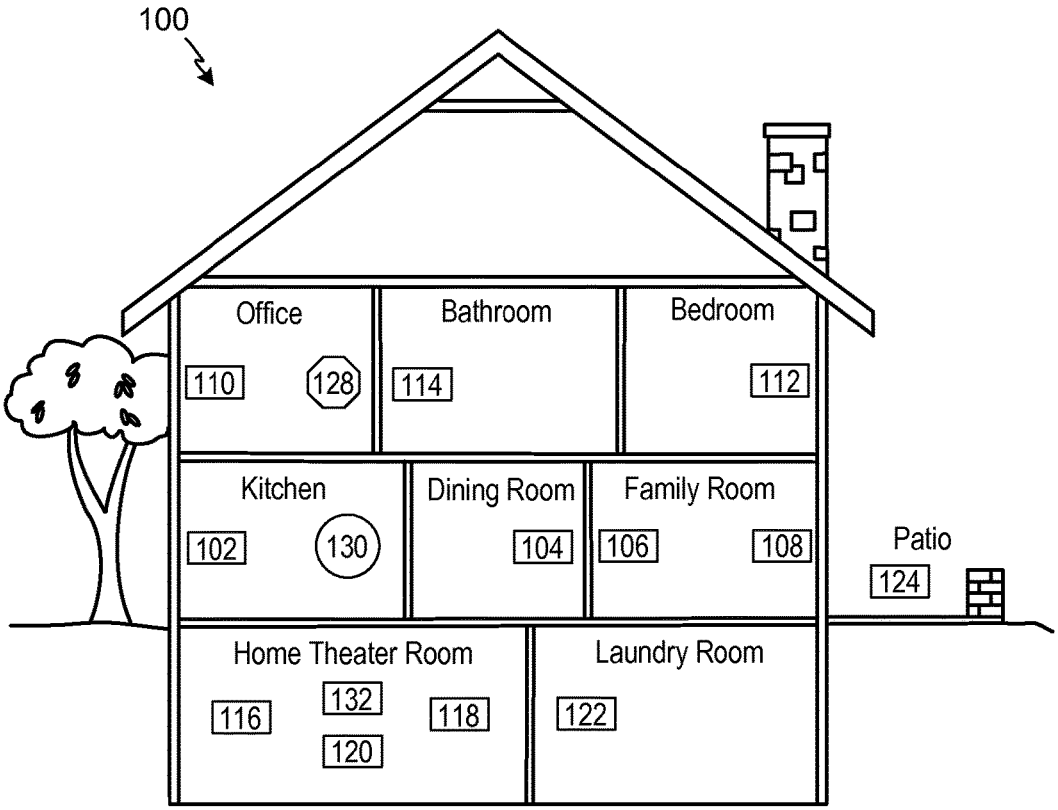
FIG. 1 shows an example configuration in which certain embodiments may be practiced.

In addition, the drawings are for the purpose of illustrating example embodiments, but it is understood that the inventions are not limited to the arrangements and instrumentality shown in the drawings.

DETAILED DESCRIPTION

I. Overview

Listening to audio content out loud can be a social activity that involves family, friends, or both. Audio content may include, for instance, music, talk radio, books, audio from television, and other audible material. For example, in a household, people may play music out loud at parties and other social gatherings. In such an environment, people may wish to play the music in one listening zone or multiple listening zones simultaneously, such that the music in each listening zone may be synchronized, without audible echoes or glitches. Listening to audio content out loud can also be an individual experience. For example, an individual may play music out loud for themselves in the morning before work, in the evening during dinner, or at other times throughout the day at home, work, or on the road. For these individual experiences, the individual may choose to either use headphones or limit the out loud playback of audio content to a single zone or area.

In one example, an audio system may include one or more audio players, often referred to herein as zone players or playback devices or players, and controllers, which may also be a player in some instances. A controller may be used to control the playback system, and can include capabilities for, among other things, browsing and selecting audio content for playback, viewing and editing audio content in one or more playback queues, or grouping and ungrouping zone players into one or more listening zones, etc. According to an embodiment, the playback system may operate as a distributed system such that each controller has full control over the entire playback system, and each player has the ability to play audio content from the either a same audio source or a different audio source as another player.

In one example, different zone players and/or audio speakers in the audio system may be configured to render different frequency sub-ranges of the audio content selected for playback. The different frequency sub-ranges may be substantially separated by one or more crossover frequencies. In one case, the crossover frequencies between the different frequency sub-ranges may be determined according to playback characteristics of respective zone players and/or audio speakers within the audio system. Accordingly, the playback of the audio system may be improved by having each zone player and/or audio speaker render frequency sub-ranges most suitable for rendering by the respective zone player and/or audio speaker.

In some cases, however, the playback characteristics of the respective zone players and/or audio speakers may vary according to the playback volume of the zone players and/or audio speakers. In other words, a particular zone player and/or audio speaker capable of clearly rendering a particular frequency sub-range at a first volume, may not be capable of rendering the particular frequency sub-range as clearly at a second volume. Accordingly, embodiments are provided for adjusting frequency sub-ranges and their associated crossover frequencies according to changes in the playback volume of the audio system. In some embodiments, the crossover frequencies may also be adjusted according to changes in playback equalization of the audio system.

In one aspect, a method is provided. The method involves causing a first subset of a plurality of audio speakers to render a first sub-range of a range of audio frequencies of an audio content, and a second subset of speakers of the plurality of audio speakers to render a second sub-range of the range of audio frequencies. The first sub-range and the second sub-range are substantially separated at a first crossover frequency. The method may further involve detecting a playback volume adjustment of the audio content rendered by the plurality of speakers, and causing an adjustment of the first crossover frequency substantially separating the first sub-range and second sub-range based on the adjusted playback volume.

In another aspect, a system is provided. The system includes at least one processor, a non-transitory computer readable medium, and program instructions stored on the non-transitory computer readable medium. The program instructions are executable by the at least one processor to perform functions including causing a first subset of a plurality of audio speakers to render a first sub-range of a range of audio frequencies of an audio content, and a second subset of speakers of the plurality of audio speakers to render a second sub-range of the range of audio frequencies. The first sub-range and the second sub-range are substantially separated at a first crossover frequency. The functions may further involve detecting a playback volume adjustment of the audio content rendered by the plurality of speakers, and causing an adjustment of the first crossover frequency substantially separating the first sub-range and second sub-range based on the adjusted playback volume.

In yet another aspect, a non-transitory computer readable medium having instructions stored thereon is provided. The instructions are executable by a computing device to cause the computing device to perform functions including causing a first subset of a plurality of audio speakers to render a first sub-range of a range of audio frequencies of an audio content, and a second subset of speakers of the plurality of audio speakers to render a second sub-range of the range of audio frequencies. The first sub-range and the second sub-range are substantially separated at a first crossover frequency. The functions may further involve detecting a playback volume adjustment of the audio content rendered by the plurality of speakers, and causing an adjustment of the first crossover frequency substantially separating the first sub-range and second sub-range based on the adjusted playback volume.

II. Example Operating Environment

Referring now to the drawings, in which like numerals can refer to like parts throughout the figures, FIG. 1 shows an example system configuration 100 in which one or more embodiments disclosed herein can be practiced or implemented.

By way of illustration, the system configuration 100 represents a home with multiple zones, though the home could have been configured with only one zone. Each zone, for example, may represent a different room or space, such as an office, bathroom, bedroom, kitchen, dining room, family room, home theater room, utility or laundry room, and patio. A single zone might also include multiple rooms or spaces if so configured. One or more of zone players 102-124 are shown in each respective zone. A zone player 102-124, also referred to as a playback device, multimedia unit, speaker, player, and so on, provides audio, video, and/or audiovisual output. A controller 130 (e.g., shown in the kitchen for purposes of illustration) provides control to the system configuration 100. Controller 130 may be fixed to a zone, or alternatively, mobile such that it can be moved about the zones. The system configuration 100 may also include more than one controller 130. The system configuration 100 illustrates an example whole house audio system, though it is understood that the technology described herein is not limited to its particular place of application or to an expansive system like a whole house audio system 100 of FIG. 1.

a. Example Zone Players

Figure 2A:
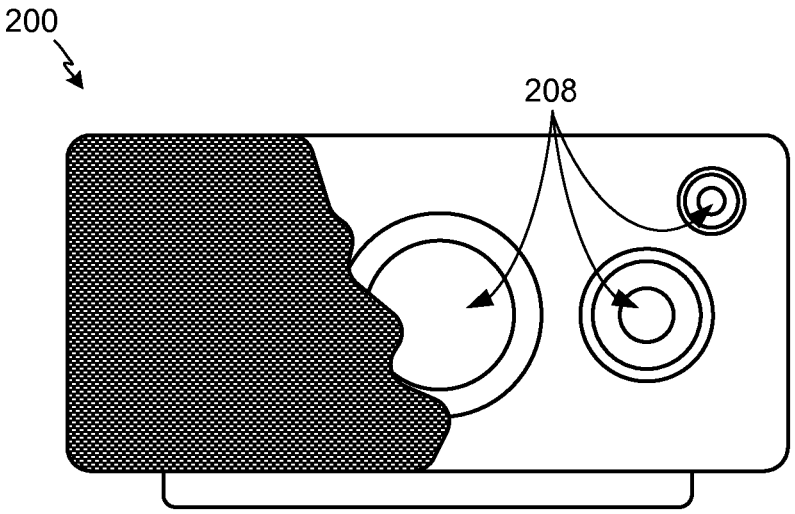
FIG. 2A shows an illustration of an example zone player having a built-in amplifier and transducers.
Figure 2B:
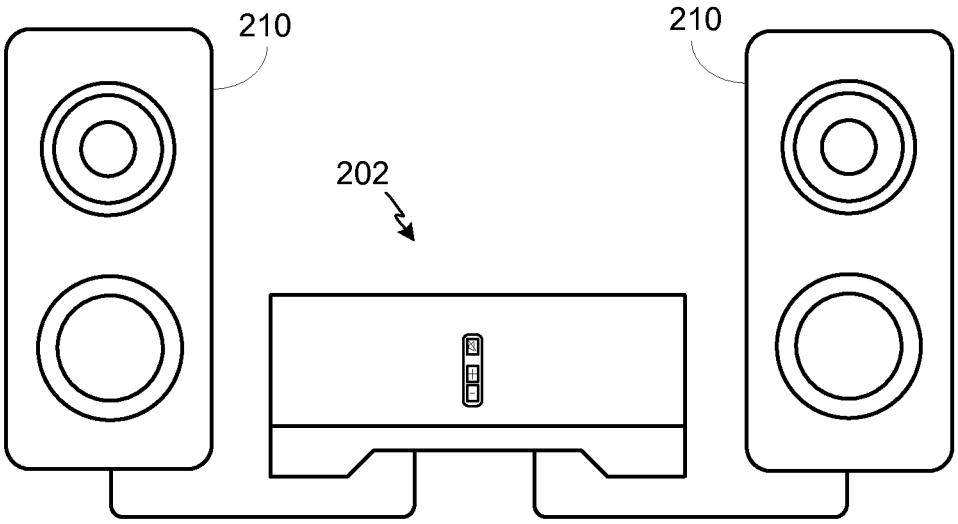
FIG. 2B shows an illustration of an example zone player having a built-in amplifier and connected to external speakers.
Figure 2C:
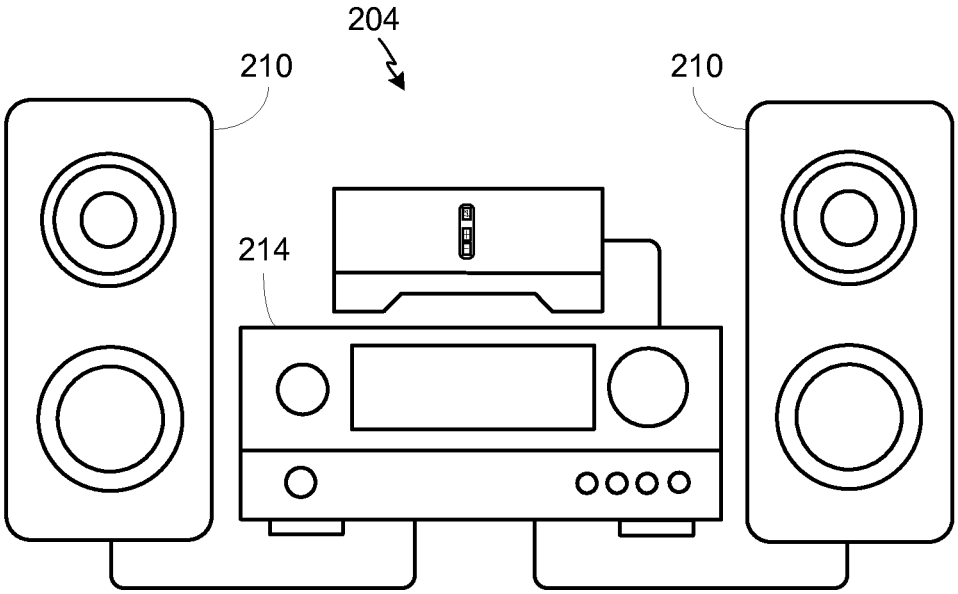
FIG. 2C shows an illustration of an example zone player connected to an A/V receiver and speakers.

FIGS. 2A, 2B, and 2C show example types of zone players. Zone players 200, 202, and 204 of FIGS. 2A, 2B, and 2C, respectively, can correspond to any of the zone players 102-124 of FIG. 1, for example. In some embodiments, audio is reproduced using only a single zone player, such as by a full-range player. In some embodiments, audio is reproduced using two or more zone players, such as by using a combination of full-range players or a combination of full-range and specialized players. In some embodiments, zone players 200-204 may also be referred to as a "smart speaker," because they contain processing capabilities beyond the reproduction of audio, more of which is described below.

FIG. 2A illustrates zone player 200 that includes sound producing equipment 208 capable of reproducing full-range sound. The sound may come from an audio signal that is received and processed by zone player 200 over a wired or wireless data network. Sound producing equipment 208 includes one or more built-in amplifiers and one or more acoustic transducers (e.g., speakers). A built-in amplifier is described more below with respect to FIG. 4. A speaker or acoustic transducer can include, for example, any of a tweeter, a mid-range driver, a low-range driver, and a subwoofer. In some embodiments, zone player 200 can be statically or dynamically configured to play stereophonic audio, monaural audio, or both. In some embodiments, zone player 200 is configured to reproduce a subset of full-range sound, such as when zone player 200 is grouped with other zone players to play stereophonic audio, monaural audio, and/or surround audio or when the audio content received by zone player 200 is less than full-range.

FIG. 2B illustrates zone player 202 that includes a built-in amplifier to power a set of detached speakers 210. A detached speaker can include, for example, any type of loudspeaker. Zone player 202 may be configured to power one, two, or more separate loudspeakers. Zone player 202 may be configured to communicate an audio signal (e.g., right and left channel audio or more channels depending on its configuration) to the detached speakers 210 via a wired path.

FIG. 2C illustrates zone player 204 that does not include a built-in amplifier, but is configured to communicate an audio signal, received over a data network, to an audio (or "audio/video") receiver 214 with built-in amplification.

Referring back to FIG. 1, in some embodiments, one, some, or all of the zone players 102 to 124 can retrieve audio directly from a source. For example, a zone player may contain a playlist or queue of audio items to be played (also referred to herein as a "playback queue"). Each item in the queue may comprise a uniform resource identifier (URI) or some other identifier. The URI or identifier can point the zone player to the audio source. The source might be found on the Internet (e.g., the cloud), locally from another device over data network 128 (described further below), from the controller 130, stored on the zone player itself, or from an audio source communicating directly to the zone player. In some embodiments, the zone player can reproduce the audio itself, send it to another zone player for reproduction, or both where the audio is played by the zone player and one or more additional zone players in synchrony. In some embodiments, the zone player can play a first audio content (or not play at all), while sending a second, different audio content to another zone player(s) for reproduction.

By way of illustration, SONOS, Inc. of Santa Barbara, Calif. presently offers for sale zone players referred to as a "PLAY:5," "PLAY:3," "CONNECT:AMP," "CONNECT," and "SUB." Any other past, present, and/or future zone players can additionally or alternatively be used to implement the zone players of example embodiments disclosed herein. Additionally, it is understood that a zone player is not limited to the particular examples illustrated in FIGS. 2A, 2B, and 2C or to the SONOS product offerings. For example, a zone player may include a wired or wireless headphone. In yet another example, a zone player might include a sound bar for television. In yet another example, a zone player can include or interact with a docking station for an Apple IPOD™ or similar device.

b. Example Controllers

Figure 3:
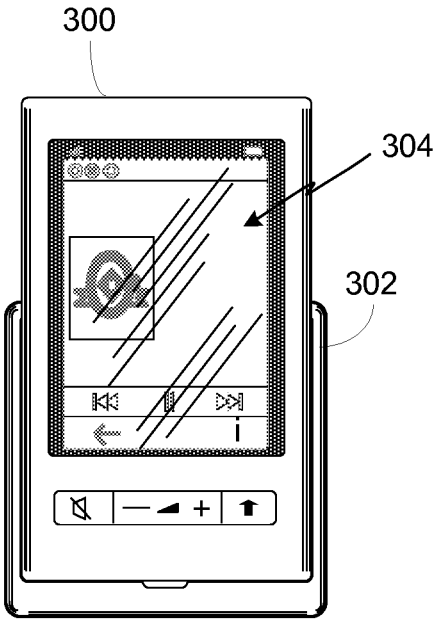
FIG. 3 shows an illustration of an example controller.

FIG. 3 illustrates an example wireless controller 300 in docking station 302. By way of illustration, controller 300 can correspond to controlling device 130 of FIG. 1. Docking station 302, if provided, may be used to charge a battery of controller 300. In some embodiments, controller 300 is provided with a touch screen 304 that allows a user to interact through touch with the controller 300, for example, to retrieve and navigate a playlist of audio items, control operations of one or more zone players, and provide overall control of the system configuration 100. In certain embodiments, any number of controllers can be used to control the system configuration 100. In some embodiments, there can be a limit set on the number of controllers that can control the system configuration 100. The controllers might be wireless like wireless controller 300 or wired to data network 128.

In some embodiments, if more than one controller is used in system 100, then each controller may be coordinated to display common content, and may all be dynamically updated to indicate changes made from a single controller. Coordination can occur, for instance, by a controller periodically requesting a state variable directly or indirectly from one or more zone players; the state variable may provide information about system 100, such as current zone group configuration, what is playing in one or more zones, playback volumes, and other items of interest. The state variable may be passed around on data network 128 between zone players (and controllers, if so desired) as needed or as often as programmed.

In addition, an application running on any network-enabled portable device, such as an IPHONE™, IPAD™, ANDROID™ powered phone, or any other smart phone or network-enabled device can be used as controller 130. An application running on a laptop or desktop personal computer (PC) or Mac™ can also be used as controller 130. Such controllers may connect to system 100 through an interface with data network 128, a zone player, a wireless router, or using some other configured connection path. Example controllers offered by Sonos, Inc. of Santa Barbara, Calif. include a "Controller 200," "SONOS® CONTROL," "SONOS® Controller for IPHONE™," "SONOS® Controller for IPAD™," "SONOS® Controller for ANDROID™," "SONOS® Controller for MAC™ or PC."

c. Example Data Connection

Zone players 102 to 124 of FIG. 1 are coupled directly or indirectly to a data network, such as data network 128. Controller 130 may also be coupled directly or indirectly to data network 128 or individual zone players. Data network 128 is represented by an octagon in the figure to stand out from other representative components. While data network 128 is shown in a single location, it is understood that such a network is distributed in and around system 100. Particularly, data network 128 can be a wired network, a wireless network, or a combination of both wired and wireless networks. In some embodiments, one or more of the zone players 102-124 are wirelessly coupled to data network 128 based on a proprietary mesh network. In some embodiments, one or more of the zone players 102-124 are wirelessly coupled to data network 128 using a non-mesh topology. In some embodiments, one or more of the zone players 102-124 are coupled via a wire to data network 128 using Ethernet or similar technology. In addition to the one or more zone players 102-124 connecting to data network 128, data network 128 can further allow access to a wide area network, such as the Internet.

In some embodiments, connecting any of the zone players 102-124, or some other connecting device, to a broadband router, can create data network 128. Other zone players 102-124 can then be added wired or wirelessly to the data network 128. For example, a zone player (e.g., any of zone players 102-124) can be added to the system configuration 100 by simply pressing a button on the zone player itself (or perform some other action), which enables a connection to be made to data network 128. The broadband router can be connected to an Internet Service Provider (ISP), for example. The broadband router can be used to form another data network within the system configuration 100, which can be used in other applications (e.g., web surfing). Data network 128 can also be used in other applications, if so programmed. An example, second network may implement SONOSNET™ protocol, developed by SONOS, Inc. of Santa Barbara. SONOSNET™ represents a secure, AES-encrypted, peer-to-peer wireless mesh network. Alternatively, in certain embodiments, the data network 128 is the same network, such as a traditional wired or wireless network, used for other applications in the household.

d. Example Zone Configurations

A particular zone can contain one or more zone players. For example, the family room of FIG. 1 contains two zone players 106 and 108, while the kitchen is shown with one zone player 102. In another example, the home theater room contains additional zone players to play audio from a 5.1 channel or greater audio source (e.g., a movie encoded with 5.1 or greater audio channels). In some embodiments, one can position a zone player in a room or space and assign the zone player to a new or existing zone via controller 130. As such, zones may be created, combined with another zone, removed, and given a specific name (e.g., "Kitchen"), if so desired and programmed to do so with controller 130. Moreover, in some embodiments, zone configurations may be dynamically changed even after being configured using controller 130 or some other mechanism.

In some embodiments, if a zone contains two or more zone players, such as the two zone players 106 and 108 in the family room, then the two zone players 106 and 108 can be configured to play the same audio source in synchrony, or the two zone players 106 and 108 can be paired to play two separate sounds in left and right channels, for example. In other words, the stereo effects of a sound can be reproduced or enhanced through the two zone players 106 and 108, one for the left sound and the other for the right sound. In certain embodiments, paired zone players (also referred to as "bonded zone players") can play audio in synchrony with other zone players in the same or different zones.

In some embodiments, two or more zone players can be sonically consolidated to form a single, consolidated zone player. A consolidated zone player (though made up of multiple, separate devices) can be configured to process and reproduce sound differently than an unconsolidated zone player or zone players that are paired, because a consolidated zone player will have additional speaker drivers from which sound can be passed. The consolidated zone player can further be paired with a single zone player or yet another consolidated zone player. Each playback device of a consolidated playback device can be set in a consolidated mode, for example.

According to some embodiments, one can continue to do any of: group, consolidate, and pair zone players, for example, until a desired configuration is complete. The actions of grouping, consolidation, and pairing are preferably performed through a control interface, such as using controller 130, and not by physically connecting and reconnecting speaker wire, for example, to individual, discrete speakers to create different configurations. As such, certain embodiments described herein provide a more flexible and dynamic platform through which sound reproduction can be offered to the end-user.

e. Example Audio Sources

In some embodiments, each zone can play from the same audio source as another zone or each zone can play from a different audio source. For example, someone can be grilling on the patio and listening to jazz music via zone player 124, while someone is preparing food in the kitchen and listening to classical music via zone player 102. Further, someone can be in the office listening to the same jazz music via zone player 110 that is playing on the patio via zone player 124. In some embodiments, the jazz music played via zone players 110 and 124 is played in synchrony. Synchronizing playback amongst zones allows for someone to pass through zones while seamlessly (or substantially seamlessly) listening to the audio. Further, zones can be put into a "party mode" such that all associated zones will play audio in synchrony.

Sources of audio content to be played by zone players 102-124 are numerous. In some embodiments, music on a zone player itself may be accessed and a played. In some embodiments, music from a personal library stored on a computer or networked-attached storage (NAS) may be accessed via the data network 128 and played. In some embodiments, Internet radio stations, shows, and podcasts can be accessed via the data network 128. Music or cloud services that let a user stream and/or download music and audio content can be accessed via the data network 128. Further, music can be obtained from traditional sources, such as a turntable or CD player, via a line-in connection to a zone player, for example. Audio content can also be accessed using a different protocol, such as AIRPLAY™, which is a wireless technology by Apple, Inc., for example. Audio content received from one or more sources can be shared amongst the zone players 102 to 124 via data network 128 and/or controller 130. The above-disclosed sources of audio content are referred to herein as network-based audio information sources. However, network-based audio information sources are not limited thereto.

In some embodiments, the example home theater zone players 116, 118, 120 are coupled to an audio information source such as a television 132. In some examples, the television 132 is used as a source of audio for the home theater zone players 116, 118, 120, while in other examples audio information from the television 132 can be shared with any of the zone players 102-124 in the audio system 100.

III. Example Zone Players

Figure 4:
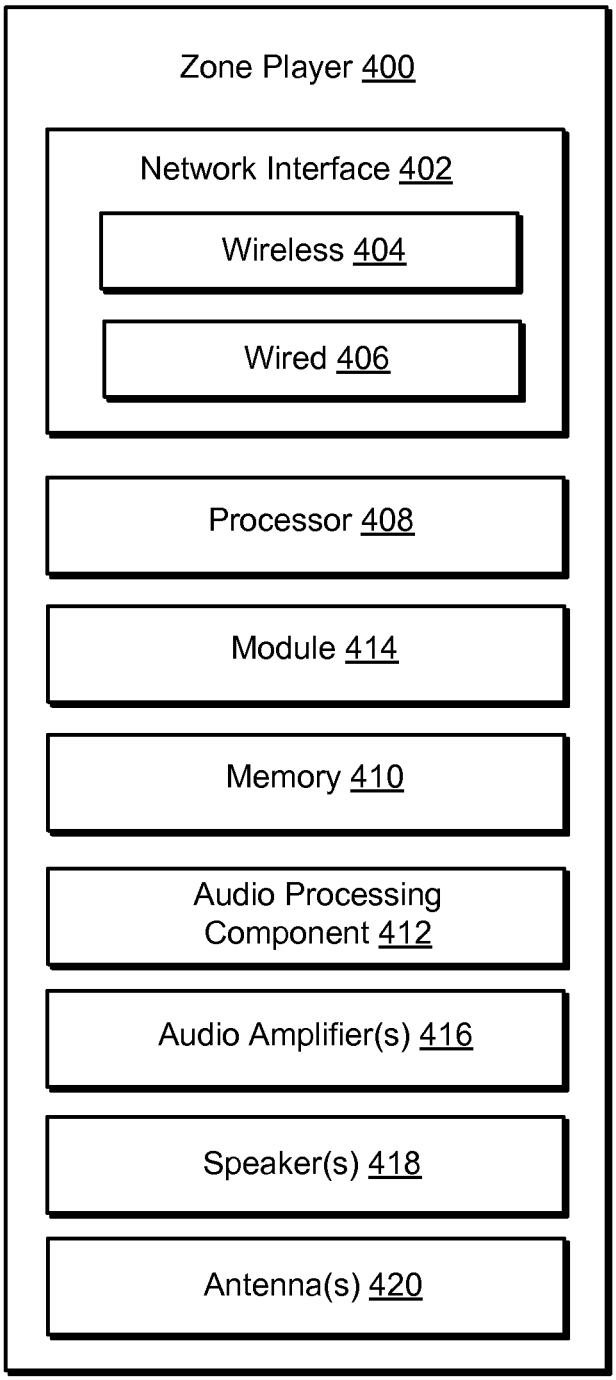
FIG. 4 shows an internal functional block diagram of an example zone player.

Referring now to FIG. 4, there is shown an example block diagram of a zone player 400 in accordance with an embodiment. Zone player 400 includes a network interface 402, a processor 408, a memory 410, an audio processing component 412, one or more modules 414, an audio amplifier 416, and a speaker unit 418 coupled to the audio amplifier 416. FIG. 2A shows an example illustration of such a zone player. Other types of zone players may not include the speaker unit 418 (e.g., such as shown in FIG. 2B) or the audio amplifier 416 (e.g., such as shown in FIG. 2C). Further, it is contemplated that the zone player 400 can be integrated into another component. For example, the zone player 400 could be constructed as part of a television, lighting, or some other device for indoor or outdoor use.

In some embodiments, network interface 402 facilitates a data flow between zone player 400 and other devices on a data network 128. In some embodiments, in addition to getting audio from another zone player or device on data network 128, zone player 400 may access audio directly from the audio source, such as over a wide area network or on the local network. In some embodiments, the network interface 402 can further handle the address part of each packet so that it gets to the right destination or intercepts packets destined for the zone player 400. Accordingly, in certain embodiments, each of the packets includes an Internet Protocol (IP)-based source address as well as an IP-based destination address.

In some embodiments, network interface 402 can include one or both of a wireless interface 404 and a wired interface 406. The wireless interface 404, also referred to as a radio frequency (RF) interface, provides network interface functions for the zone player 400 to wirelessly communicate with other devices (e.g., other zone player(s), speaker(s), receiver(s), component(s) associated with the data network 128, and so on) in accordance with a communication protocol (e.g., any wireless standard including IEEE 802.11a, 802.11b, 802.11g, 802.11n, or 802.15). Wireless interface 404 may include one or more radios. To receive wireless signals and to provide the wireless signals to the wireless interface 404 and to transmit wireless signals, the zone player 400 includes one or more antennas 420. The wired interface 406 provides network interface functions for the zone player 400 to communicate over a wire with other devices in accordance with a communication protocol (e.g., IEEE 802.3). In some embodiments, a zone player includes multiple wireless 404 interfaces. In some embodiments, a zone player includes multiple wired 406 interfaces. In some embodiments, a zone player includes both of the interfaces 404 and 406. In some embodiments, a zone player 400 includes only the wireless interface 404 or the wired interface 406.

In some embodiments, the processor 408 is a clock-driven electronic device that is configured to process input data according to instructions stored in memory 410. The memory 410 is data storage that can be loaded with one or more software module(s) 414, which can be executed by the processor 408 to achieve certain tasks. In the illustrated embodiment, the memory 410 is a tangible machine-readable medium storing instructions that can be executed by the processor 408. In some embodiments, a task might be for the zone player 400 to retrieve audio data from another zone player or a device on a network (e.g., using a uniform resource locator (URL) or some other identifier). In some embodiments, a task may be for the zone player 400 to send audio data to another zone player or device on a network. In some embodiments, a task may be for the zone player 400 to synchronize playback of audio with one or more additional zone players. In some embodiments, a task may be to pair the zone player 400 with one or more zone players to create a multi-channel audio environment. Additional or alternative tasks can be achieved via the one or more software module(s) 414 and the processor 408.

The audio processing component 412 can include one or more digital-to-analog converters (DAC), an audio preprocessing component, an audio enhancement component or a digital signal processor, and so on. In some embodiments, the audio processing component 412 may be part of processor 408. In some embodiments, the audio that is retrieved via the network interface 402 is processed and/or intentionally altered by the audio processing component 412. Further, the audio processing component 412 can produce analog audio signals. The processed analog audio signals are then provided to the audio amplifier 416 for play back through speakers 418. In addition, the audio processing component 412 can include circuitry to process analog or digital signals as inputs to play from zone player 400, send to another zone player on a network, or both play and send to another zone player on the network. An example input includes a line-in connection (e.g., an auto-detecting 3.5 mm audio line-in connection).

The audio amplifier 416 is a device(s) that amplifies audio signals to a level for driving one or more speakers 418. The one or more speakers 418 can include an individual transducer (e.g., a "driver") or a complete speaker system that includes an enclosure including one or more drivers. A particular driver can be a subwoofer (e.g., for low frequencies), a mid-range driver (e.g., for middle frequencies), and a tweeter (e.g., for high frequencies), for example. An enclosure can be sealed or ported, for example. Each transducer may be driven by its own individual amplifier.

A commercial example, presently known as the PLAY:5™, is a zone player with a built-in amplifier and speakers that is capable of retrieving audio directly from the source, such as on the Internet or on the local network, for example. In particular, the PLAY:5™ is a five-amp, five-driver speaker system that includes two tweeters, two mid-range drivers, and one woofer. When playing audio content via the PLAY:5, the left audio data of a track is sent out of the left tweeter and left mid-range driver, the right audio data of a track is sent out of the right tweeter and the right mid-range driver, and mono bass is sent out of the subwoofer. Further, both mid-range drivers and both tweeters have the same equalization (or substantially the same equalization). That is, they are both sent the same frequencies but from different channels of audio. Audio from Internet radio stations, online music and video services, downloaded music, analog audio inputs, television, DVD, and so on, can be played from the PLAY:5™.

IV. Example Controller

Figure 5:
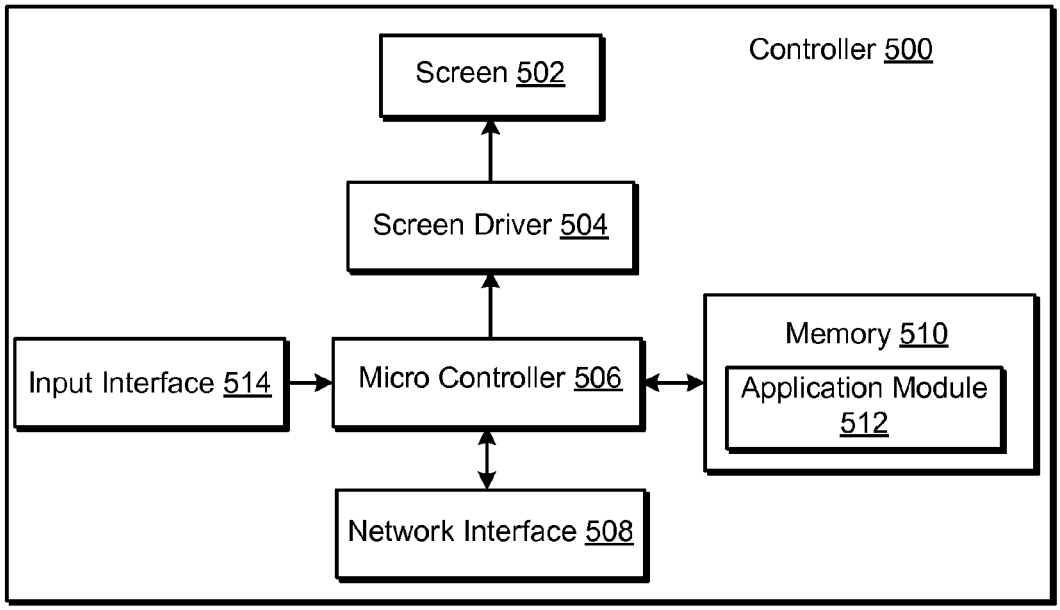
FIG. 5 shows an internal functional block diagram of an example controller.

Referring now to FIG. 5, there is shown an example block diagram for controller 500, which can correspond to the controlling device 130 in FIG. 1. Controller 500 can be used to facilitate the control of multi-media applications, automation and others in a system. In particular, the controller 500 may be configured to facilitate a selection of a plurality of audio sources available on the network and enable control of one or more zone players (e.g., the zone players 102-124 in FIG. 1) through a wireless or wired network interface 508. According to one embodiment, the wireless communications is based on an industry standard (e.g., infrared, radio, wireless standards including IEEE 802.11a, 802.11b, 802.11g, 802.11n, 802.15, and so on). Further, when a particular audio is being accessed via the controller 500 or being played via a zone player, a picture (e.g., album art) or any other data, associated with the audio and/or audio source can be transmitted from a zone player or other electronic device to controller 500 for display.

Controller 500 is provided with a screen 502 and an input interface 514 that allows a user to interact with the controller 500, for example, to navigate a playlist of many multimedia items and to control operations of one or more zone players. The screen 502 on the controller 500 can be an LCD screen, for example. The screen 500 communicates with and is commanded by a screen driver 504 that is controlled by a microcontroller (e.g., a processor) 506. The memory 510 can be loaded with one or more application modules 512 that can be executed by the microcontroller 506 with or without a user input via the user interface 514 to achieve certain tasks. In some embodiments, an application module 512 is configured to facilitate grouping a number of selected zone players into a zone group and synchronizing the zone players for audio play back. In some embodiments, an application module 512 is configured to control the audio sounds (e.g., volume) of the zone players in a zone group. In operation, when the microcontroller 506 executes one or more of the application modules 512, the screen driver 504 generates control signals to drive the screen 502 to display an application specific user interface accordingly.

The controller 500 includes a network interface 508 that facilitates wired or wireless communication with a zone player. In some embodiments, the commands such as volume control and audio playback synchronization are sent via the network interface 508. In some embodiments, a saved zone group configuration is transmitted between a zone player and a controller via the network interface 508. The controller 500 can control one or more zone players, such as 102-124 of FIG. 1. There can be more than one controller for a particular system, and each controller may share common information with another controller, or retrieve the common information from a zone player, if such a zone player stores configuration data (e.g., such as a state variable). Further, a controller can be integrated into a zone player.

It should be noted that other network-enabled devices such as an IPHONE®, IPAD® or any other smart phone or network-enabled device (e.g., a networked computer such as a PC or MAC®) can also be used as a controller to interact or control zone players in a particular environment. In some embodiments, a software application or upgrade can be downloaded onto a network-enabled device to perform the functions described herein.

In certain embodiments, a user can create a zone group (also referred to as a bonded zone) including at least two zone players from the controller 500. The zone players in the zone group can play audio in a synchronized fashion, such that all of the zone players in the zone group play back an identical audio source or a list of identical audio sources in a synchronized manner such that no (or substantially no) audible delays or hiccups are to be heard. Similarly, in some embodiments, when a user increases the audio volume of the group from the controller 500, the signals or data of increasing the audio volume for the group are sent to one of the zone players and causes other zone players in the group to be increased together in volume.

A user via the controller 500 can group zone players into a zone group by activating a "Link Zones" or "Add Zone" soft button, or de-grouping a zone group by activating an "Unlink Zones" or "Drop Zone" button. For example, one mechanism for 'joining' zone players together for audio play back is to link a number of zone players together to form a group. To link a number of zone players together, a user can manually link each zone player or room one after the other. For example, assume that there is a multi-zone system that includes the following zones: Bathroom, Bedroom, Den, Dining Room, Family Room, and Foyer.

In certain embodiments, a user can link any number of the six zone players, for example, by starting with a single zone and then manually linking each zone to that zone.

In certain embodiments, a set of zones can be dynamically linked together using a command to create a zone scene or theme (subsequent to first creating the zone scene). For instance, a "Morning" zone scene command can link the Bedroom, Office, and Kitchen zones together in one action. Without this single command, the user would manually and individually link each zone. The single command may include a mouse click, a double mouse click, a button press, a gesture, or some other programmed action. Other kinds of zone scenes can be programmed.

In certain embodiments, a zone scene can be triggered based on time (e.g., an alarm clock function). For instance, a zone scene can be set to apply at 8:00 am. The system can link appropriate zones automatically, set specific music to play, and then stop the music after a defined duration. Although any particular zone can be triggered to an "On" or "Off" state based on time, for example, a zone scene enables any zone(s) linked to the scene to play a predefined audio (e.g., a favorable song, a predefined playlist) at a specific time and/or for a specific duration. If, for any reason, the scheduled music failed to be played (e.g., an empty playlist, no connection to a share, failed Universal Plug and Play (UPnP), no Internet connection for an Internet Radio station, and so on), a backup buzzer can be programmed to sound. The buzzer can include a sound file that is stored in a zone player, for example.

V. Example Ad-Hoc Network

Figure 6:
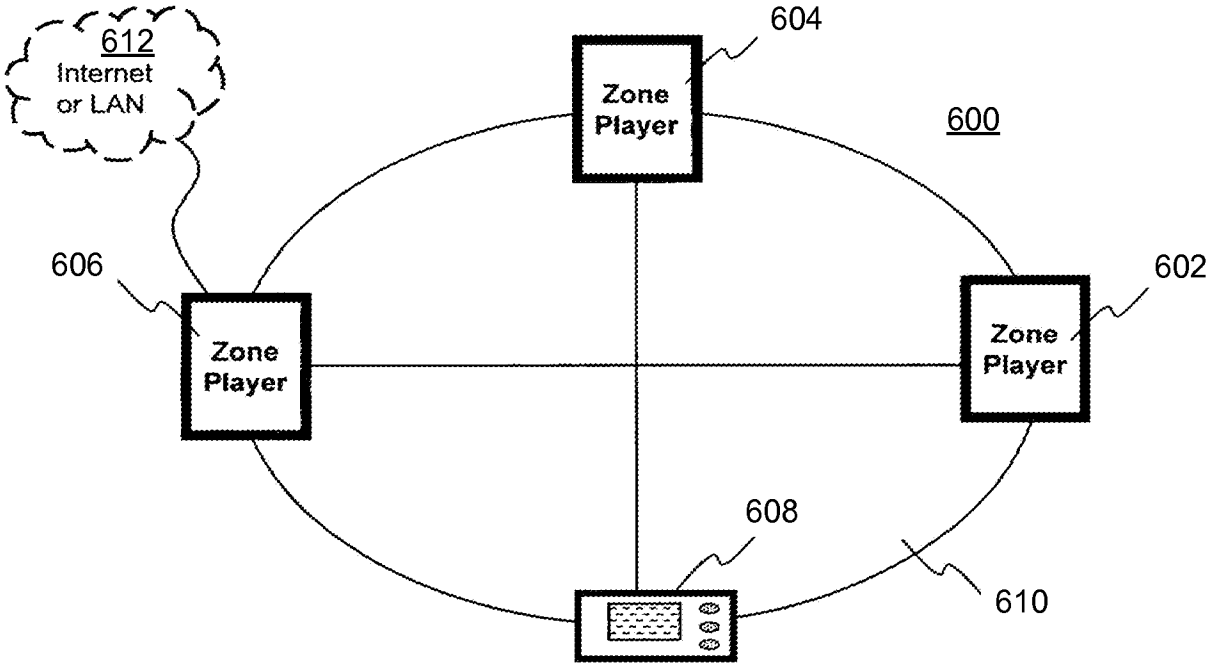
FIG. 6 shows an example ad-hoc playback network.

Certain particular examples are now provided in connection with FIG. 6 to describe, for purposes of illustration, certain systems and methods to provide and facilitate connection to a playback network. FIG. 6 shows that there are three zone players 602, 604 and 606 and a controller 608 that form a network branch that is also referred to as an Ad-Hoc network 610. The network 610 may be wireless, wired, or a combination of wired and wireless. In general, an Ad-Hoc (or "spontaneous") network is a local area network or other small network in which there is generally no one access point for all traffic. With an established Ad-Hoc network 610, the devices 602, 604, 606 and 608 can all communicate with each other in a "peer-to-peer" style of communication, for example. Furthermore, devices may join and/or leave from the network 610, and the network 610 will automatically reconfigure itself without needing the user to reconfigure the network 610. While an Ad-Hoc network is referenced in FIG. 6, it is understood that a playback network may be based on a type of network that is completely or partially different from an Ad-Hoc network.

Using the Ad-Hoc network 610, the devices 602, 604, 606, and 608 can share or exchange one or more audio sources and be dynamically grouped to play the same or different audio sources. For example, the devices 602 and 604 are grouped to playback one piece of music, and at the same time, the device 606 plays back another piece of music. In other words, the devices 602, 604, 606 and 608, as shown in FIG. 6, form a HOUSEHOLD that distributes audio and/or reproduces sound. As used herein, the term HOUSEHOLD (provided in uppercase letters to disambiguate from the user's domicile) is used to represent a collection of networked devices that are cooperating to provide an application or service. An instance of a HOUSEHOLD is identified with a household 610 (or household identifier), though a HOUSEHOLD may be identified with a different area or place.

In certain embodiments, a household identifier (HHID) is a short string or an identifier that is computer-generated to help ensure that it is unique. Accordingly, the network 610 can be characterized by a unique HHID and a unique set of configuration variables or parameters, such as channels (e.g., respective frequency bands), service set identifier (SSID) (a sequence of alphanumeric characters as a name of a wireless network), and WEP keys (wired equivalent privacy or other security keys). In certain embodiments, SSID is set to be the same as HHID.

In certain embodiments, each HOUSEHOLD includes two types of network nodes: a control point (CP) and a zone player (ZP). The control point controls an overall network setup process and sequencing, including an automatic generation of required network parameters (e.g., WEP keys). In an embodiment, the CP also provides the user with a HOUSEHOLD configuration user interface. The CP function can be provided by a computer running a CP application module, or by a handheld controller (e.g., the controller 308) also running a CP application module, for example. The zone player is any other device on the network that is placed to participate in the automatic configuration process. The ZP, as a notation used herein, includes the controller 308 or a computing device, for example. In some embodiments, the functionality, or certain parts of the functionality, in both the CP and the ZP are combined at a single node (e.g., a ZP contains a CP or vice-versa).

In certain embodiments, configuration of a HOUSEHOLD involves multiple CPs and ZPs that rendezvous and establish a known configuration such that they can use a standard networking protocol (e.g., IP over Wired or Wireless Ethernet) for communication. In an embodiment, two types of networks/protocols are employed: Ethernet 802.3 and Wireless 802.11g. Interconnections between a CP and a ZP can use either of the networks/protocols. A device in the system as a member of a HOUSEHOLD can connect to both networks simultaneously.

In an environment that has both networks in use, it is assumed that at least one device in a system is connected to both as a bridging device, thus providing bridging services between wired/wireless networks for others. The zone player 606 in FIG. 6 is shown to be connected to both networks, for example. The connectivity to the network 612 is based on Ethernet and/or Wireless, while the connectivity to other devices 602, 604 and 608 is based on Wireless and Ethernet if so desired.

It is understood, however, that in some embodiments each zone player 606, 604, 602 may access the Internet when retrieving media from the cloud (e.g., the Internet) via the bridging device. For example, zone player 602 may contain a uniform resource locator (URL) that specifies an address to a particular audio track in the cloud. Using the URL, the zone player 602 may retrieve the audio track from the cloud, and ultimately play the audio out of one or more zone players.

VI. Example System Configuration

Figure 7:
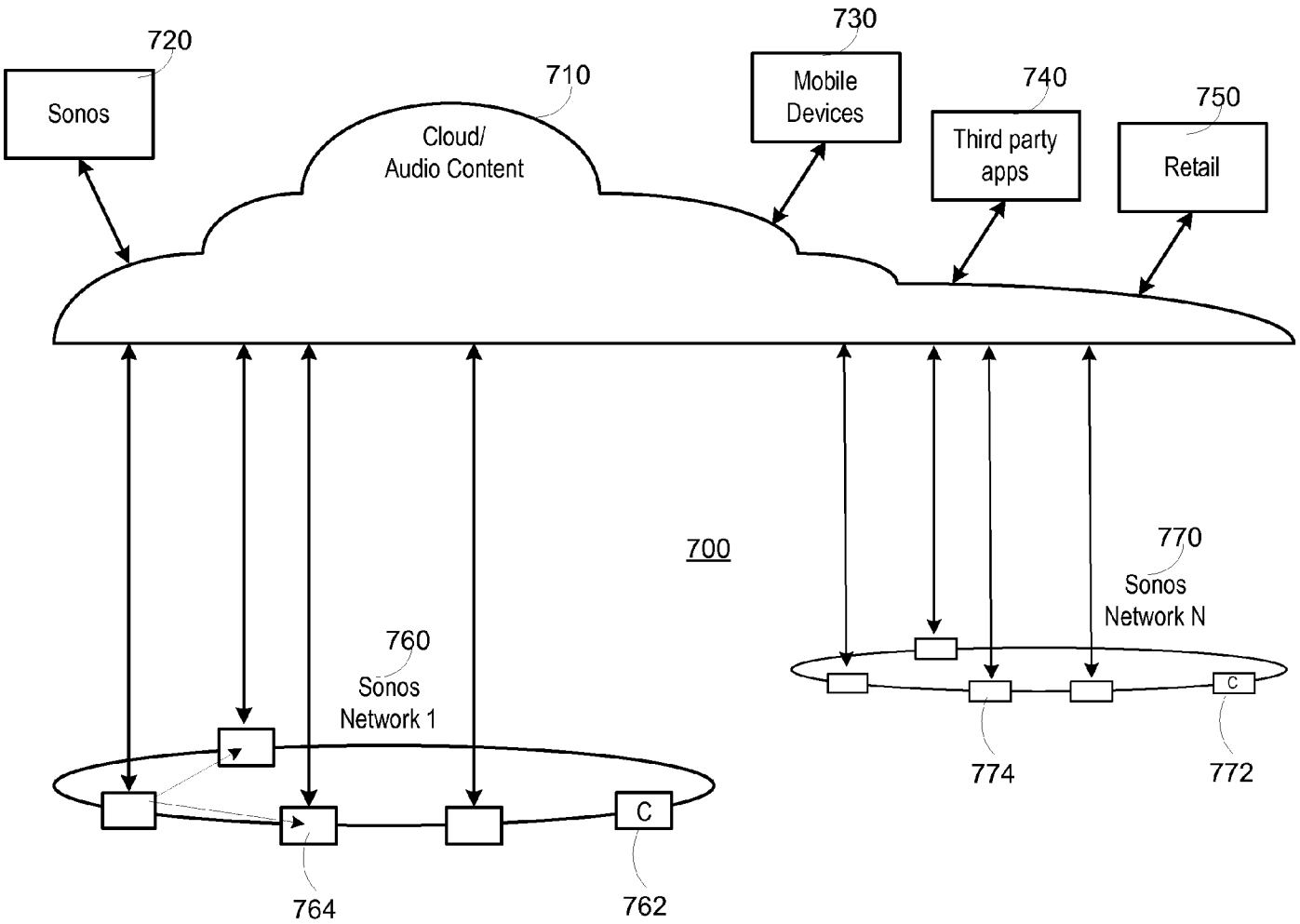
FIG. 7 shows a system including a plurality of networks including a cloud-based network and at least one local playback network.

FIG. 7 shows a system including a plurality of networks including a cloud-based network and at least one local playback network. A local playback network includes a plurality of playback devices or players, though it is understood that the playback network may contain only one playback device. In certain embodiments, each player has an ability to retrieve its content for playback. Control and content retrieval can be distributed or centralized, for example. Input can include streaming content provider input, third party application input, mobile device input, user input, and/or other playback network input into the cloud for local distribution and playback.

As illustrated by the example system 700 of FIG. 7, a plurality of content providers 720-750 can be connected to one or more local playback networks 760-770 via a cloud and/or other network 710. Using the cloud 710, a multimedia playback system 720 (e.g., Sonos™), a mobile device 730, a third party application 740, a content provider 750 and so on can provide multimedia content (requested or otherwise) to local playback networks 760, 770. Within each local playback network 760, 770, a controller 762, 772 and a playback device 764, 774 can be used to playback audio content.

VII. Example Methods for Crossover Frequency Adjustment

As discussed previously, different zone players in the audio system may be configured to render different frequency sub-ranges of an audio content, and the different frequency sub-ranges may be determined according to playback characteristics of respective zone players in the audio system. Playback characteristics of the respective zone players may be defined by elements such as sizes of one or more audio speakers in a zone player, driver designs for the one or more audio speakers in the zone player, and/or overall construction of the zone player. As such, an optimal frequency sub-range may be determined for each zone player according to playback characteristics of the respective zone player, and the frequency sub-ranges rendered by the different zone players may be configured based on the determined respective optimal frequency sub-ranges. For example, the audio system may include a first zone player, which may include a sub-woofer and may therefore optimally render a low frequency sub-range of audio content. The audio system may further include a second zone player, which may include mid-range speakers and a tweeter, and may therefore optimally render a mid and high frequency sub-range of audio content. In one case, optimal frequency sub-ranges may be stored as state variables at the respective zone player and/or at a controller.

As mentioned before, the playback characteristics of the respective zone players may also vary based on a playback volume of the zone players. In other words, changes to the playback volume of a zone player may change the optimal frequency sub-range of the zone player. As such, embodiments herein are provided for adjusting frequency sub-ranges rendered by zone players in an audio system and the associated crossover frequencies according to changes in the playback volume of the audio system.

Figure 8:
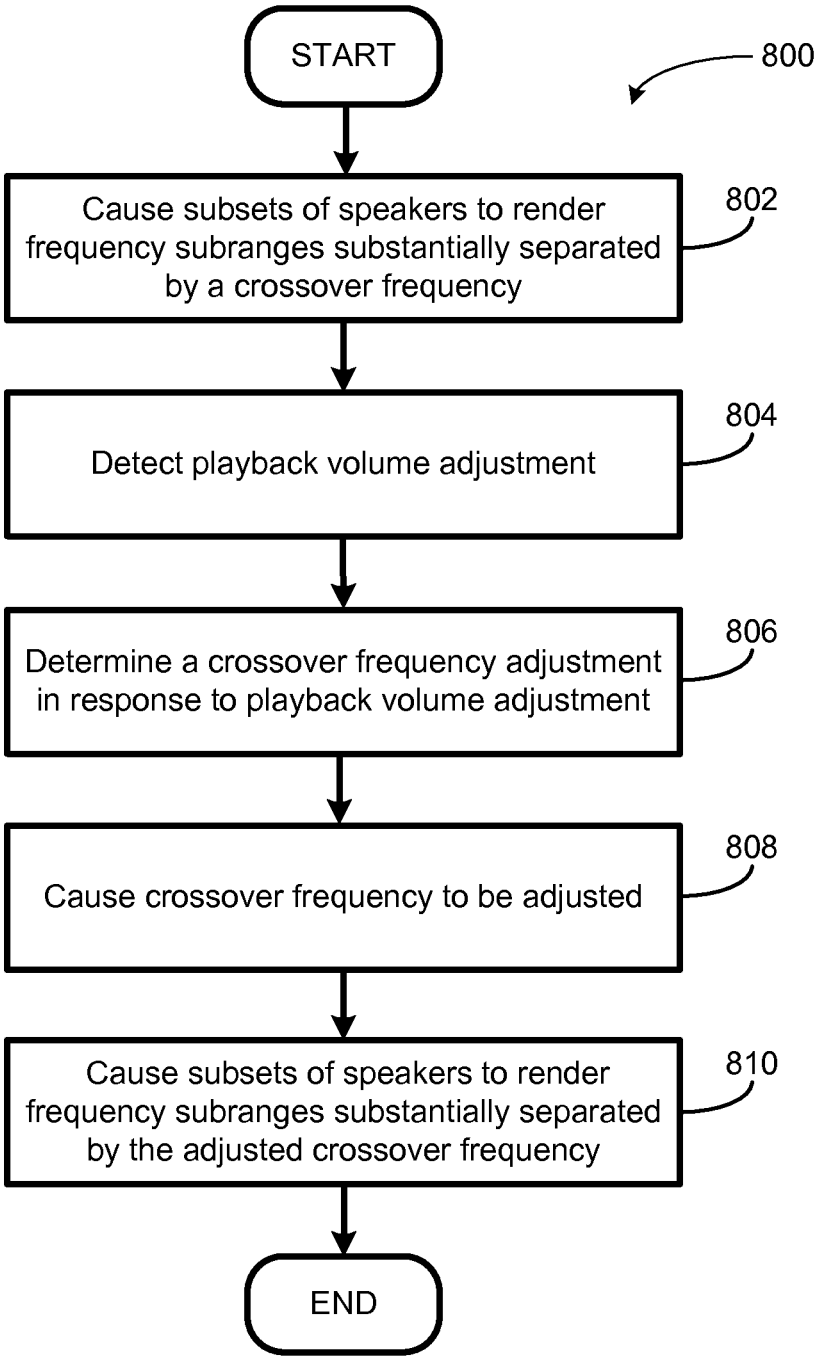
FIG. 8 shows an example flow diagram for crossover frequency adjustment.

FIG. 8 shows a first example flow diagram of a method 800 for crossover frequency adjustment, in accordance with at least some embodiments described herein. Method 800 shown in FIG. 8 presents an embodiment of a method that could be used in the environment 100 with the systems 200, 202, 204, 300, 400, and 500 for example, in communication with a device, such as devices illustrated in FIGS. 2-5, components of the devices. Method 800 may include one or more operations, functions, or actions as illustrated by one or more of blocks 802-810. Although the blocks are illustrated in sequential order, these blocks may also be performed in parallel, and/or in a different order than those described herein. Also, the various blocks may be combined into fewer blocks, divided into additional blocks, and/or removed based upon the desired implementation.

In addition, for the method 800 and other processes and methods disclosed herein, the flowchart shows functionality and operation of one possible implementation of present embodiments. In this regard, each block may represent a module, a segment, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, for the method 800 and other processes and methods disclosed herein, each block in FIG. 8 may represent circuitry that is wired to perform the specific logical functions in the process.

At block 802, the method 800 may involve causing subsets of speakers to render frequency sub-ranges substantially separated by a crossover frequency. As discussed previously, a subset of speakers in an audio system may be one or more speakers in a zone player in the audio system. The subset of speakers in the audio system may also be one or more speakers from separate zone players.

In one example, the audio system may be rendering audio content having a frequency range of 20 Hz-20,000 Hz, and may distribute playback of different frequency sub-ranges of the audio content to first and second zone players based on the optimal playback frequency ranges of the zone players. In one case, the first and second zone players may be zone players 106 and 108, respectively in the Family Room zone of FIG. 1. The distribution of different frequency sub-ranges for playback by different zone players, as discussed previously, may be for improved audio playback quality.

For instance, the first zone player may be configured to render audio content substantially in the frequency sub-range of 20 Hz-80 Hz, while the second zone player may be configured to render audio content substantially in the frequency sub-range of 80 Hz-20,000 Hz. In this example, 80 Hz may be referred to as the crossover frequency.

Figure 9A:
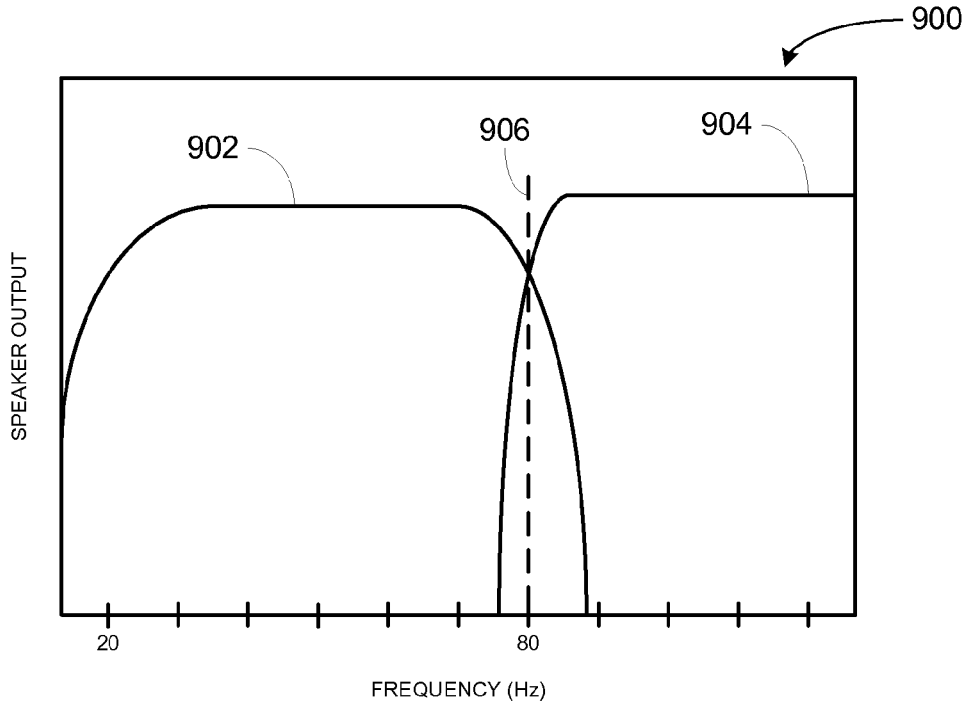
FIG. 9A shows an illustrative example of frequency sub-ranges substantially separated by a crossover frequency.

FIG. 9A shows an illustrative example of rendered frequency sub-ranges 902 and 904 substantially separated by a crossover frequency 906. As shown, the frequency sub-range of 20 Hz-80 Hz rendered by the first zone player may be represented by the frequency band 902, and the frequency sub-range 80 Hz-20,000 Hz rendered by the second zone player may be represented by the frequency band 904. Note that as illustrated, the crossover frequency 906 may represent a point where the frequency bands 902 and 904 are substantially separated. For example, the crossover frequency 906 may represent a frequency at which the output level of the frequency band 902 declines to half-power (or −3 dB), and where the output level of the frequency band 904 begins to exceed half-power.

In one example, the distribution of the different frequency sub-ranges to the first and second zone players may be performed locally at each of the zone players. For instance, both first and second zone players may receive the full frequency range of the audio content to be rendered, and may be configured to respectively filter in (or band-pass) components of the audio content to be rendered at the respective zone players. In other words, the first zone player may filter out frequencies above 80 Hz and render the remaining audio content, while the second zone player may filter out frequencies below 80 Hz and render the remaining audio content. As suggested previously, these configurations may be stored as state variables on the respective zone players and/or a controller.

In another example, the distribution of the different frequency sub-ranges to the first and second zone players may be performed at a system processor. The processor may receive state variables indicating optimal playback frequencies for zone players from the respective zone players and distribute the audio content accordingly. In this case, the system processor may filter the audio content and send audio content components filtered below or substantially below 80 Hz to the first zone player, and send audio content components filtered above or substantially above 80 Hz to the second zone player. In one case, one of the first or second zone players may be a "primary" player, which may be configured to manage the operations of the system as the system processor. In this case, if the first zone player is the primary player, the first zone player may be configured to separate or substantially separate frequency components of the audio content at the crossover frequency of 80 Hz (by various forms of audio filtering and signal processing), render the frequency components below or substantially below 80 Hz locally, and provide frequency components above or substantially above 80 Hz to the second zone player for playback.

In the course of enjoying audio content, the playback volume of the audio system may be adjusted, and at block 804, the method 800 may involve detecting such a playback volume adjustment. In one case, the playback volume may be increased by the user when a favorite song of the user is playing. In another case, the playback volume may be automatically decreased by the audio system based on a preset capping the playback volume after a certain time in the evening. In one example, the volume adjustment may be detected at a system level. For instance, the playback volume adjustment may be detected as a change in the amplification level of the audio signal by the audio system. In other words, the playback volume adjustment may refer to a change in the playback volume of the audio system. In one case, the volume adjustment may be detected when a command or request to adjust the volume is received at the system.

In another example, the volume adjustment may be detected at a hardware level. For instance, the playback volume adjustment may be detected at the output of the zone player. In one case, zone players in the audio system may include a volume detection microphone configured to detect audio speaker output levels. In another case, incremental amplifier thresholds may be implemented such that volume adjustment detection may occur when output volume from an amplifier in the zone player exceeds one of the amplifier thresholds.

In some scenarios, as described above, a default crossover frequency may be determined for a system such that an overall playback quality of the system is sufficiently adequate over a relatively wide range of equalization and volume settings. However, as mentioned above, a zone player may respond differently to the playback of the same frequency at different playback volumes. For example, a zone player rendering audio content of 100 Hz clearly at 65 dB may not render the same audio content at 90 dB as clearly. As such, the crossover frequency may be adjusted dynamically according to changes in playback volumes for improved audio content playback over a range of playback volumes.

At block 806, the method 800 may involve determining a crossover frequency adjustment in response to the detected playback volume adjustment. In one case, block 806 may involve determining whether a crossover frequency adjustment may be beneficial or necessary for improved audio content playback prior to determining the crossover frequency. In one example, determining that a crossover frequency adjustment may be beneficial or necessary may be based on thresholds determined during R&D tests.

Continuing with the above example of the system having first and second zone players, and a crossover frequency of 80 Hz, distortion may become present in the lower frequency audio components rendered by the mid-range speakers in the second zone player as the playback volume increases. In this case, the system may determine that at the increased volume, the first zone player is capable of better rendering the lower frequency audio content distorted by the mid-range speaker, and thus determine that a crossover frequency adjustment may improve the audio content playback quality.

The crossover frequency adjustment may then be determined. For instance, a crossover frequency adjustment from 80 Hz to 120 Hz may be determined to result in improved audio content playback quality. The resulting frequency sub-range may therefore be such that the first zone player now renders audio content in the frequency range of 20 Hz-120 Hz, and the second zone player now renders audio content in the frequency range of 120 Hz-20,000 Hz.

As suggested above, the adjustment of the crossover frequency may be a function of the playback volume, such that a change in the playback volume may result in a shift in the optimal crossover frequency for the system. In one case, the playback volume may refer to a volume setting of the system, as set by a user. In other words, the playback volume may not necessarily represent an actual volume of the outputted audio content, but rather a level of audio content signal amplification by a signal processor or power amplifier providing the audio content to the speakers of the zone player. In one example, the playback volume may be a value between 1 and 10.

In another case, the playback volume may refer to the actual audio output of the zone player. In this case, the audio output may be measured from the speaker output and may be represented in decibel units. The actual output of the zone player may vary depending on the audio content, even if the playback volume of the zone player is constant. For example, music often includes variations in loudness.

In either case, different playback volumes may be mapped to a corresponding optimal crossover frequency such that when the playback volume changes, whether by a user changing the playback volume or music getting louder or quieter, the crossover frequency may be dynamically adjusted for improved audio content playback. In the case the playback volume refers to a volume setting of the zone player, adjustments of the crossover frequency may occur as the volume setting of the zone player is changed. In the case the playback volume refers to the actual audio output, adjustments of the crossover frequency may occur whenever the audio output changes sufficiently such that audio content playback may be improved by adjusting the crossover frequency. In this case, crossover frequency adjustments may occur due to changes in loudness of the audio content itself, or indirectly as a result of changes to the playback volume of the zone player.

Figure 9B:
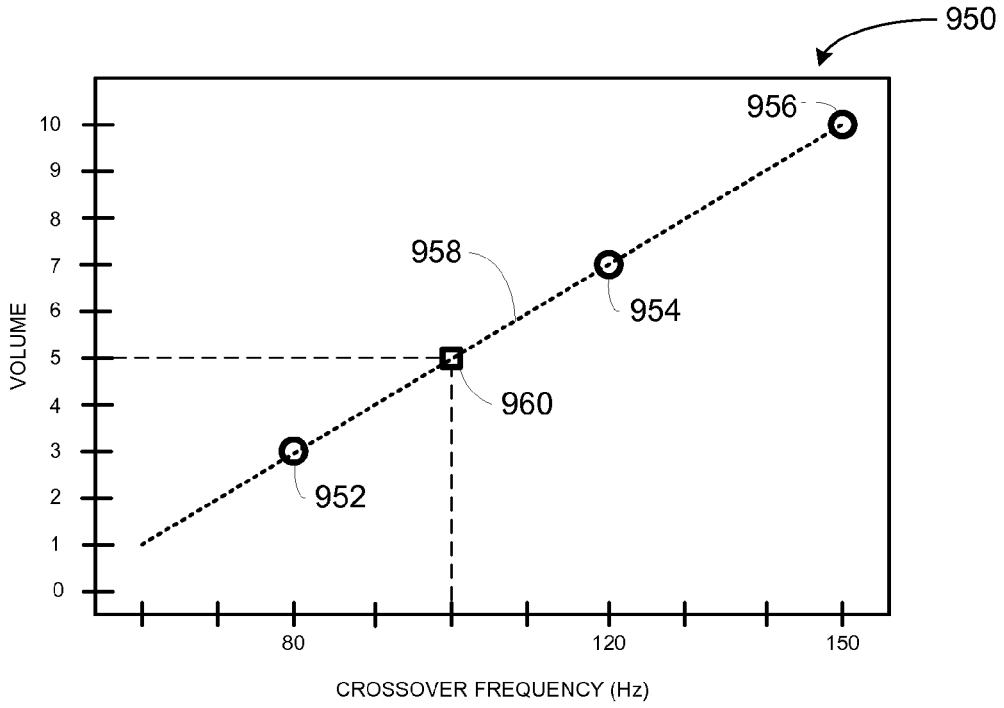
FIG. 9B shows an illustrative example of a relationship between playback volumes and optimal crossover frequencies.

FIG. 9B shows an illustrative example of a relationship curve 950 between playback volumes and optimal crossover frequencies for a zone player in an audio system. In one example, the mapping between playback volumes and corresponding crossover frequencies may be determined based on tests during R&D of the relevant zone players, to determine the optimal playback crossover frequencies at the various playback volumes. As illustrated in FIG. 9B, a crossover frequency of 80 Hz may be determined to be optimal for a volume setting of 3 out of 10, a crossover frequency of 120 Hz may be determined to be optimal for a volume setting of 7 out of 10, and a crossover frequency of 150 Hz may be determined to be optimal for a volume setting of 10 out of 10.

In the case the playback volume refers to the actual audio output, as opposed to volume setting in the above example, a crossover frequency of 80 Hz may be determined to be optimal for an audio output of 60 dB, a crossover frequency of 120 Hz may be determined to be optimal for an audio output of 80 dB, and a crossover frequency of 150 Hz may be determined to be optimal for an audio output of 90 dB.

In addition, corresponding crossover frequencies may also be mapped to different equalization settings and different playback volumes. For example, optimal crossover frequencies may be determined during R&D for a flat equalization setting (Bass, Mid, and Treble each set at 5 out of 10, for example) at volumes 3, 7, and 10, and optimal crossover frequencies may be determined during R&D for a scooped equalization setting (Bass and Treble at 8, Mid at 2, for example) for the same series of volumes 3, 7, and 10.

In such a case, relationships between playback volumes and optimal crossover frequencies such as that shown in FIG. 9B may be determined for a range of different equalization settings. In this case, adjustments to the playback equalization of the audio system or a zone player in the audio system may be detected, and corresponding crossover frequency adjustments may be determined for improved audio content playback quality at the new equalization setting. Similar examples may be provided based on actual audio output as well.

As discussed, the dynamic adjustments of crossover frequency may then be based on the mapping between playback volumes (and equalizations in some embodiments) and the corresponding optimal crossover frequencies. In one case, the crossover frequency may be adjusted step-wise, such that the crossover frequency of 80 Hz may be determined for any playback volume between 1 and 3, the crossover frequency of 120 Hz may be determined for any playback volume between 4 and 6, and the crossover frequency of 150 Hz may be determined for any playback volume 7 or over. In other words, the crossover frequency may be adjusted based on whether the playback volume surpasses one or more threshold playback volumes, for example.

In another case, a more continuous adjustment of the crossover frequency may be implemented. In this case, an interpolated crossover frequency may be determined for playback volumes without a predetermined corresponding crossover frequency. For example, as illustrated in FIG. 9B, for a playback volume of 5, which is half way between playback volumes 3 and 7, an interpolated crossover frequency of 100 Hz may be calculated as a midpoint 960 between the crossover frequencies 80 Hz and 120 Hz corresponding to the playback volumes 3 and 7, respectively. In another example, the interpolated crossover frequency may be determined from a best-fit curve representing a relationship between the playback volumes and available corresponding optimal crossover frequencies.

In yet another case, the optimal crossover frequency may be determined both step-wise and continuously. For example, a crossover frequency of 80 Hz may be determined for any playback volume between 0 and 3, while optimal crossover frequencies are interpolated for playback volumes between 3 and 10, as discussed above.

Note that in the above example, the optimal crossover frequency and the playback volume appear to be linearly related, as illustrated by the linear curve 958. This may be a simplified relationship between playback volumes and optimal crossover frequencies provided for illustrative purposes only. In some embodiments, the relationship between playback volumes and optimal crossover frequencies may be in the shape of a polynomial curve, such as an S-curve.

In a further example, crossover frequency adjustments may be determined not based on playback volume per se, but rather based on detected distortion in the rendered audio content. For example, if distortion is detected in the rendering of lower frequency components of the audio content by the mid-range speaker at a certain volume, the crossover frequency may be adjusted such that a subwoofer renders the lower frequency components of the audio content, thereby eliminating the distortion. In one case, the crossover frequency may be adjusted incrementally until the distortion is resolved. In this case, the crossover frequency corresponding to the certain volume may be stored in a state variable and used for reference when adjusting volumes in the future. For instance, a relationship curve between the optimal crossover frequency and volume maybe generated over time using this distortion elimination process each time the playback volume is adjusted.

In addition, crossover frequency adjustments may be determined based on a combination of both the mapping between playback volumes and the corresponding optimal crossover frequencies, and distortion detection. For instance, the mapping between playback volumes and corresponding optimal crossover frequencies may be utilized as a starting point when determining crossover frequency adjustments, and distortion detection may be used to refine the mapping and adjustments. In this case, the state variable storing the mapping between playback volumes and corresponding optimal crossover frequencies may be updated with the fine-tuned adjustments.

Note that thus far, discussions have been focused on crossover frequency adjustments between two zone players. In operation, the adjustment of crossover frequencies in response to detecting volume adjustments may be applied to an entire audio system having more than two zone players. In such a case, the adjustment of crossover frequencies may depend on the capabilities and characteristics of all zone players and/or speakers in the audio system. In other words, an optimal playback configuration is provided for the entire audio system, rather individual pairs of zone players.

Regardless of how the crossover frequency adjustments are determined, block 808 of method 800 may involve causing the crossover frequency to be adjusted according to the determined crossover frequency adjustment at block 806, and block 810 of method 800 may involve causing the subsets of audio speakers to render frequency sub-ranges substantially separated by the adjusted crossover frequency.

In one example, the crossover frequency adjustments may be implemented similarly to how distribution of the playback of different frequency sub-range components to the first and second zone players is implemented, as previously discussed. For example, if the distribution of the different frequency sub-range components to respective corresponding zone players is performed locally at each of the zone players, the respective corresponding zone players may continue to receive the full range of the audio content, and implement the crossover frequency adjustments by respectively filtering (or band-passing) components of the audio content according to the determined crossover frequency.

In one case, dynamic adjustment of crossover frequencies among multiple zone players may involve distributing a formula to each zone player in the audio system. The formula may be based on the availability of different zone players as well as characteristics of the different zone players or individual speakers, and may be used to determine the optimal crossover frequency when a volume adjustment to either the system or individual zone player is detected. In this instance, coefficients in the formula may be based on the characteristics of the zone players and/or individual speakers, and the input parameters may be the adjusted volume levels.

In the case the distribution of the different frequency sub-range components to the zone players is performed at a system processor (or primary player), the system processor may implement the crossover frequency adjustments by filtering the audio content according to the determined optimal crossover frequency and send to the different zone players audio content components having the respective corresponding frequency sub-ranges. Other examples of implementation may also exist.

Further, as mentioned above, while the above embodiments generally refer to a first and second zone player in the audio system, causing the subsets of audio speakers to render frequency sub-ranges substantially separated by the adjusted crossover frequency at block 810 may apply to all zone players in the audio system. In one case, different zone players in the audio system may implement different crossover frequencies based on the different playback characteristics of each zone player such that the overall playback quality of the audio system is improved. In a sense, the goal of the crossover frequencies may ultimately be to provide optimal playback quality by the audio system as a whole, and not just the individual zone players.

As mentioned above, a zone player in the system may have more than one speaker, and each of the speakers in the zone player may have a respective optimal playback frequency range. For instance, a zone player may have mid-range speakers for rendering mid frequency audio content and a tweeter for rendering high frequency audio content. Accordingly, the different speakers in the zone player may be configured to render different frequency components of the audio content based on the respective optimal playback frequency ranges, and one or more crossover frequencies may exist, defining the frequency sub-ranges rendered by the different speakers. As such, the one or more crossover frequencies between speakers within the zone player may also be adjusted in a similar manner as discussed above with respect to adjusting crossover frequencies between different zone players. Further, a corresponding frequency sub-range may be determined and adjusted accordingly, for each individual speaker in the system (not just each zone player in the system, or each speaker in a zone player). In one case, individual speaker in the system may be grouped according to their respective optimal playback frequency ranges, independent on which zone player an individual speaker is part of, and crossover frequency adjustments may be made between different groups of speakers.

While the above embodiments generally apply to crossover frequency adjustments in response to user-end or system-level adjustments to playback volume and/or equalization settings, one having ordinary skill in the art will appreciate that similar embodiments may be implemented to dynamically adjust crossover frequencies throughout the playback of audio content. For instance, in the case the audio content is a song with a wide volume range, and shifts in equalization (songs with loud and quiet section, and non-continuous sections of heavy bass), the crossover frequencies may be adjusted during playback of the audio content to provide optimal playback quality throughout the song.

Further, crossover frequency adjustments may also be made in response to changes in system configurations and/or playback characteristics. For instance, when a new zone player or speaker is added to the audio system, the audio system may adjust crossover frequencies to adapt to the addition of the new zone player or speaker, thereby providing optimal audio content playback quality. In another instance, a speaker or zone player may malfunction during the rendering of audio content. In this case, the audio system may adjust crossover frequencies to adapt to the absence of the new zone player or speaker, thereby providing optimal audio content playback quality. In either case, the updated crossover frequencies may be stored in a state variable at the respective zone player and/or the controller.

VIII. Conclusion

The descriptions above disclose various example systems, methods, apparatus, and articles of manufacture including, among other components, firmware and/or software executed on hardware. However, such examples are merely illustrative and should not be considered as limiting. For example, it is contemplated that any or all of these firmware, hardware, and/or software components can be embodied exclusively in hardware, exclusively in software, exclusively in firmware, or in any combination of hardware, software, and/or firmware. Accordingly, while the following describes example systems, methods, apparatus, and/or articles of manufacture, the examples provided are not the only way(s) to implement such systems, methods, apparatus, and/or articles of manufacture.

As provided in the embodiments discussed above, a crossover frequency between two subsets of audio speakers in a plurality of speakers may be adjusted in response to playback volume adjustments when rendering audio content. In one aspect, a method is provided. The method involves causing a first subset of a plurality of audio speakers to render a first sub-range of a range of audio frequencies of an audio content, and a second subset of speakers of the plurality of audio speakers to render a second sub-range of the range of audio frequencies. The first sub-range and the second sub-range are substantially separated at a first crossover frequency. The method may further involve detecting a playback volume adjustment of the audio content rendered by the plurality of speakers, and causing an adjustment of the first crossover frequency substantially separating the first sub-range and second sub-range based on the adjusted playback volume.

In another aspect, a system is provided. The system includes at least one processor, a non-transitory computer readable medium, and program instructions stored on the non-transitory computer readable medium. The program instructions are executable by the at least one processor to perform functions including causing a first subset of a plurality of audio speakers to render a first sub-range of a range of audio frequencies of an audio content, and a second subset of speakers of the plurality of audio speakers to render a second sub-range of the range of audio frequencies. The first sub-range and the second sub-range are substantially separated at a first crossover frequency. The functions may further involve detecting a playback volume adjustment of the audio content rendered by the plurality of speakers, and causing an adjustment of the first crossover frequency substantially separating the first sub-range and second sub-range based on the adjusted playback volume.

In yet another aspect, a non-transitory computer readable medium having instructions stored thereon is provided. The instructions are executable by a computing device to cause the computing device to perform functions including causing a first subset of a plurality of audio speakers to render a first sub-range of a range of audio frequencies of an audio content, and a second subset of speakers of the plurality of audio speakers to render a second sub-range of the range of audio frequencies. The first sub-range and the second sub-range are substantially separated at a first crossover frequency. The functions may further involve detecting a playback volume adjustment of the audio content rendered by the plurality of speakers, and causing an adjustment of the first crossover frequency substantially separating the first sub-range and second sub-range based on the adjusted playback volume.

Additionally, references herein to "embodiment" means that a particular feature, structure, or characteristic described in connection with the embodiment can be included in at least one example embodiment of the invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible medium such as a memory, DVD, CD, Blu-ray, and so on, storing the software and/or firmware.

We claim:

1. A method comprising:

receiving, via a network interface of a first playback device, digital data representing audio content at the first playback device;

receiving, via a network interface of a second playback device, digital data representing the audio content at the second playback device;

processing, via an audio processing component, the digital data representing the audio content into a digital audio signal including samples that form an audio waveform representing the audio content;

rendering a first portion of the audio content via the first and second playback devices such that:

(i) the first playback device outputs the first portion of the audio content (a) above an output power level for frequencies within a first frequency range and (b) below the output power level for frequencies within a second frequency range, wherein each frequency of the first frequency range is higher than each frequency of the second frequency range, and wherein rendering the first portion of the audio content comprises the first playback device (a) filtering the first portion of the audio content to separate the first portion of the audio content into the frequencies within the first frequency range and the frequencies within the second frequency range for output; and (ii) the second playback device outputs the first portion of the audio content (a) above the output power level for frequencies within the second frequency range and (b) below the output power level for frequencies within the first frequency range, wherein rendering the first portion of the audio content comprises the second playback device filtering the first portion of the audio content to separate the first portion of the audio content into the frequencies within the first frequency range and the frequencies within the second frequency range for output;

while rendering the first portion of the audio content, determining, based on a portion of the digital audio signal representing a second portion of the audio content, that the second portion of the audio content includes relatively higher sound pressure levels in bass frequencies than the first portion of the audio content; and based on determining that the second portion of the audio content includes relatively higher sound pressure levels in bass frequencies than the first portion of the audio content, adjusting, for the second portion of the audio content, the rendering of the audio content such that:

(i) the first playback device outputs the second portion of the audio content (a) above the output power level for the frequencies of the first frequency range and (b) above the output power level for frequencies within a portion of the second frequency range, wherein rendering the second portion of the audio content comprises the first playback device filtering the second portion of the audio content to separate the second portion of the audio content into the frequencies within the first frequency range and the frequencies within the portion of the second frequency range for output; or (ii) the second playback device outputs the second portion of the audio content (a) above the output power level for the frequencies of the second frequency range and (b) above the output power level for frequencies within a portion of the first frequency range, wherein rendering the second portion of the audio content comprises the second playback device filtering the second portion of the audio content to separate the second portion of the audio content into the frequencies within the portion of the first frequency range and the frequencies within the second frequency range for output.

2. The method of claim 1, wherein the frequencies of the first frequency range comprise frequencies up to 80 Hz, and wherein adjusting the rendering comprises adjusting the rendering such that the first playback device outputs the second portion of the audio content above the output power level for frequencies up to 120 Hz.

3. The method of claim 1, wherein the frequencies of the first frequency range comprise frequencies up to 120 Hz, and wherein adjusting the rendering comprises adjusting the rendering such that the second playback device outputs the second portion of the audio content above the output power level for frequencies between 80 and 120 Hz.

4. The method of claim 1, wherein the output power level is at least half of a maximum power level of the audio content for frequencies within the first frequency range.

5. The method of claim 1, wherein the output power level is at least half of a maximum power level of the audio content for frequencies within the second frequency range.

6. A system comprising:

a first playback device configured to receive, via a network interface of the first playback device, audio content and render a first portion of the audio content such the first playback device outputs the first portion of the audio content (a) above an output power level for frequencies within a first frequency range and (b) below the output power level for frequencies within a second frequency range, wherein each frequency of the first frequency range is higher than each frequency of the second frequency range, and wherein rendering the first portion of the audio content comprises the first playback device filtering the first portion of the audio content to separate the first portion of the audio content into the frequencies within the first frequency range and the frequencies within the second frequency range for output;

a second playback device configured to receive audio content and render the audio content such that the second playback device outputs the first portion of the audio content (a) above the output power level for frequencies within the second frequency range and (b) below the output power level for frequencies within the first frequency range, wherein rendering the first portion of the audio content comprises the second playback device filtering the first portion of the audio content to separate the first portion of the audio content into the frequencies within the first frequency range and the frequencies within the second frequency range for output;

at least one processor;

a non-transitory computer readable medium; and program instructions stored on the non-transitory computer readable medium and executable by the at least one processor to perform functions comprising:

processing, via an audio processing component, the digital data representing the audio content into a digital audio signal including samples that form an audio waveform representing the audio content;

determining, based on a portion of the digital audio signal representing a second portion of the audio content, that the second portion of the audio content includes relatively higher sound pressure levels in bass frequencies than the first portion of the audio content while the first and second playback devices are rendering the first portion of the audio content; and based on determining that the second portion of the audio content includes relatively higher sound pressure levels in bass frequencies than the first portion of the audio content, adjusting, for the second portion of the audio content, the rendering of the audio content by the first and second playback devices such that:

(i) the first playback device outputs the second portion of the audio content (a) above the output power level for the frequencies of the first frequency range and (b) above the output power level for frequencies within a portion of the second frequency range, wherein rendering the second portion of the audio content comprises the first playback device filtering the second portion of the audio content to separate the second portion of the audio content into the frequencies within the first frequency range and the frequencies within the portion of the second frequency range for output; or (ii) the second playback device outputs the second portion of the audio content (a) above the output power level for the frequencies of the second frequency range and (b) above the output power level for frequencies within a portion of the first frequency range, wherein rendering the second portion of the audio content comprises the second playback device filtering the second portion of the audio content to separate the second portion of the audio content into the frequencies within the portion of the first frequency range and the frequencies within the second frequency range for output.

7. The system of claim 6, further comprising a third playback device operably coupled to the first and second playback devices, wherein the third playback device comprises the at least one processor and the non-transitory computer readable medium, and wherein adjusting the rendering of the audio content by the first and second playback devices comprises the third playback device sending the first and second playback devices instructions to adjust the rendering of the audio content.

8. The system of claim 6, wherein the first playback device comprises the at least one processor and the non-transitory computer readable medium, and wherein adjusting the rendering of the audio content by the first and second playback devices comprises the first playback device sending the second playback device instructions to adjust the rendering of the audio content.

9. The system of claim 6, wherein the second playback device comprises the at least one processor and the non-transitory computer readable medium, and wherein adjusting the rendering of the audio content by the first and second playback devices comprises the second playback device sending the first playback device instructions to adjust the rendering of the audio content.

10. The system of claim 6, wherein the frequencies of the first frequency range comprise frequencies up to 80 Hz, and wherein adjusting the rendering comprises adjusting the rendering such that the first playback device outputs the audio content above the output power level for frequencies up to 120 Hz.

11. The system of claim 6, wherein the frequencies of the first frequency range comprise frequencies up to 120 Hz, and wherein adjusting the rendering comprises adjusting the rendering such that the second playback device outputs the audio content above the output power level for frequencies between 80 and 120 Hz.

12. The system of claim 6, wherein the output power level is at least half of a maximum power level of the audio content for frequencies within the first frequency range.

13. The system of claim 6, wherein the output power level is at least half of a maximum power level of the audio content for frequencies within the second frequency range.

14. The method of claim 1, further comprising:

determining a characteristic of a first portion of the audio content, wherein rendering the first portion of the audio content via the first and second playback devices comprises rending the first portion of the audio content based on the determined characteristic of the first portion of the audio content.

15. The method of claim 1, wherein determining that the second portion of the audio content includes relatively higher sound pressure levels in bass frequencies than the first portion of the audio content comprises a third playback device operably coupled to the first and second playback devices determining that the second portion of the audio content includes relatively higher sound pressure levels in bass frequencies than the first portion of the audio content and wherein adjusting the rendering of the audio content by comprises the third playback device sending the first and second playback devices instructions to adjust the rendering of the audio content.

16. The method of claim 1, wherein determining that the second portion of the audio content includes relatively higher sound pressure levels in bass frequencies than the first portion of the audio content comprises the first playback device determining that the second portion of the audio content includes relatively higher sound pressure levels in bass frequencies than the first portion of the audio content and wherein adjusting the rendering of the audio content comprises the first playback device sending the second playback device instructions to adjust the rendering of the audio content.

17. The system of claim 6, wherein determining that the second portion of the audio content includes relatively higher sound pressure levels in bass frequencies than the first portion comprises a third playback device operably coupled to the first and second playback devices determining that the second portion of the audio content includes relatively higher sound pressure levels in bass frequencies than the first portion of the audio content and wherein adjusting the rendering of the audio content by comprises the third playback device sending the first and second playback devices instructions to adjust the rendering of the audio content.

18. The system of claim 6, wherein determining that the second portion of the audio content includes relatively higher sound pressure levels in bass frequencies than the first portion of the audio content comprises the first playback device determining that the second portion of the audio content includes relatively higher sound pressure levels in bass frequencies than the first portion of the audio content and wherein adjusting the rendering of the audio content comprises the first playback device sending the second playback device instructions to adjust the rendering of the audio content.

19. The method of claim 1, wherein the first portion and the second portion are in non-continuous sections of the audio content.

20. The system of claim 6, wherein the first portion and the second portion are in non-continuous sections of the audio content.

* * * * *